US012329327B2

(12) United States Patent
Osborne, Jr.

(10) Patent No.: US 12,329,327 B2
(45) Date of Patent: Jun. 17, 2025

(54) SHEET MATERIAL DISPENSER ASSEMBLY FOR SELECTIVELY DISPENSING SHEET MATERIAL FROM A PLURALITY OF SUPPLIES OF ROLLED SHEET MATERIAL

(71) Applicant: Valve Solutions, Inc., Alpharetta, GA (US)

(72) Inventor: Charles Agnew Osborne, Jr., Cumming, GA (US)

(73) Assignee: VSI Health and Hygiene Group, LLC, Alpharetta, GA (US)

( * ) Notice: Subject to any disclaimer, the term of this patent is extended or adjusted under 35 U.S.C. 154(b) by 213 days.

(21) Appl. No.: 18/107,260

(22) Filed: Feb. 8, 2023

(65) Prior Publication Data

US 2023/0248189 A1 Aug. 10, 2023

Related U.S. Application Data

(60) Provisional application No. 63/337,371, filed on May 2, 2022, provisional application No. 63/307,699, filed on Feb. 8, 2022.

(51) Int. Cl.
*A47K 10/36* (2006.01)
*A47K 10/38* (2006.01)

(52) U.S. Cl.
CPC ..... *A47K 10/36* (2013.01); *A47K 10/38* (2013.01)

(58) Field of Classification Search
CPC .... A47K 10/36; A47K 10/38; A47K 10/3687; A47K 10/3612; A47K 10/3618;
(Continued)

(56) References Cited

U.S. PATENT DOCUMENTS 2,299,301 A 10/1942 Britt et al.
2,549,912 A 4/1951 Lindsay
(Continued)

FOREIGN PATENT DOCUMENTS

CN 210582329 U 5/2020
EP 0452577 A1 10/1991
(Continued)

OTHER PUBLICATIONS

International Search Report and the Written Opinion of the International Search Authority for PCT/US2019/065460, mailed Apr. 6, 2020.
(Continued)

*Primary Examiner* — William A. Rivera
(74) *Attorney, Agent, or Firm* — Womble Bond Dickinson (US) LLP

(57) ABSTRACT

A dispenser assembly facilitating selective dispensing of sheet material from a plurality of supplies of sheet material can be provided. The dispenser assembly can include a drive system that includes a plurality of driven rollers configured to engage and move sheet material from a respective supply of sheet material and a drive mechanism configured to drive the plurality of driven rollers. When the drive mechanism is driven in one direction, one of the plurality of driven rollers is rotated to dispense sheet material from one of the plurality of supplies of sheet material, and when the drive mechanism is driven in the opposite direction, another one of the plurality of driven rollers is rotated to dispense sheet material from another supply of sheet material.

19 Claims, 33 Drawing Sheets

(58) Field of Classification Search
CPC ..... A47K 10/3625; A47K 2010/3668; A47K 2010/3253
See application file for complete search history.

(56) References Cited

U.S. PATENT DOCUMENTS 2,826,373 A 3/1958 Schwartz
2,840,319 A 6/1958 Danko
3,007,650 A 11/1961 Burton
3,010,670 A 11/1961 Jones et al.
3,132,782 A 5/1964 Coates, Jr.
3,387,902 A 6/1968 Perrin et al.
3,572,600 A 3/1971 Jespersen
3,637,276 A 1/1972 Bump
3,650,487 A 3/1972 Bahnsen
3,677,485 A 7/1972 Berg
3,690,580 A 9/1972 Jespersen
3,698,653 A 10/1972 Okamura
3,700,181 A 10/1972 Diring et al.
3,737,087 A 6/1973 Rooklyn
3,754,719 A 8/1973 Choy
3,770,222 A 11/1973 Jespersen
3,771,739 A 11/1973 Nelson
3,865,295 A 2/1975 Okamura
3,948,454 A 4/1976 Bastian
4,108,389 A 8/1978 Womack
4,113,195 A 9/1978 Theunissen
4,143,827 A 3/1979 Tucker
4,148,442 A 4/1979 Baumann et al.
4,165,138 A 8/1979 Hedge et al.
4,260,117 A 4/1981 Perrin et al.
4,285,474 A 8/1981 Perez
4,307,638 A 12/1981 DeLuca et al.
4,340,195 A 7/1982 DeLuca
4,363,454 A 12/1982 Mohar
4,375,874 A 3/1983 Leotta et al.
4,422,584 A 12/1983 Dashnier et al.
4,422,585 A 12/1983 Schultz et al.
4,432,482 A 2/1984 Beausoleil
4,487,375 A 12/1984 Rasmussen et al.
4,520,968 A 6/1985 Shpigelman
4,552,315 A 11/1985 Granger
4,564,148 A 1/1986 Wentworth
4,634,192 A 1/1987 Fielding
4,765,475 A 8/1988 Kaysserian
4,796,832 A 1/1989 Schutz et al.
4,807,823 A 2/1989 Wyant
4,830,301 A 5/1989 Miller
4,836,462 A 6/1989 Bruss
4,872,601 A 10/1989 Sigmund
4,879,150 A 11/1989 Schutz et al.
4,944,466 A 7/1990 Jespersen
5,000,393 A 3/1991 Madsen
5,009,313 A 4/1991 Morand
5,265,816 A 11/1993 Collins
5,271,574 A 12/1993 Formon et al.
5,288,032 A 2/1994 Boone et al.
5,295,638 A 3/1994 Lee
5,314,131 A 5/1994 McCanless et al.
5,370,336 A 12/1994 Whittington
5,400,982 A 3/1995 Collins
5,449,127 A 9/1995 Davis
5,558,302 A 9/1996 Jesperson
5,577,634 A 11/1996 Morand
5,628,474 A 5/1997 Krueger et al.
5,636,812 A 6/1997 Conner et al.
5,645,244 A 7/1997 Moody
5,669,576 A 9/1997 Moody
5,690,299 A 11/1997 Perrin et al.
5,749,538 A 5/1998 Brown et al.
5,813,624 A 9/1998 Grasso et al.
5,868,335 A 2/1999 Lebrun
5,873,542 A 2/1999 Perrin et al.
5,954,256 A 9/1999 Niada
6,027,002 A 2/2000 Granger
6,082,664 A 7/2000 Phelps et al.
6,092,759 A 7/2000 Gemmell et al.
6,138,939 A 10/2000 Phelps et al.
6,152,397 A 11/2000 Purcell
6,189,828 B1 2/2001 Reilly
6,202,956 B1 3/2001 Grasso et al.
6,290,169 B1 9/2001 Hartley
6,315,237 B1 11/2001 Hoerner
6,328,255 B1 12/2001 Moody et al.
6,363,824 B1 4/2002 Granger
6,364,245 B1 4/2002 Paal et al.
6,382,553 B1 5/2002 Lewis et al.
6,405,972 B1 6/2002 Wakam
6,409,120 B1 6/2002 Tramontina et al.
6,412,679 B2 7/2002 Formon et al.
6,422,503 B1 7/2002 Kong
6,426,701 B1 7/2002 Levy et al.
6,491,251 B1 12/2002 Stanland et al.
6,520,372 B2 2/2003 Phelps
6,527,219 B1 3/2003 Trecartin
6,550,714 B1 4/2003 Granger
6,561,378 B1 5/2003 Roessler et al.
6,592,067 B2 7/2003 Denen et al.
6,607,160 B2 8/2003 Lewis et al.
6,648,267 B2 11/2003 Stanland et al.
6,679,409 B2 1/2004 Petterson
6,685,074 B2 2/2004 Gracyalny et al.
6,691,597 B2 2/2004 Granger
6,702,225 B2 3/2004 Newman et al.
6,715,637 B1 4/2004 Ramos
6,736,348 B1 5/2004 Formon et al.
6,736,466 B1 5/2004 Helland et al.
6,742,689 B2 6/2004 Formon et al.
6,752,349 B2 6/2004 Moody et al.
6,758,434 B2 7/2004 Kapiloff et al.
6,786,448 B2 9/2004 Arcilesi
6,826,991 B1 12/2004 Rasmussen
6,830,210 B2 12/2004 Formon et al.
6,892,620 B2 5/2005 Kapiloff
6,902,134 B2 6/2005 Green et al.
6,903,654 B2 6/2005 Hansen et al.
6,915,935 B2 7/2005 Portnoy
6,920,999 B2 7/2005 Taylor et al.
6,959,891 B2 11/2005 Kapiloff et al.
6,977,588 B2 12/2005 Schotz et al.
7,014,140 B2 3/2006 Elliott et al.
7,040,566 B1 5/2006 Rodrian et al.
7,066,423 B2 6/2006 Andersson
7,083,138 B2 8/2006 Elliott et al.
7,093,737 B2 8/2006 Tramontina et al.
7,114,676 B2 10/2006 Elliott et al.
7,124,911 B2 10/2006 Tramontina et al.
7,131,609 B1 11/2006 Lewis et al.
7,168,653 B2 1/2007 Omdoll et al.
7,182,288 B2 2/2007 Denen et al.
7,185,841 B2 3/2007 Kaufmann
7,185,843 B1 3/2007 Li
D543,402 S 5/2007 Goeking et al.
7,213,782 B2 5/2007 Osborne
7,219,852 B2 5/2007 Tramontina et al.
D543,745 S 6/2007 Goeking et al.
7,232,040 B2 6/2007 Decker et al.
7,270,292 B2 9/2007 Rasmussen
7,275,658 B2 10/2007 Decker et al.
7,287,720 B1 10/2007 Allegre et al.
7,296,765 B2 11/2007 Rodrian
7,312,782 B2 12/2007 Hiraki et al.
7,341,170 B2 3/2008 Boone
7,370,824 B1 5/2008 Osborne
7,374,065 B2 5/2008 Taylor et al.
7,380,748 B2 6/2008 Goeking et al.
7,398,944 B2 7/2008 Lewis et al.
7,422,174 B2 9/2008 Elliott et al.
7,460,013 B1 12/2008 Osborne
7,523,885 B2 4/2009 Lewis
7,527,218 B2 5/2009 Brown
7,533,845 B2 5/2009 Neveu et al.
7,554,084 B2 6/2009 Mok et al.
7,568,652 B2 8/2009 Cittadino et al.

(56) References Cited

U.S. PATENT DOCUMENTS 7,594,622 B2 9/2009 Witt et al.
7,624,664 B2 12/2009 Morris et al.
7,648,097 B2 1/2010 Cattacin et al.
7,698,980 B2 4/2010 Morris et al.
7,726,515 B2 6/2010 Sherman et al.
7,726,599 B2 6/2010 Lewis et al.
7,735,770 B2 6/2010 Conner
7,774,096 B2 8/2010 Goerg et al.
7,783,380 B2 8/2010 York et al.
7,793,882 B2 9/2010 Reinsel et al.
7,795,584 B2 9/2010 Mok et al.
7,821,155 B2 10/2010 Reinsel et al.
7,837,077 B2 11/2010 Formon et al.
7,841,556 B2 11/2010 Elliott et al.
7,841,558 B2 11/2010 Elliott et al.
7,845,593 B2 12/2010 Formon et al.
7,861,964 B2 1/2011 Cittadino et al.
7,878,446 B2 2/2011 Reinsel et al.
7,931,228 B2 4/2011 Omdoll
7,963,475 B2 6/2011 Rodrian et al.
7,967,235 B2 6/2011 Forman et al.
7,984,872 B2 7/2011 Kuehneman et al.
8,016,155 B2 9/2011 Decker et al.
8,028,867 B2 10/2011 Sterngold et al.
8,066,217 B2 11/2011 Cittadino et al.
8,082,827 B2 12/2011 Friesen et al.
8,082,828 B2 12/2011 Formon et al.
8,160,742 B2 4/2012 Goerg et al.
8,162,252 B2 4/2012 Cittadino et al.
8,165,716 B1 4/2012 Goeking et al.
8,186,551 B2 5/2012 Morris et al.
8,186,673 B2 5/2012 Michels
8,439,293 B2 5/2013 Haglietner
8,464,976 B2 6/2013 Mok et al.
8,496,198 B2 7/2013 Cittadino et al.
8,550,396 B2 10/2013 Marrs
8,584,982 B2 11/2013 Eakin
8,616,117 B2 12/2013 Evers et al.
8,651,003 B1 2/2014 Vercellone
8,800,415 B2 8/2014 Osborne
8,800,910 B2 8/2014 Shepherd
8,882,021 B2 11/2014 Cittadino et al.
8,991,647 B2 3/2015 Meyers
9,138,110 B2 9/2015 Knight et al.
9,167,941 B2 10/2015 Cittadino et al.
9,296,546 B2 3/2016 Wichmann et al.
9,357,886 B2 6/2016 Duncan et al.
9,370,283 B2 6/2016 Fellhoelter
9,635,985 B2 5/2017 Phelps
9,635,986 B2 5/2017 Phelps
9,648,995 B2 5/2017 Elliott et al.
9,756,992 B2 9/2017 Osborne
9,861,238 B2 1/2018 Phelps
9,907,441 B2 3/2018 Osborne et al.
9,918,598 B2 3/2018 Osborne
10,105,020 B2 10/2018 Carper et al.
10,123,665 B2 11/2018 Osborne, Jr. et al.
10,136,769 B2 11/2018 Osborne, Jr. et al.
10,149,579 B2 12/2018 Goltz et al.
10,213,070 B2 2/2019 Osborne, Jr.
10,299,638 B2 5/2019 Henson et al.
10,441,117 B2 10/2019 Osborne, Jr.
10,610,064 B2 4/2020 Osborne et al.
10,660,485 B2 5/2020 Johnson
10,660,486 B2 5/2020 Osborne, Jr.
10,835,086 B2 11/2020 Osborne, Jr.
11,071,415 B2 7/2021 Osborne, Jr.
11,109,721 B2 9/2021 Williams, Jr. et al.
11,109,722 B2 9/2021 Osborne, Jr.
11,142,419 B2 10/2021 Osborne, Jr.
11,154,166 B2 10/2021 Osborne, Jr.
11,246,460 B2 * 2/2022 Osborne, Jr. ..... A47K 10/3687
11,478,111 B2 10/2022 Osborne, Jr.
11,612,278 B2 3/2023 Osborne, Jr.
11,612,279 B2 3/2023 Osborne, Jr.
11,819,169 B2 * 11/2023 Osborne, Jr. ..... A47K 10/3687
12,108,916 B2 * 10/2024 Osborne, Jr. ..... A47K 10/3612
2003/0110911 A1 6/2003 Kapiloff
2003/0146337 A1 8/2003 Moody et al.
2003/0168550 A1 11/2003 Formon et al.
2004/0004152 A1 1/2004 Kapiloff et al.
2005/0167541 A1 8/2005 Osborne
2005/0171634 A1 8/2005 York et al.
2006/0236832 A1 10/2006 Cvjetkovic et al.
2007/0152010 A1 7/2007 Denen et al.
2007/0194166 A1 8/2007 Reinsel et al.
2007/0194167 A1 8/2007 Denen et al.
2007/0290094 A1 12/2007 Anderson
2008/0011772 A1 1/2008 Morris et al.
2008/0018302 A1 1/2008 Reinsel et al.
2008/0048064 A1 2/2008 Lemaire et al.
2008/0078777 A1 4/2008 Cittadino et al.
2008/0087758 A1 4/2008 Formon et al.
2008/0156926 A1 7/2008 Cattacin et al.
2008/0217350 A1 9/2008 Hansen et al.
2008/0245922 A1 10/2008 Fellhoelter
2009/0032636 A1 2/2009 Orlandi
2009/0101751 A1 4/2009 Cittadino et al.
2009/0120952 A1 5/2009 Cattacin et al.
2009/0177315 A1 7/2009 Goeking et al.
2009/0217870 A1 9/2009 Luu
2010/0044407 A1 2/2010 Yardley
2010/0170979 A1 7/2010 Lewis et al.
2010/0206979 A1 8/2010 Collins
2010/0286817 A1 11/2010 Goeking et al.
2010/0286818 A1 11/2010 Goeking et al.
2011/0042503 A1 2/2011 Hagleitner
2011/0114782 A1 5/2011 Rodrian et al.
2012/0167739 A1 7/2012 Lewis et al.
2012/0255413 A1 10/2012 Osborne, Jr.
2012/0312853 A1 12/2012 Osborne et al.
2013/0161346 A1 6/2013 Wolme et al.
2013/0320130 A1 12/2013 Osborne
2014/0158809 A1 6/2014 Borke
2014/0263811 A1 9/2014 Goeking et al.
2014/0263812 A1 9/2014 Osborne
2015/0157177 A1 6/2015 Carper et al.
2015/0238056 A1 8/2015 Fellhoelter
2015/0265108 A1 9/2015 Brickl et al.
2015/0297043 A1 10/2015 Osborne et al.
2015/0327735 A1 11/2015 Himmelmann et al.
2016/0039348 A1 2/2016 Brower et al.
2016/0120376 A1 5/2016 Massey, Jr.
2016/0227970 A1 8/2016 Diamond
2016/0353945 A1 12/2016 Osborne
2016/0353947 A1 12/2016 Osborne
2016/0353948 A1 12/2016 Zhu
2016/0374521 A1 12/2016 Sherrill
2016/0374522 A1 12/2016 Sherrill
2017/0188760 A1 7/2017 Henson et al.
2017/0320697 A1 11/2017 Merkel et al.
2017/0367547 A1 12/2017 Osborne
2018/0110380 A1 4/2018 Phelps
2018/0146829 A1 5/2018 Osborne
2018/0153360 A1 6/2018 Osborne, Jr. et al.
2018/0170703 A1 6/2018 Osborne, Jr.
2018/0177348 A1 6/2018 Swanson et al.
2019/0174972 A1 6/2019 Osborne, Jr. et al.
2019/0350414 A1 11/2019 Starkey
2019/0380546 A1 12/2019 Sexton et al.
2020/0029751 A1 1/2020 Osborne, Jr.
2020/0054177 A1 2/2020 Osborne, Jr.
2020/0187727 A1 6/2020 Osborne, Jr
2020/0205620 A1 7/2020 Osborne, Jr.
2020/0205621 A1 7/2020 Osborne, Jr.
2020/0229659 A1 7/2020 Osborne, Jr.
2020/0390295 A1 12/2020 Osborne, Jr.
2021/0085136 A1 3/2021 Bartman et al.
2021/0113033 A1 4/2021 Osborne, Jr.
2021/0330142 A1 10/2021 Osborne, Jr.
2021/0338018 A1 11/2021 Osborne, Jr.
2021/0393089 A1 12/2021 Osborne, Jr.
2022/0024709 A1 1/2022 Osborne, Jr.

(56) References Cited

U.S. PATENT DOCUMENTS

| | | | |
|---|---|---|---|
| 2022/0039614 | A1 | 2/2022 | Osborne, Jr. |
| 2022/0151445 | A1 | 5/2022 | Osborne, Jr. |
| 2023/0064043 | A1 | 3/2023 | Osborne, Jr. |

FOREIGN PATENT DOCUMENTS

| | | | |
|---|---|---|---|
| EP | 522477 | B1 | 10/1995 |
| EP | 1033100 | A2 | 9/2000 |
| EP | 1915080 | B1 | 12/2008 |
| EP | 2589325 | A2 | 5/2013 |
| GB | 2269361 | A | 2/1994 |
| JP | 07-275161 | A | 10/1995 |
| JP | 10-014819 | A | 1/1998 |
| JP | 4594187 | B2 | 12/2010 |
| KR | 1993006227 | Y1 | 9/1993 |
| WO | WO 0035328 | A1 | 6/2000 |
| WO | WO 2012/075504 | A1 | 6/2012 |

OTHER PUBLICATIONS

Extended European Search Report for related application, EP 19896280.5, dated Sep. 5, 2022.

International Search Report and the Written Opinion of the International Search Authority for PCT/US2023/012617, mailed May 26, 2023.

* cited by examiner

SHEET MATERIAL DISPENSER ASSEMBLY FOR SELECTIVELY DISPENSING SHEET MATERIAL FROM A PLURALITY OF SUPPLIES OF ROLLED SHEET MATERIAL

CROSS-REFERENCE

The present patent application claims benefit of U.S. Provisional Patent Application No. 63/307,699, filed Feb. 8, 2022, and claims benefit of U.S. Provisional Patent Application No. 63/337,371, filed May 2, 2022, titled "SHEET MATERIAL DISPENSER ASSEMBLY FOR SELECTIVELY DISPENSING SHEET MATERIAL FROM A PLURALITY OF SUPPLIES OF ROLLED SHEET MATERIAL."

INCORPORATION BY REFERENCE

The disclosure and figures of U.S. Provisional Patent Application No. 63/307,699, filed on Feb. 8, 2022, and U.S. Provisional Patent Application No. 63/337,371, filed May 2, 2022 are specifically incorporated by reference herein as if set forth in their entireties.

TECHNICAL FIELD

In one aspect, the present disclosure is directed to dispenser assemblies for rolled sheet materials, and more particularly, is directed to dispenser assemblies for selectively dispensing from a plurality of supplies of rolled sheet material. Other aspects are also described.

BACKGROUND

Dispensers for sheet materials, such as for dispensing tissue paper, paper towels, or other paper products, are commonly used in hospitals, restrooms, and other facilities. Some dispensers have more than one supply of sheet material, e.g., multiple rolls of sheet material, for dispensing/feeding. When a supply of sheet material in such dispensers is running low or has been fully dispensed, a transfer of the feeding of sheet material to a new supply generally must be performed, which often must be done manually. Accordingly, it can be seen that a need exists for a dispenser assembly that can selectively switch/transfer the feeding/dispensing of sheet material between a plurality of supplies of sheet material between a plurality of supplies of sheet material, e.g., when a supply of sheet material is running low or has been fully dispensed. The present disclosure addresses these and other related and unrelated problems/issues in the relevant art.

SUMMARY

In one aspect, the present disclosure is directed to a dispenser assembly for dispensing sheet materials such as rolls of tissue, paper towels, and/or other rolled sheet material products. The dispenser assembly generally includes a dispenser housing having a plurality of supplies of rolled sheet material supported therein.

Each supply of rolled sheet material is supported by a corresponding support assembly within the dispenser housing. In one construction, the plurality of supplies of sheet material can include a first supply of sheet material supported by a corresponding first support assembly, and a second supply of sheet material supported by a corresponding second support assembly. The first and second support assemblies can be spaced apart from each other along the dispenser housing.

The dispenser assembly further can include a dispensing system for controlling the dispensing of selected, predetermined amounts of sheet material from at least one of the plurality of supplies of sheet material. The dispensing system can include a plurality of driven roller assemblies for engaging and driving the sheet material from the supplies of rolled sheet material. Each driven roller assembly generally will be associated with at least one supply of the plurality of supplies of sheet material for dispensing sheet material therefrom. For example, the first supply of rolled sheet material can be dispensed by a first driven roller assembly and the second supply of rolled sheet material can be dispensed by a second driven roller assembly.

Each driven roller assembly can have at least one driven roller driven by a drive mechanism (e.g., a motor or other suitable drive mechanism) in communication therewith. In one variation, the drive mechanism can be operatively connected to the driven roller(s) by a belt or series of belts (e.g., one or more belts engaging a belt pulley or belt gear connected to each of the driven rollers).

The dispensing assembly further can include at least one guide roller that engages the sheet material and is rotatable with the rotation of the driven roller to help facilitate feeding and dispensing of the sheet material. The dispenser assembly further can include additional guide or pressing rollers positioned adjacent each of the driven rollers to help guide the sheet material during dispensing thereof without departing from the scope of the present disclosure.

Each of the driven rollers can be configured to rotate in a desired or selected direction, and typically can be rotated by the drive mechanism for a selected number of rotations as needed to dispense the selected amounts of sheet material from their corresponding supply of rolled sheet material, but generally will remain stationary when the drive mechanism is reversed or driven in the opposite direction. For example, each driven roller can include or can be coupled to a clutch mechanism (e.g., a hybrid or one-way clutch mechanism) or other disengageable drive connection that engages the driven roller and causes it to rotate when driven/rotated in one direction and disengages the driven roller and allows it to stay substantially stationary when driven in the opposite direction.

For example, the first driven roller can be rotated when the drive mechanism is driven in a first direction to dispense sheet material from the first supply of rolled sheet material, while the second driven roller can remain generally stationary such that sheet material is not dispensed from the second supply of rolled sheet material. When the drive mechanism is driven in a second direction, the second driven roller can be rotated to dispense selected predetermined amounts of sheet material from the second supply of rolled sheet material, while the first driven roller can be disengaged and remain generally stationary such that sheet material is not dispensed therefrom.

Accordingly, the dispenser assembly of the present disclosure provides for selective dispensing of sheet material from the plurality of supplies of sheet material as needed. For example, upon a change or reversing of the driving direction of the drive mechanism, the dispenser can switch the dispensing of sheet material from the one supply of sheet material to the other. This change or switch/transfer of feeding from one supply to another can be substantially automatic, i.e., in response to a signal from a sensor or monitoring system, by a command from a control system for the dispenser, manually by a switch upon receipt of one or more signals from a device external to the dispenser assembly, etc.

The drive assembly additionally can include a tensioning assembly including one or more biasing members for providing a substantially constant tension along the drive belt. In one variation, the one or more biasing members (e.g., including one or more tension springs) can be operatively connected to the motor (e.g., one end of the one or more springs can be connected to the motor or a support therefor, and another end of the one or more springs can be connected to the dispenser housing or a component attached thereto).

The tensioning assembly can include a bracket movably supporting the drive mechanism along the dispenser housing, and the one or more biasing members can be coupled to the bracket to bias the tensioning assembly sufficient to apply tension along the drive belt and/or for providing dampening of vibrations from an operation of the dispenser assembly.

The dispenser assembly can include at least one cutting mechanism (e.g., including a tear bar(s), serrated cutting blade(s), knife(s), or other sharpened portion(s)) positioned along the discharge of the dispenser housing for severance of dispensed sheet material from the supplies of sheet material.

The dispenser assembly can include pawl member assembly including a pivotally mounted pawl member located proximate or otherwise along the cutting mechanism such that movement of the sheet material into the cutting mechanism for severance thereof moves the pawl member from a first position to a second position. The pawl member assembly further can generate one or more signals that can be sent to a control circuit of the dispenser to notify the control circuit that a portion of the dispensed sheet material has been removed.

The dispensing assembly also can include a sheet material detection sensor including an emitter and a detector focused across at least a portion of the discharge path(s) extending through the discharge. The sheet material detection sensor can be activated by a control system of the dispenser assembly to verify that the sheet material has been removed from the discharge.

The dispensing assembly further can include a monitoring system configured to determine a supply level of the supplies of sheet material, and upon a determination that the supply level of the supplies of sheet material is below a threshold level, the direction of the drive mechanism can be changed.

Still more aspects and advantages of these embodiments and other embodiments, are discussed in detail herein. Moreover, it is to be understood that both the foregoing information and the following detailed description provide merely illustrative examples of various aspects and embodiments and are intended to provide an overview or framework for understanding the nature and character of the various aspects and embodiments disclosed herein. Accordingly, these and other objects, along with advantages and features of the present disclosure herein disclosed, will become apparent through reference to the following description and the accompanying drawings. Furthermore, it is to be understood that the features of the various embodiments described herein are not mutually exclusive and may exist in various combinations and permutations.

BRIEF DESCRIPTION OF THE DRAWINGS

The accompanying drawings, which are included to provide a further understanding of the embodiments of the present disclosure, are incorporated in and constitute a part of this specification, illustrate embodiments of the present disclosure, and together with the detailed description, serve to explain the principles of the embodiments discussed herein. No attempt is made to show structural details of this disclosure in more detail than can be necessary for a fundamental understanding of the exemplary embodiments discussed herein and the various ways in which they can be practiced. According to common practice, the various features of the drawings discussed below are not necessarily drawn to scale. Dimensions of various features and elements in the drawings can be expanded or reduced to more clearly illustrate the embodiments of the disclosure. The use of the same reference symbols in different drawings indicates similar or identical items.

DETAILED DESCRIPTION

Figure 1:
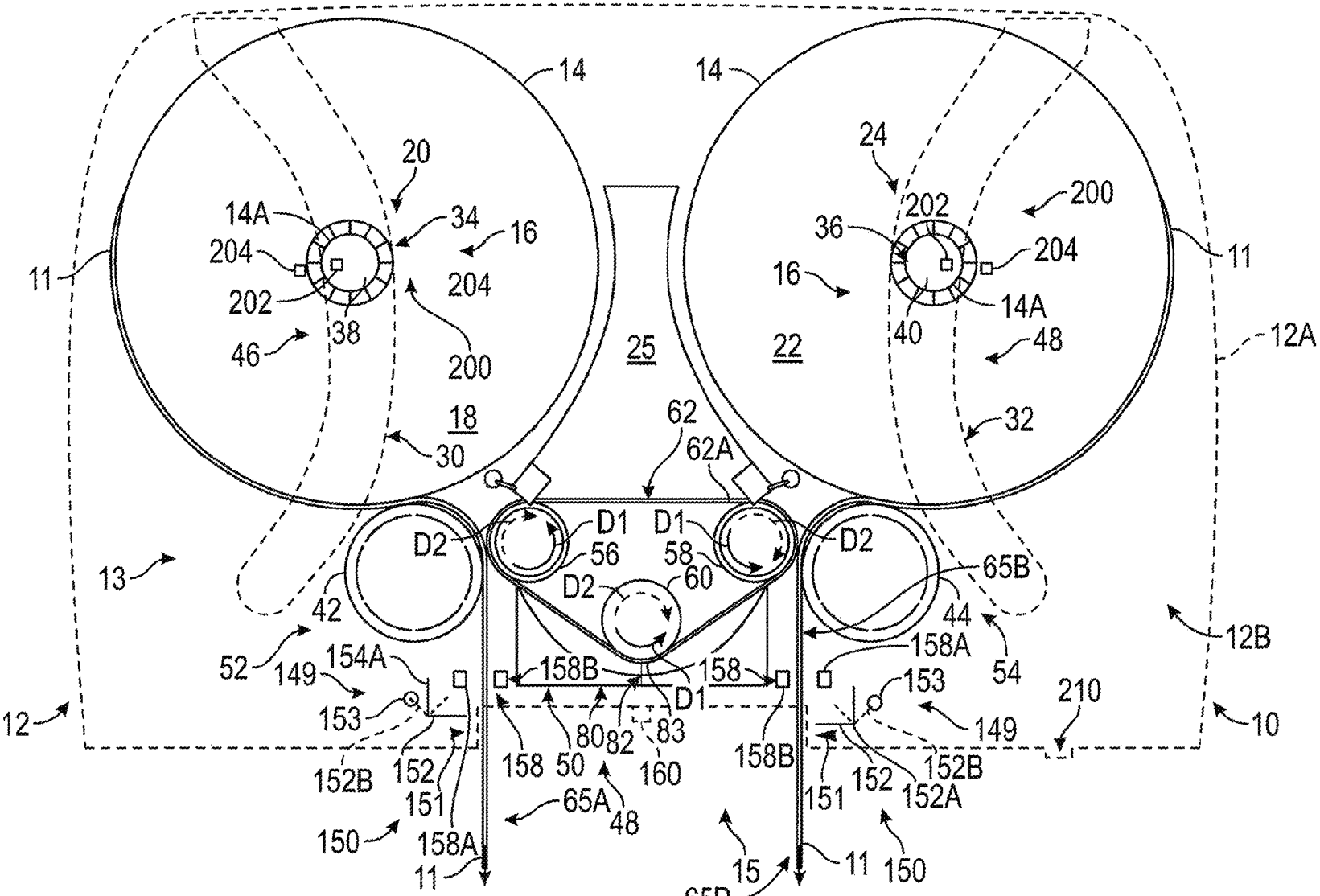
FIG. 1 provides a schematic illustration of a dispensing assembly for selectively dispensing a predetermined amount of sheet material from a plurality of supplies of sheet material according to principles of the present disclosure.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a driven roller" can include two or more such driven rollers unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "can," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular embodiment.

The phraseology and terminology used herein is for the purpose of description and should not be regarded as limiting. As used herein, the term "plurality" refers to two or more items or components. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to any claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish claim elements.

Disclosed are components that can be used to perform the disclosed methods and systems. These and other components are disclosed herein, and it is understood that when combinations, subsets, interactions, groups, etc. of these components are disclosed that while specific reference to each various individual and collective combinations and permutation of these cannot be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and systems can be understood more readily by reference to the following detailed description of preferred embodiments and the examples included therein and to the Figures and their previous and following description.

FIG. 1 shows a dispenser assembly 10 for dispensing a rolled sheet material 11, such as tissue rolls, paper towel rolls, or other suitable rolled sheet material products. As shown in FIG. 1, the dispenser assembly 10 can include a dispenser housing 12 having a cover 12A that is movable/removable to allow access to the components of the dispenser assembly 10, and a backing portion 12B that is configured to mount or otherwise connect (e.g., via fasteners, adhesive, etc.) to the dispenser assembly 10 to a wall, partition, or other suitable support within a facility, such as, for example, a restroom, hospital room, and the like. The dispenser housing 12 can be formed from plastic materials, metallic materials, other suitable synthetic or composite materials, or combinations thereof. The dispenser housing 12 further includes one or more chambers or compartments 13 defined therein and sized, dimensioned, and/or configured to receive and house a plurality of supplies 14 of sheet material 11 therein. The dispenser housing 12 also including a discharge 15, e.g., including one or more defined apertures or openings, that facilitates dispensing of the sheet material 11 of the supplies of sheet material 14 from the dispenser assembly 10.

As generally shown in FIG. 1, each supply 14 of sheet material typically includes a roll or spindle 14A with sheet material 11 wrapped or spun thereabout. The dispenser assembly 10 further includes a plurality of support assemblies 16 rotatable supporting plurality of supplies 14 within the dispenser housing 12. That is, each supply of sheet material 14 is configured to be supported by a corresponding support assembly 16 positioned with the chamber(s) 13 of the dispenser housing 12. The plurality of supplies 14 of sheet material can include a first supply 18 of sheet material that is supported by a corresponding first support assembly 20, and a second supply 22 of sheet material that is supported by a second support assembly 24. The first and second support assemblies 20/24 can be spaced apart from each other along the dispenser housing 12 as generally indicated in FIG. 1. A partition or other suitable portion 25 further can be positioned between the first and second support assemblies 20/24.

In one construction, the support assemblies 20/24 can include slots or grooves 30/32 defined in or along the dispenser housing 12 (e.g., in the cover 12A and/or backing portion 12B or other walls, portions, supports, etc. within the dispenser housing 12). The slots 30/32 can be configured to at least partially receive first and second ends 34/36 of the support roll or spindle 38/40 for the first and second supplies 18/22 of sheet material, and at least a portion of each of the supplies of sheet material being supported by and/or resting on or engaging a corresponding guide roller 42/44. The slots or grooves of the roll support assemblies 20/24 can include one or more angled or sloped portions 46/48 having a variable slope or angle to increase and/or decrease an amount of force the supply 18/22 of rolled sheet material exerts on the guide rollers 42/44. The slope of portions 46/48 can be selected such that as the sheet material is fed from the supplies 18/22 of sheet material and is depleted (e.g., the amount and thus the weight of sheet material remaining on a roll 38/40 decreases), the position of the supply rolls 18/22 will change so as to generally maintain a substantially constant downward force exerted by the sheet material supplies 18/22 on the respective guide rollers 42/44.

Figure 2A:
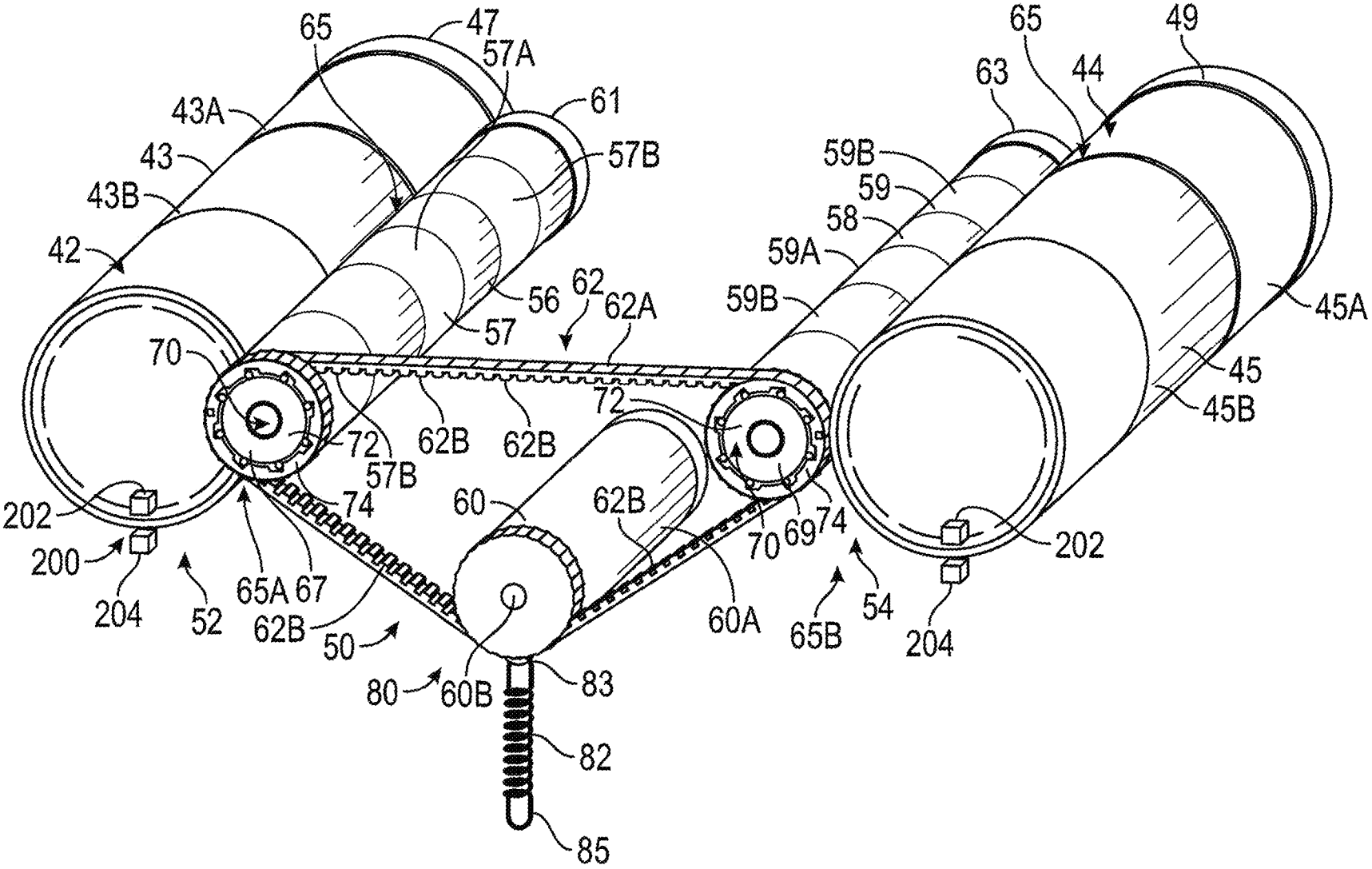
FIG. 2A shows a perspective view of a drive system for the dispensing assembly of FIG. 1.

As generally shown in FIG. 2A, the guide rollers 42/44 of the dispenser assembly 10 will be positioned along or substantially proximate, adjacent, etc. and engaging the supplies 14 of sheet material, with the first guide roller 42 engaging the first supply 18 of sheet material and the second guide roller 44 engaging the second supply 22 of sheet material. Each of the guide rollers 42/44 can include an elongated body 43/45 defining a substantially cylindrical sidewall 43A/45A configured to engage the sheet material from the supplies 18/22 of sheet material, e.g., to at least partially support the supplies 18/22 of sheet material within the slots 30/32 (FIG. 1) and to facilitate dispensing of the supplies 18/22 of sheet material from the dispenser assembly 10. The body 43/45 of the guide rollers 42/44 can be formed from a plastic material, though other materials, such as wood, elastomeric materials, such as rubber, or other composite or synthetic materials or combinations thereof, can be used without departing from the scope of the present disclosure. The guide rollers 42/44 also can include bands 43B/45B of a gripping material, e.g., including a rubber or other elastomers or synthetic materials, to assist in gripping or engaging the sheet material 11 without causing damage thereto. The guide rollers 42/44 are rotatably mounted within the dispenser housing 12. FIG. 2A shows that the guide rollers 42/44 can include bearing assemblies 47/49 attached to the guide rollers 42/44 that support the guide rollers 42/44 within the dispenser housing 12, such that the guide rollers 42/44 are rotatable thereabout (e.g., the bearing assemblies 47/49 can be fixedly connected to the backing portion 14B and/or the cover 14A or other walls, portions, supports, etc. of the dispenser assembly 12). The bearing assemblies 47/49 can include, for example and without limitation, roller bearings, ball bearings, and the like, or other suitable mechanisms that facilitate rotation of the guide rollers 42/44.

FIGS. 1 and 2A further show that the dispenser assembly 10 includes a dispensing system or mechanism 50 for selectively dispensing predetermined amounts (i.e., particular, selected lengths) of sheet material 11 from the plurality of supplies 18/22 of sheet material. The dispensing system 50 can include a plurality of driven rollers 56/58 for engaging and driving the sheet material from the supplies 18/22 of sheet material. For example, the first supply 18 of sheet material can be dispensed by a corresponding first driven roller 56 and the second supply 22 of rolled sheet material can be dispensed by a corresponding second driven roller 58. The first driven roller 56 will engage and draw or urge sheet material from the first supply 18 of sheet material along a first discharge path 65A toward and out of the discharge 15 of the dispenser housing 12, while the second driven roller 58 will engage and draw or urge sheet material from the second supply 22 of sheet material along a second discharge path 65B toward and out of the discharge of the dispenser housing 12.

Figure 5:
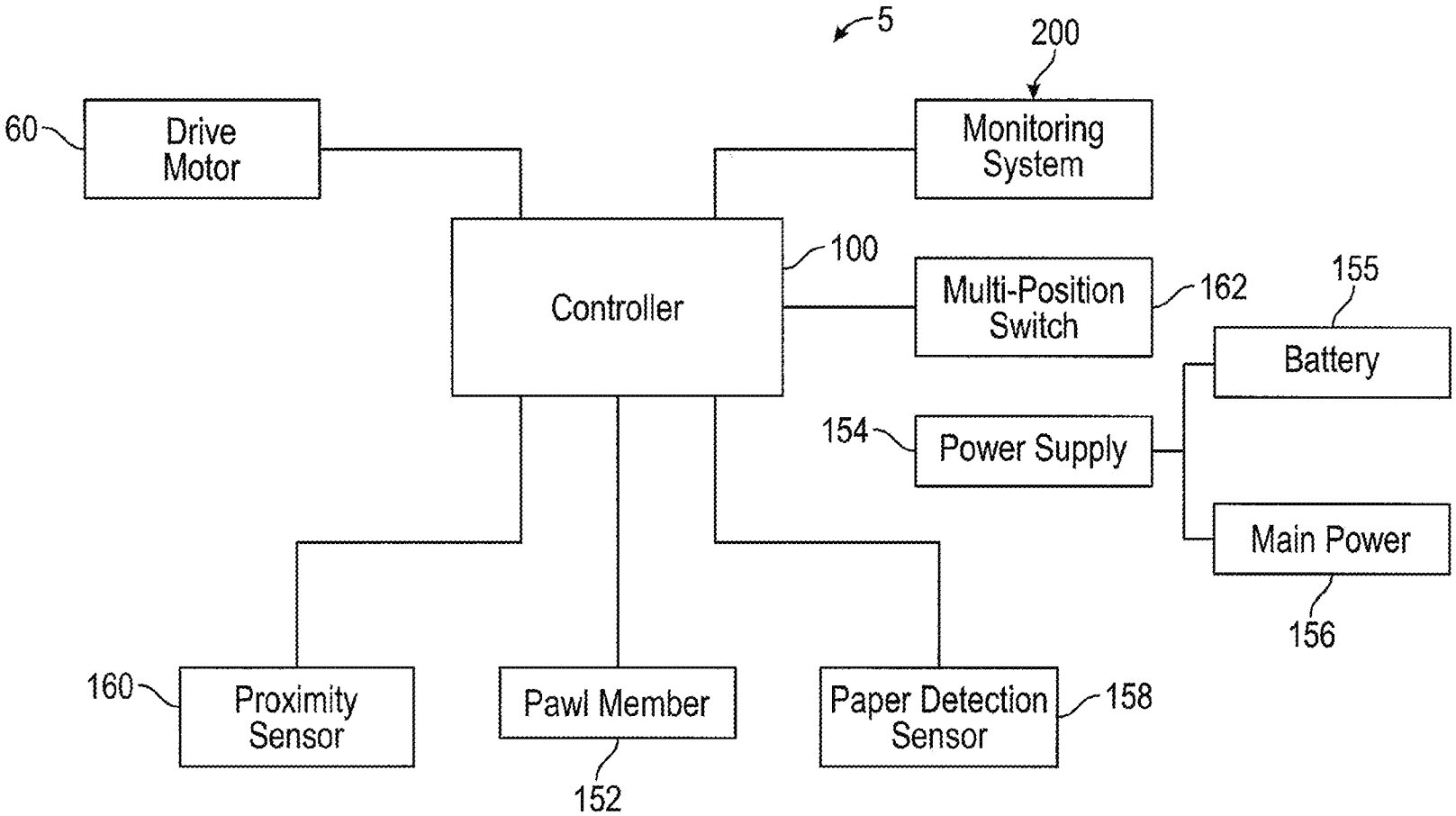
FIG. 5 shows a block diagram of an example of a control system of the dispenser assembly according to principles of the present disclosure.

As additionally indicated in FIGS. 1 and 2A, the dispenser assembly 10 includes a drive mechanism 60 operatively connected or coupled to the plurality of driven rollers 56/58 to drive rotation thereof. In one variation, the drive mechanism 60 can include a motor 60A (e.g., a brushless servo or stepper motor, or other, similar type of variable speed, reversible electric motor), though or other suitable drive mechanisms, drive systems, actuators, and/or the like can be used without departing from the scope of the present disclosure. The driven rollers 56/58 positioned substantially adjacent and along the guide rollers 42/44 rotate under the power of the drive mechanism 60 to pull the sheet material 11 from the respective supplies 18/22 and along the discharge paths 65A/B at least partially defined between the driven rollers 56/58 and associated guide rollers 42/44 and through the discharge 15 defined in the dispenser housing 12. Each driven roller 56/58 further is selectively driven/rotated by a drive mechanism 60 linked to or otherwise in communication with the driven rollers 56/58. The drive mechanism 60 communicates with a control circuitry 5 (e.g., including controller 100 as shown in FIG. 5) of the dispenser assembly 10 to receive instructions and power for selectively activating and driving the driven rollers 56/58 of each roller assembly through a dispensing cycle (e.g., a determined time, number of revolutions, etc.), to feed the selected or desired amount/length of the sheet material through the discharge 15 of the dispenser housing 12. In addition, the drive mechanism 60 can be driven in a first direction, e.g., D1 in FIG. 1, to drive the first driven roller 56 and move the sheet material from the corresponding first supply 18 of sheet material along the first discharge path 65A toward and out from the discharge 15 of the dispenser housing 12. The drive mechanism 60 also can be reversed and driven in a second direction, e.g., D2 in FIG. 1, to drive the second driven roller 58 and move the sheet material from the corresponding second supply 22 of sheet material along the second discharge path 65B toward and out from the discharge 15 of the dispenser housing 12.

FIG. 2A shows that the driven rollers 56/58 can include an elongated body 57/59 with a generally cylindrical sidewall 57A/59A that is configured to engage and pull the sheet material 11 from the respective supplies of sheet material 18/22. The driven rollers 56/58 are rotatably mounted within the dispenser housing 12 by one or more bearing assemblies 61/63 (e.g., including roller bearings, ball bearings, etc. or other suitable bearing mechanisms that facilitate rotation of the driven rollers 56/58) connected to the backing portion 12B and/or the cover 12A or other suitable wall, portion, support, etc. within the dispenser housing 12. The driven rollers 56/58 further can include bands of a gripping material 57B/59B, such as a rubber or synthetic material, to assist in pulling the sheet material between the driven rollers 56/58 and guide rollers 42/44, without causing damage to the sheet material as it passes between the driven 56/58 and guide rollers 42/44.

In some constructions, the driven rollers 56/58 and/or the guide roller 42/44 can be biased into engagement with each other (e.g., by one or more biasing mechanism, such as springs, e.g., compression springs, tension springs, torsion springs, and the like; elastic cylinders; and/or other suitable biasing mechanisms) to press or otherwise engage the sheet material between the driven rollers 56/58 and guide rollers 42/44. The roller assemblies 52/54 further can include additional guide or pressing rollers positioned adjacent the driven rollers 56/58 and/or guide rollers 42/44 to guide and/or engage the sheet material without departing from the scope of the present disclosure.

In addition, the drive system 50 can include a belt driven transmission assembly 62 including a driven belt 62A operatively connecting or engaging the driven mechanism 60 and driven rollers 56/58 to transfer power therebetween for selectively driving rotation of the first driven roller 42 and/or the second driven roller 44. For example, as indicated in FIGS. 1 and 2A, the drive mechanism 60 can be operatively connected to each of the driven rollers 56/58 by a drive belt 62A that engages corresponding belt pulleys or belt gears 67/69 connected to each of the driven rollers 56/58 and a belt pulley or belt gear 71 connected to the driven mechanism 60. The belt gears 67. 69, and 71 can include a first driven roller belt gear 67 operatively connected to the first driven roller 42; a second driven roller belt gear 69 operatively connected to the second driven roller 44; and a drive mechanism belt gear 71 operatively connected to the drive mechanism 60.

In the illustrated construction, a single belt 62 is shown operatively connected to the drive mechanism 60 (e.g., engaging the belt gear 71 that is coupled to a driveshaft 60B of the motor 60A) and to each of the driven rollers 56/58 (e.g., engaging the belt gears 67/69 attached thereto or otherwise in operative communication therewith); however, it is contemplated that a series of belts can be used to connect the drive mechanism 60 and driven roller 56/58, such as one drive belt connecting the drive mechanism 60 and driven roller 56 and another drive belt connecting the drive mechanism 60 and driven roller 58, without departing from the scope of the present disclosure. It further will be understood that in additional or alternative constructions, one or more of the driven rollers 56/58 can be connected to the driven mechanism 60 by other suitable transmission assemblies or mechanisms, such as a series of gears or other suitable transmission assemblies.

Figure 2B:
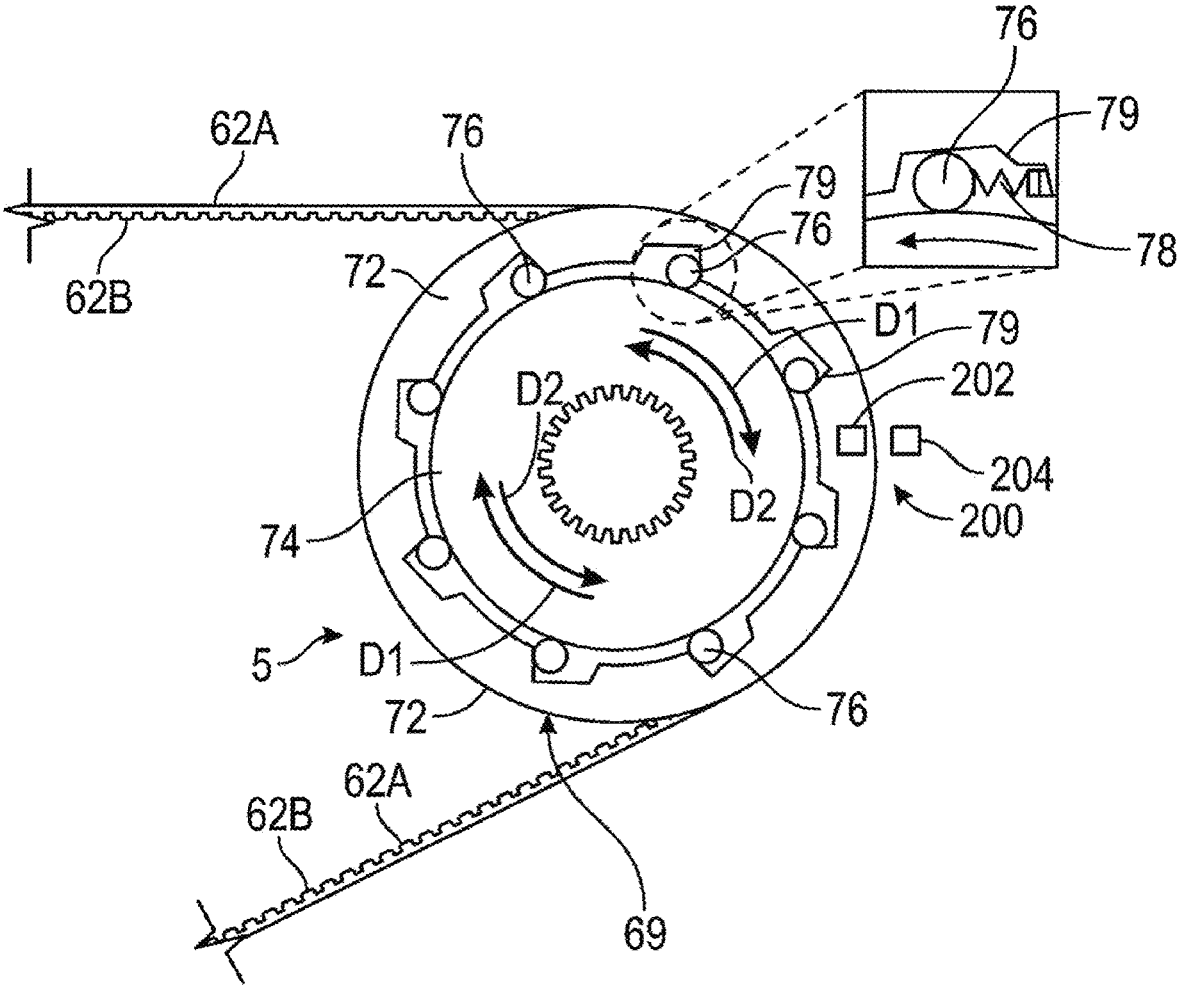
FIG. 2B shows a belt pulley of a driven roller of the drive system of FIG. 2A with an integrated clutch mechanism according to principles of the of the present disclosure.
Figure 2C:
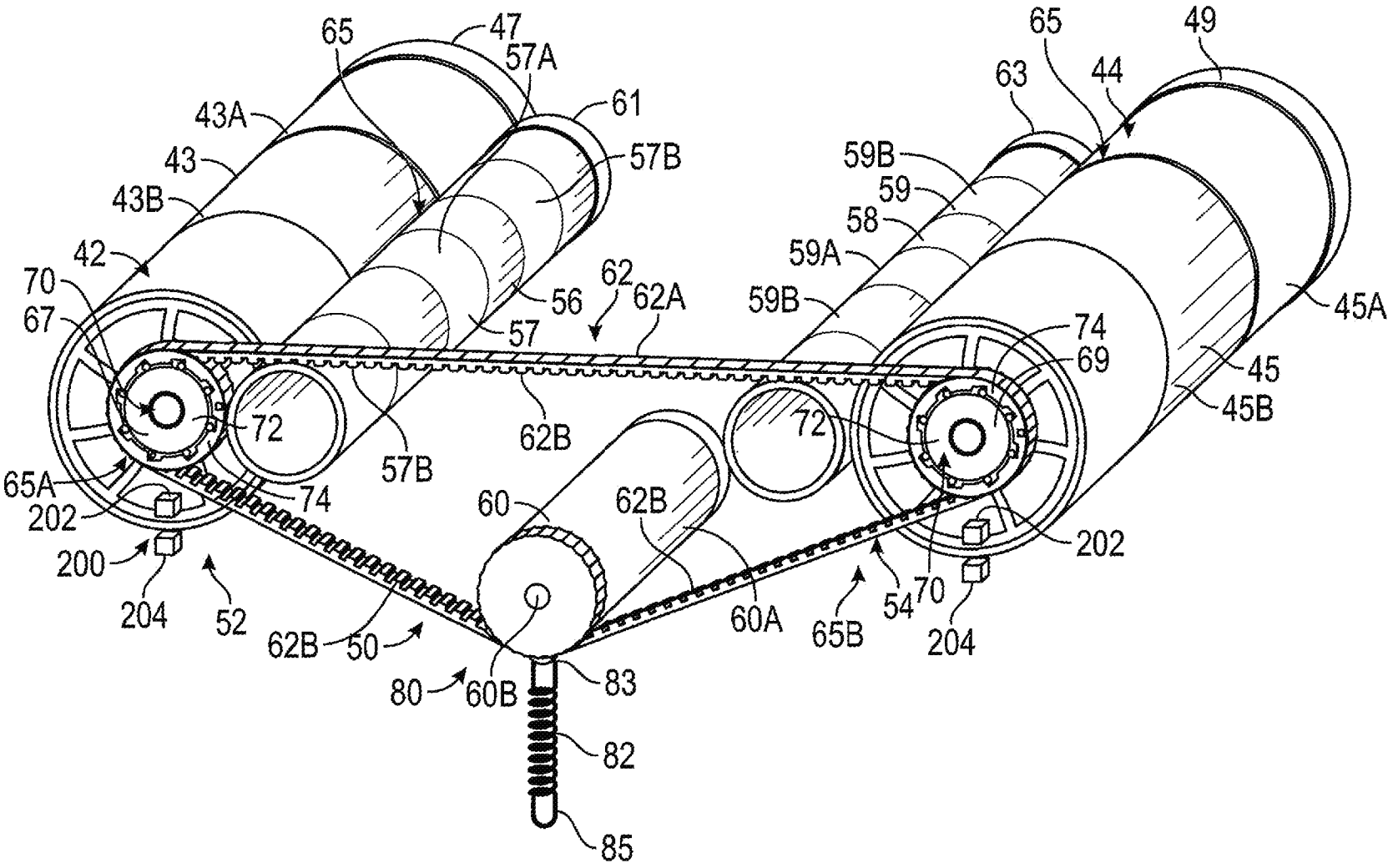
FIG. 2C illustrates a drive system according to further principles of the present disclosure.

In an additional or an alternative construction, as generally indicated in FIG. 2C, the belt gears 67/69 can be operatively connected to the rollers 42/44 (rather than rollers 56/59) such that the rollers 42/44 are driven rollers. That is, as FIG. 2C indicates, the belt 62A can engage the belt gears 67/69 attached to the ends of the driven rollers 42/44 such that the driven rollers 42/44 can be selectively driven and rotated by the drive mechanism 60. In this construction, the rollers 56/58, which are not directly engaged by the belt 62A, are allowed to float, and further can be biased into engagement with the driven rolls 42/44 (e.g., by one or more biasing assemblies including at least one biasing member, such as a spring, biased cylinder, etc.). The rollers 56/58 accordingly can be configured as guide or pressing rollers to help to direct the sheet material along the respective discharge paths 65A and 65B. In additional variations, at least one or a plurality of pressing or guide rollers can be positioned along and biased into engagement with the driven rollers 42/44. Still further, the pressing or guide roller(s) (e.g., rollers 56/58) can be coupled to the rollers 42/44 by a transmission mechanism, such as a belt driven transmission mechanism, that can transfer power between the rollers 42/44 and 56/58 and also can be configured to bias the rollers 42/44 and 56/58 towards engagement with one another.

As shown in FIGS. 1-3B, the belt 62A also can include a plurality of cogs or teeth 62B disposed thereabout and configured to engage corresponding notches, teeth, and the like in the belt gears, i.e., 67, 69, and/or 71. The belt 62A and/or the cogs 62B thereof can be formed from a rubber material, such as a chloroprene rubber, or other suitable rubber, though any suitable material can be used without departing from the scope of the present disclosure. The belt 62A also can include one or more layers or plies, including a tensile layer that comprises a reinforcement, for example, fiberglass, though the belt can comprise any suitable material, e.g., other rubbers, plastics, synthetics and/or composites, without departing from the present disclosure. Additionally, the belt 62A can include a wrapping, such as a cloth or sheet material comprising high elastic nylon, though the wrap cloth can comprise any other suitable material without departing from the present disclosure.

The driven rollers 56/58 (or driven rollers 42/44 as shown in FIG. 2C) generally are configured to be selectively rotatable to dispense amounts of sheet material 11 from their corresponding supply of sheet material 18 or 22 when driven in one direction by the drive mechanism 60, but generally will remain substantially stationary, such that sheet material 11 is not dispensed from its corresponding supply of sheet material 18 or 22, when the drive mechanism 60 is driven in the opposite direction. For example, when the first driven roller 56 is rotated by the drive mechanism 60 in a first direction D1 shown in FIG. 1, the first driven roller 56 can engage and feed/dispense sheet material from the first supply 18 of sheet material, while the second driven roller 58 remains generally stationary such that sheet material from the second supply 22 is not dispensed therefrom. When the drive mechanism 60 is driven in a second, opposite direction D2 shown in FIG. 1, the second drive roller 58 will be rotated to dispense the select/predetermined amounts of sheet material from the second supply 22 of sheet material while the first driven roller 56 remains generally stationary, such that the sheet material is not dispensed from the first supply 18 of rolled sheet material. Accordingly, the dispenser assembly 10 can provide for selective dispensing of the plurality of supplies 18 or 22 of sheet material by controlling the driving direction of the drive mechanism 60. Thus, sheet material 11 can be dispensed from one supply of sheet material 18 or 22, until such supply is substantially dispensed or exhausted, after which the direction of the drive mechanism 60 can be switched/changed (e.g., reversed or otherwise altered) to transfer to and begin dispensing the sheet material 11 from the other supply of sheet material 18 or 22.

The driven rollers 56/58 (or driven rollers 42/44 as shown in FIG. 2C) also can include or incorporate a clutch assembly or mechanism 70, such as a hybrid or one-way clutch mechanism, that allows for selective transfer of power between the drive mechanism 60 and the driven rollers 56/58 (or driven rollers 42/44 as shown in FIG. 2C), such as generally shown in FIGS. 2A and 2B. For example, as FIGS. 2A-2C indicate, the clutch assembly 70 can be incorporated or integrated with the belt gears 67/69 connected to the driven rollers 56/58 (or rollers 42/44 as shown in FIG. 2C). Accordingly, when the drive mechanism 60 is driven in a first direction D1, the clutch assembly 70 of the first driven roller 56 will lock/engage for transfer of power/torque to the first driven roller 56 so that the first driven roller 56 is driven by the drive mechanism 60 and rotated to dispense its corresponding supply 18 of sheet material (while the clutch assembly 70 of the second driven roller 58 remains generally disengaged such that the second driven roller 58 is substantially stationary as no power/torque is transferred from the drive mechanism 60 and the second driven roller 58). In addition, when the drive mechanism 60 is driven in the opposite direction D2, the clutch assembly 70 for the first driven roller 56 will unlock or disengage such that there is no transfer of power/torque between the drive mechanism 60 and the first driven roller 56 such that the first driven roller 56 remains generally stationary (while the clutch assembly 70 for the second driven roller 58 engages or locks for transfer of power/torque to the second driven roller 58 so that the second driven roller 58 is rotated to dispense its corresponding supply 22 of sheet material).

In one example construction, as generally indicated in FIG. 2B, each clutch assembly 70 can include one or more tracks/races, such as inner and outer races 72/74, that rotate together (when engaged) or independently of one another (when disengaged). The clutch assembly 70 further can include a plurality of biased rollers or bearings 76 can be received between the inner and outer races and can be biased such as by a series of springs 78 or other biasing mechanisms, toward/against corresponding surfaces or other engagement portions 79 of the outer race 74 to stop or prevent rotation of the bearings 76 and provide engagement or coupling between the inner 72 and outer 74 races. For example, as indicated in FIG. 2B, when the inner race 72 is rotated in the direction D1 shown in FIG. 2B upon rotation of the driven mechanism 60, the bearings 76 are engaged and urged into the surfaces 79, which blocks or prevents rotation of the rollers 76, allowing the inner race 72 to engage, drive, and rotate the outer race 74 and thus rotate the driven roller 58 to facilitate feeding of sheet material from its corresponding supply 22. And, when the inner race 72 is rotated in the opposite direction D2 shown in FIG. 2B, the rollers 76 move away from and do not engage the outer race 74 (e.g., do not engage the engagement portions 79) under the control of the springs 78, such that the rollers 76 can rotate or spin freely allowing the inner race 72 to turn independently of the outer race 74, such that the driven roller 58 does not rotate and remains generally stationary.

The dispenser assembly 10 further can include a tensioning assembly 80 including one or more biasing members 82. For example, as shown in FIGS. 1, 2A, and 3A-B, the one or more biasing members 82 can be operatively connected to the drive mechanism 60 for biasing the drive mechanism 60, such as to provide tension along the drive belt 62A (e.g., to substantially prevent, reduce, or inhibit wear, slippage, etc. thereof) and/or to provide dampening for the drive mechanism 60 (e.g., dampening or absorbing motor vibrations or other components of the drive system). In one example, the biasing member(s) 82 can include a tension spring(s) 82A with one end 83 thereof operatively connected to the drive mechanism 60 (or part/component connected to the drive mechanism 60 or a bracket, support, frame, etc. supporting the drive mechanism within the dispenser housing 12) and another end thereof 85 operatively connected to a portion of the dispenser housing 12.

Figure 3A:
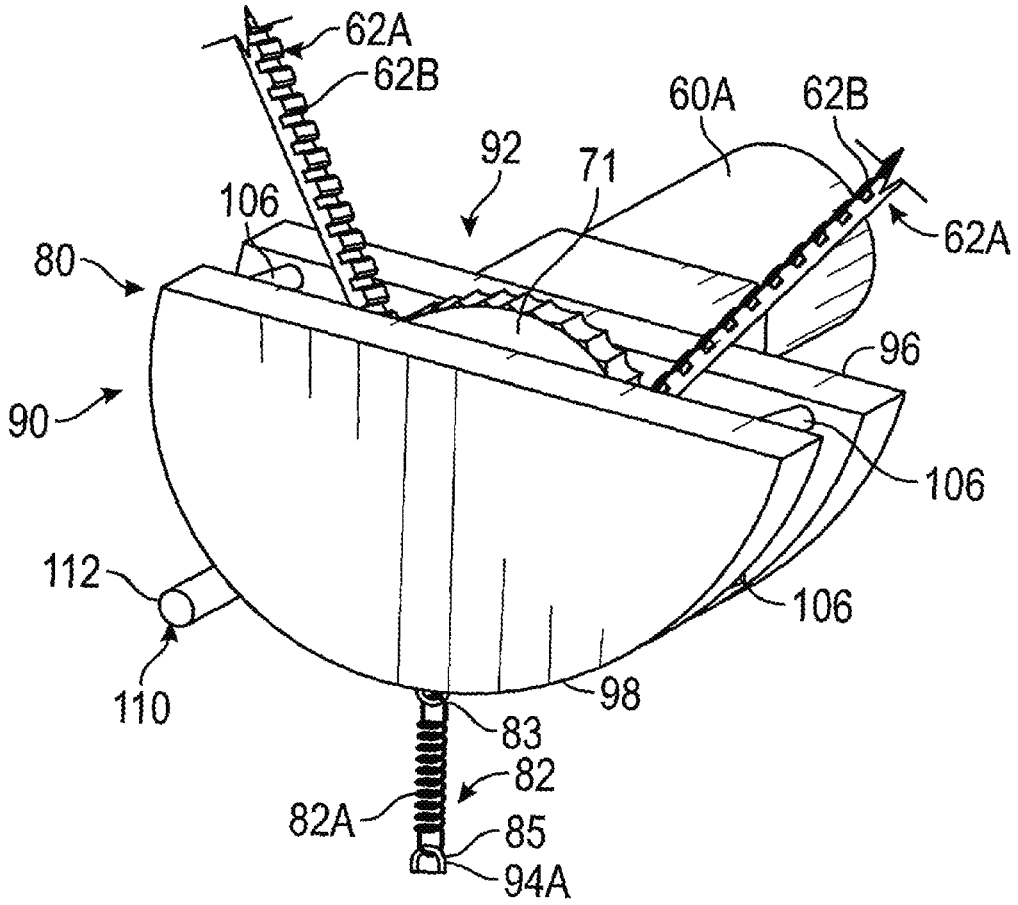
FIGS. 3A-3B illustrate examples of a cutting mechanism and pawl member according to example constructions of the present disclosure.
Figure 3B:
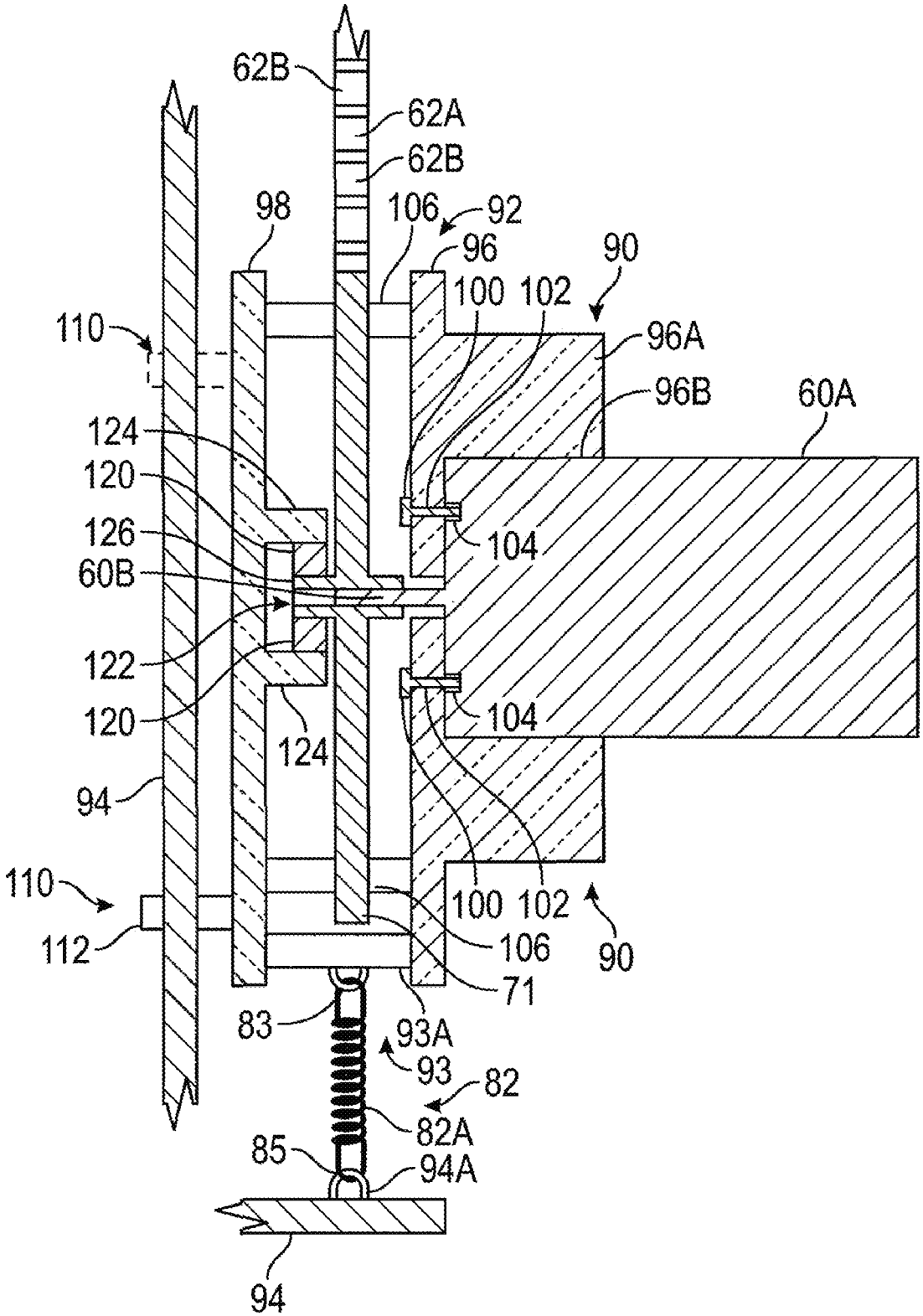

FIGS. 3A and 3B illustrate perspective and cross-sectional views of a tensioning assembly 80 according to one example construction of the present disclosure. As indicated in FIGS. 3A and 3B, the tensioning assembly 80 can include a support assembly 90 including a bracket 92 that is connected to and supports the drive mechanism 60 (i.e., the motor 60A and the belt gear 71 attached thereto) and that is movably connected to the dispenser housing 12 (e.g., movably connected to a wall, support, etc. 94 of, or otherwise connected to, the dispenser housing 12 (FIG. 3B). The bracket 92 further includes one or more connection mechanisms 93 that are configured to connect to the biasing member(s) 82. That is, one hooked, or looped end 83 of the biasing member(s) 82 can be connected to the connection mechanism 93 (e.g., including a rod 93A or other suitable connection mechanism, such as a hooked or looped connection mechanism), and the opposite, hooked or looped end 85 of the biasing member 82 can be operatively connected to a wall, support or other suitable portion 94 of the dispenser housing 12 (e.g., via a hooked or looped connection mechanism 94A or other suitable connection mechanism, such as a rod, projecting portion, etc.). Accordingly, the tensioning assembly 80 provide tension, e.g., a tensile force or stresses, along the drive belt 62A (e.g., to substantially prevent, reduce, or inhibit slippage, premature wear, etc. thereof) and also to provide dampening for the dispenser assembly 10 during operation thereof (e.g., to dampen or absorb vibrations of the motor 60A, or other components of the drive assembly, such as to reduce noise generated thereby).

The bracket 92 can include a first portion or section 96 that is connected to the motor 60A, and a second portion or section 98 that is movably connected to the wall 94 of the dispenser housing 12. The first portion 96 of the bracket 92 can be connected to the motor 60A by one or more fasteners 100, such as screws, bolts, and the like. For example, the fasteners 100 can be received through holes 102 (e.g., threaded or unthreaded holes) defined through the first portion 96 and can also be tightened into or otherwise received in corresponding threaded holes 104 of the motor 60A to secure the motor 60A to the first portion 96. The first portion 96 further can include a flange or projecting portion 96A that defined a passage or opening 96B that is sized, dimensioned, and/or configured for receipt of the motor 60A, e.g., to facilitate a frictional or snap fitting between the motor 60A and the first portion 96.

The first portion 96 further can be connected to the second portion 98 by support rods or posts 106, one or more of which can be integrally formed with the first 96 and/or second 98 portions, as generally shown in FIGS. 3A and 3B. The support rods 106 further include a passage or opening defined therethrough, which can include threads or be unthreaded and allow for the receipt of a fastener, such as for example and without limitation, a bolt, screw, and/or the like, that can be received through corresponding holes in the first 96 and/or second 98 portions to facilitate attachment of the first 96 and/or second 98 portions. The support rods 106 can be otherwise attached to the first 96 and/or second 98 portions, such as, for example and without limitation, using an adhesive, frictional or fitted connection, without departing from the scope of the present disclosure.

As additionally indicated in FIGS. 3A and 3B, the tensioning assembly 80 can include a movable connection mechanism 110 that movably connects the second portion 98 to a wall 94 of the dispenser housing 12, i.e., such that the bracket 92 can move under the guidance or control of the biasing member(s) 82. In one construction, the moveable connection mechanism 110 can include a bearing assembly 112 that is rotatably or pivotally connected to the wall 94 of the dispenser housing 12. The bearing assembly 112 can include one or more roller bearings or other suitable bearings, bushings, or mechanisms that allow for pivoting or rotation of the bracket about the bearing assembly 112. In an alternative construction, the connection mechanism 110 can include a plurality of fasteners, such as, for example and without limitation, screws, bolts, and the like, and the second portion 98 of the bracket 92 can be connected to the wall 94 by the plurality of fasteners, which can be received within slots or other elongated apertures defined in the wall 94 to allow for sliding movement of the bracket 92 under the guidance or control of the biasing member(s) 82.

FIGS. 3A and 3B further show that the second portion 98 of the bracket 92 can at least partially support the belt gear 71 connected to the driveshaft 60B of the motor 60A, as well as the driveshaft 60B, itself. For example, the tensioning assembly 80 can include a belt gear bearing assembly 120 (for example and without limitation, ball bearings, roller bearings, and/or the like) that is at least partially received within and engages an opening or passage 122 defined within a flange or projecting portion 124 of the second portion 98 of the bracket 92 (e.g., such that the bearing assembly 120 is supported thereby), and that also engages the belt gear 71. For example, the bearing assembly 120 engages a flange or other projecting portion 126 formed with the belt gear 71 (e.g., the flange 126 is at least partially fitted into or otherwise received within a passage 128 of the bearing assembly 120). Accordingly, the bracket 92 at least partially supports the belt gear 71 and/or driveshaft 60B of the motor 60A, e.g., such that the motor 60A and belt gear 71 move as a substantially unitary structure to help to reduce, inhibit, or prevent bending, twisting, or other unwanted movement of the driveshaft 60A and/or belt gear 71 due to the urging of the biasing member 82 and/or operation of the dispenser assembly 10. This further can help to reduce or inhibit premature and/or uneven wear or other damage to the motor 60A, belt gear 71, and/or other components of the drive assembly or dispenser assembly.

Figure 4A:
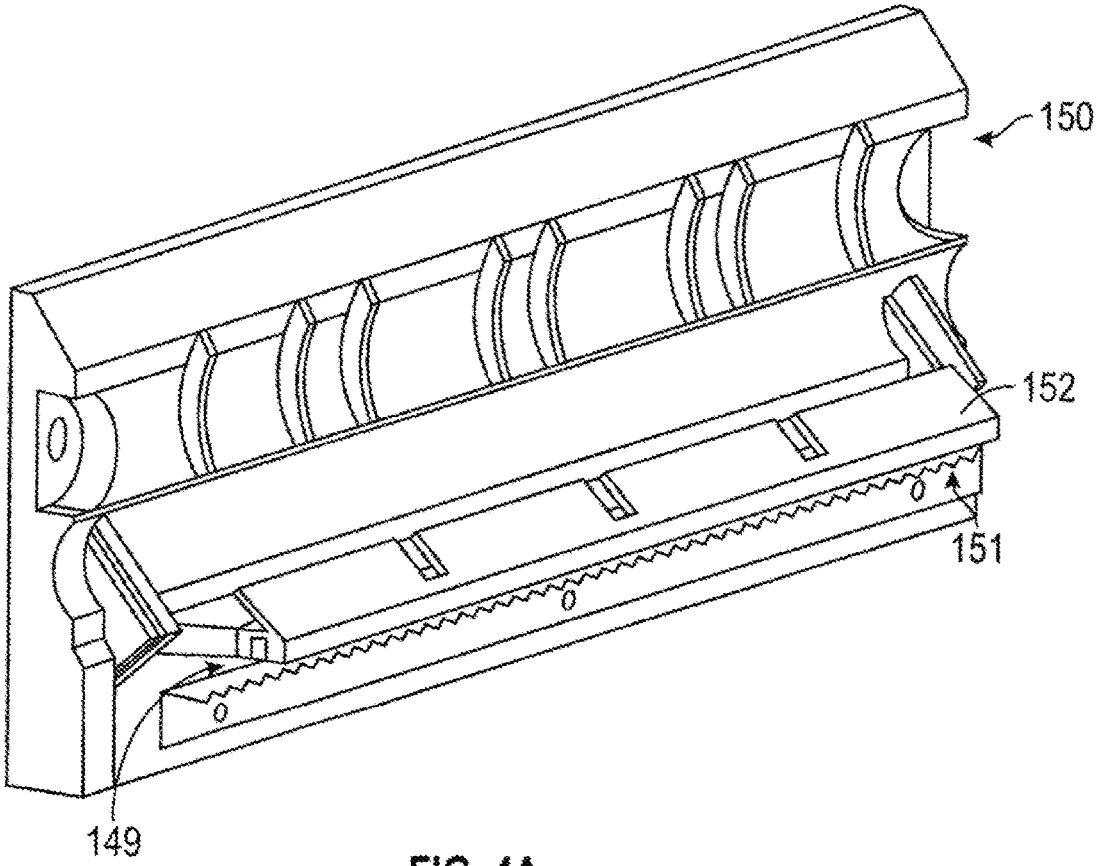
FIGS. 4A-4B show perspective and cross-sectional views of a tensioning assembly according to principles of the present disclosure.
Figure 4B:
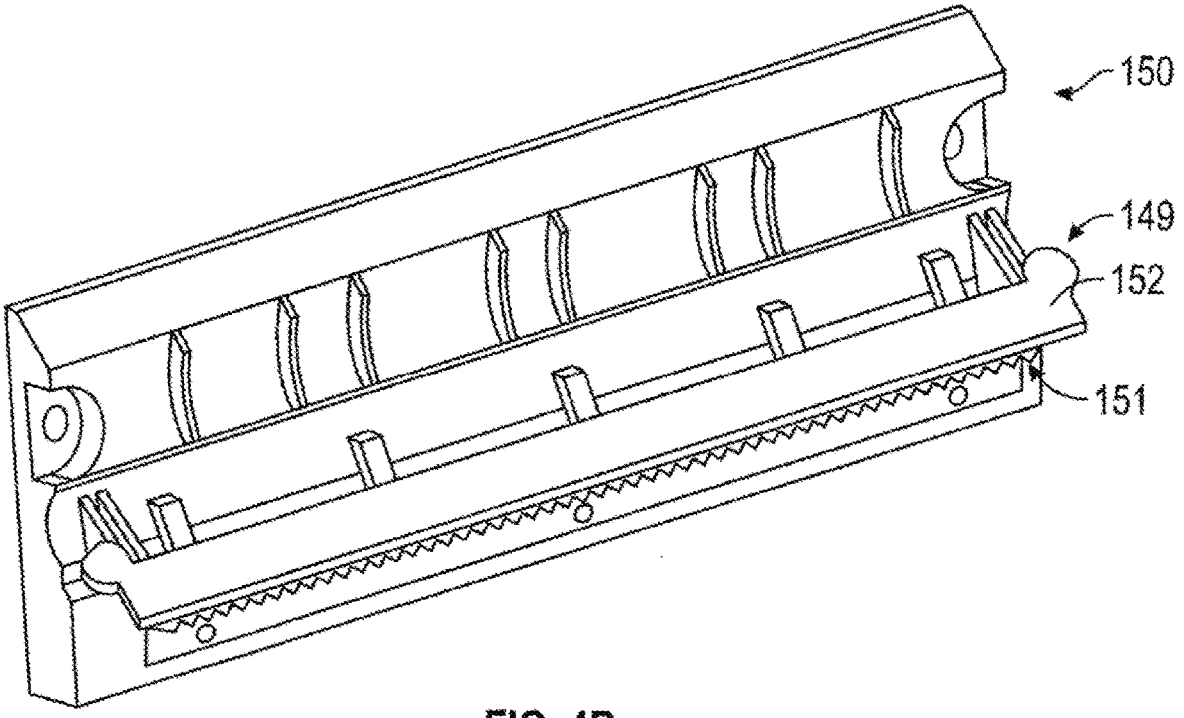

The dispenser assembly 10 also can include a cutting mechanism/assembly 150 for cutting or severance of dispensed sheet material. In one construction, as shown in FIGS. 1, 4A, and 4B, the dispenser housing may include one or more tear bars or other suitable cutting members 151 disposed adjacent or along the discharge 15 of the dispenser housing 12 so that a user can separate a sheet or measured amount of the material by grasping and pulling the sheet across the tear bar 151. In addition, or in alternative constructions, the dispenser assembly 10 can include one or more cutting mechanisms that are incorporated with the guide rollers 42/44 and/or the driven rollers 56/58 and are configured to move with rotation thereof to cut, sever, and/or perforated the sheet material 11 as or after it is dispensed from the supplies 18 or 22 of sheet material.

As additionally shown in FIGS. 1, 4A, and 4B, the dispenser assembly 10 can include a pawl member assembly 149 including a pivotally mounted pawl member 152 that is located proximate to the tear bar 151 such that movement of sheet material into the tear bar 151 for severance pivots the pawl member 152 between multiple positions 152A/152B. The pawl member assembly 149 also includes a signal device 153, such as a proximity sensor switch or the like, cooperative with the pawl member 152, that is arranged such that movement of the pawl member 152 between various positions causes the signal device 153 to send a signal to notify the control circuit or controller 5 that the sheet material has been removed. That is, movement of the sheet material into the cutting mechanism 150 generally will move the pawl member 152 from a first position 152A to a second position 152B, which activates the signal device to transmit one or more signals to the control circuitry 5 to notify the control circuit 5 that a portion of the dispensed sheet material has been removed. By way of example, such signal device 153 responsive or cooperative with the pawl member 152 can include an infrared emitter and detector that detects movement of the pawl member 152 between first 152A and second 152B positions, though any suitable sensor or detection mechanism can be employed such as, for example and without limitation, a proximity sensor or other detector, a magnetic switch, a mechanical switch, or the like.

After receiving a signal that sheet material may have been removed, the control circuitry 5 further can activate a sheet material detection sensor 158 (FIGS. 1 and 5) to verify that the sheet material has been removed from the discharge 15. The sheet material detection sensor 158 can include an emitter 158A/B and a detector 158A/B on opposing sides of and focused across at least a portion of one or more of the discharge paths 65A/B. One or more signals transmitted from the sheet material detection sensor 158 can indicate that sheet material is present or absent from the discharge path 65A/B or discharge 15 (e.g., indicating that sheet material has been removed by a user). The sheet material detection sensor 158 further can be activated by the control circuitry 5 of the dispenser assembly 10 to verify that sheet material has been removed from the discharge 15. Examples of pawl members and sheet material detection sensors are shown and described in U.S. patent application Ser. No. 13/155,528, the disclosure of which is incorporated herein by reference as if set forth in its entirety.

The control circuitry 5 can change the driving direction of the driving mechanism 60 based on signals received from the pawl member assembly 149 and/or the sheet material detection sensor 158, e.g., to reverse the motor 60A and alternate dispensing between the supplies 18/22 of sheet material. For example, if the control circuitry 5 receives one or more signals from the signal detection device 153 and/or the sheet material detection sensor 158 that indicate that sheet material cannot be dispensed from one of the supplies 18 or 22 of sheet material (e.g., indicating an error condition, sheet material jam, etc. or that the sheet material has been exhausted from the supply 18 or 22), the control circuitry 5 can generate and transmit one or more signals to the drive mechanism 60 to change the driving direction thereof to dispense from the other supply 18 or 22 of sheet material. In addition, signals received from the signal device 153 and/or the sheet material detection sensor 158 can be used by the control circuitry 5 to calculate, estimate, or otherwise determine a supply level or amount of sheet material remain in the supplies 18 or 22 of sheet material. In one example, the control circuitry 5 can determine the supply level based on the number of times signals are received from the signal device 153 and/or the sheet material detection sensor 158 (e.g., the original amount of sheet material, the lengths of sheet material being dispensed, and the number of activation times for the pawl member 152 and/or sheet material detection sensor 158 can be used to determine the remaining amount of sheet material in the supply). And, when the supply level is at or below a threshold level, such as, for example and without limitation, exemplified threshold levels of 0%, 5%, 15%, and the like, the control circuitry 5 can generate one or more signals to change the direction of the motor 60A and dispense the sheet material from the other supply. The control circuitry 5 further can generate and transmit one or more alerts, alarms, notifications, if/when the control circuitry 5 determines that one or both of the supplies 18/22 are below a threshold level, such as, for example and without limitation, exemplified threshold levels 0%, 5%, 15%, 30%, and the like, and/or one or more signals received from the signal device 153 and/or the sheet material detection sensor 158 indicate an error condition, sheet material jam, etc.

The dispenser assembly 10 further can include a monitoring system 200 in communication with the control circuitry 5 (e.g., with the controller 100 thereof as shown in FIG. 5) and configured to determine a supply level or remaining amount of sheet material of the supplies 18/22 of sheet material. In response to such information/determination, the control circuitry 5 can initiate or change the direction of the motor, e.g., when an amount of remaining sheet material is sensed less than a threshold volume. In one construction, as generally indicated in FIG. 1, the monitoring system 200 can include magnets 202 connected to the support rolls 38/40 of the first and second supplies 18/22 of sheet material supply, with the magnets 202 being rotatable therewith during dispensing thereof. In one construction, as indicated in FIG. 1, the monitoring system 200 can include a single magnet 202 connected to the support rolls 38/40; however, a plurality of magnets, for example and without limitation, a ring of magnets with alternating polarities, can be arranged along the support rolls 38/40, without departing from the scope of the present disclosure. In addition, or in alternative constructions, the monitoring system 200 can include a magnet 202 and/or magnets connected to the guide rollers 42/44 (FIG. 2A) and/or the driven rollers 56/58 (FIG. 2B).

In addition, as shown in FIGS. 1 and 2A-2B, the monitoring system 200 can include a sensor 204 arranged substantially proximal or adjacent each magnet 202 or plurality of magnets. The sensor 204 can include, for example and without limitation, a reed switch, a hall element, proximity sensor, or other suitable sensor operable to measure or otherwise capture variations, fluctuations or other changes in a magnetic field generated as each corresponding magnet 202, or plurality of magnets, is rotated with the supplies 18/22 of sheet material, guide rollers 42/44, and/or driven rollers 56/58 during dispensing and passes by the corresponding sensor 202. The detected variations, fluctuations or changes of the magnetic field can be correlated to number of rotations of the supplies of sheet material 18/22, guide rollers 42/44, and/or driven rollers 56/58, and/or a rotation angle of the supplies of sheet material 18/22, guide rollers 42/44, and/or driven rollers 56/58 for dispensing a desired length of the sheet material during each dispensing operation. By substantially continuously monitoring the number of rotations of the supplies of sheet material 18/22, guide rollers 42/44, driven rollers 56/58, and/or the number of rotations the driving mechanism 60 during dispensing operations, a diameter of the supplies 18/22 of sheet material can be substantially dynamically or continuously determined during or following each dispensing operation (e.g., the diameters can be determined during or after each dispensing operation) and, based on this determined/monitored diameter, an amount of sheet material remaining likewise can be dynamically determined, e.g., by the controller 100 of the control circuitry 5 based on signals received from the monitoring system 200. Additionally, other sensing devices or mechanisms, such as encoders or other detectors that can monitor and provide a measurement of the number of rotations of the supplies of sheet material 18/22, guide rollers 42/44, driven rollers 56/58, and/or drive mechanism 60 can be used, without departing from the scope of the present disclosure. One example monitoring system is described in U.S. patent application Ser. No. 15/922,157 which is incorporated by reference herein as if set forth in its entirety.

Furthermore, when the processor 100 of the control circuitry 5 determines that the supply level of one of the supplies 18 or 22 is at or below a threshold level, such as, for example and without limitation, exemplified threshold levels of 0%, 5%, 15%, and the like, based on one or more signals received from the monitoring system 200, the control circuitry 5 can generate one or more signals to change the direction of the motor 60A and dispense the sheet material from the other supply 18 or 22. In particular, upon a determination that the supply level of the first supply 18 of sheet material is below a threshold level, the direction of the drive mechanism can be changed from the first direction D1 in FIG. 1 to the second direction D2 in FIG. 1 to dispense the sheet material 11 from the second supply 22 of sheet material. Likewise, upon a determination that the supply level of the second supply 22 of sheet material is below a threshold level, the direction of the drive mechanism 60 can be changed from the second direction D2 in FIG. 1 to the first direction D1 in FIG. 1 to dispense the sheet material 11 from the first supply 22 of sheet material. The control circuit 5 further can generate and transmit one or more alerts, alarms, notifications, if/when the control circuit 5 determines that the supply level of one or both of the supplies 18/22 is below a threshold level, such as, for example and without limitation, exemplified threshold levels of 0%, 5%, 15%, 30%, 40%, and the like.

In addition, or in the alternative, a switch 210 disposed along the dispenser housing 12 can be manually activated by a system operator to change the direction of the dispensing mechanism 60, e.g., between directions D1 and D2 shown in FIG. 1; though the direction can be changed using any suitable means, such as, for example and without limitation, an electronic device (e.g., computer, smart phone, tablet, and the like) configured to be managed by a system operator can be used to change the direction of the drive mechanism 60. For example, the control circuitry 5 can include one or more receivers/transmitters configured to communication with the electronic device, and the control circuitry 5 can change the direction of the drive mechanism based on one or more signals received from the electronic device.

FIG. 5 illustrates a block diagram of the electronic control system or control circuitry 5 for operating the dispenser assembly 10 in an exemplary embodiment. The control circuitry generally includes a controller 100 that can include one or more processors (e.g., microprocessors) and one or more memories (e.g., RAM, ROM, etc.). One or more of the memories can store instructions, workflows, control software, and the like that are accessed and executed by the processor for carrying out operations or functions of the dispenser assembly 10. The dispenser or operative components of the dispenser may be powered by a power supply 154 such as one or more batteries 155 contained in a battery compartment of the dispenser housing 12, though any suitable battery storage device may be used for this purpose. Alternatively, or in addition to battery power, the dispenser may also be powered by a building's power distribution system, such as the exemplified alternating current (AC) distribution system as indicated at 156. For this purpose, a plug-in modular transformer/adapter can be provided with the dispenser assembly 12, which connects to a terminal or power jack port located, for example, in the bottom edge of the circuit housing for delivering power to the control circuitry and associated components. The control circuitry 5 also may include a switch, such as, for example and without limitation, a mechanical or electrical switch, that can be configured to isolate the battery circuit upon connecting the AC adapter in order to protect and preserve the batteries.

In one example, a sensor, such as a proximity detector or other sensor 160, may be configured to detect an object placed in a detection zone external to the dispenser assembly 10 to initiate operation thereof. This sensor 160 may be a passive sensor that detects changes in ambient conditions, such as, for example and without limitation, ambient light, capacitance changes caused by an object in a detection zone, and the like. In an alternate embodiment, the sensor 160 may be an active device and include an active transmitter and associated receiver, such as, for example and without limitation, one or more infrared (IR) transmitters and an IR receiver. The transmitter transmits an active signal in a transmission cone corresponding to the detection zone, and the receiver detects a threshold amount of the active signal reflected from an object placed into the detection zone. The control circuitry 5 generally will be configured to be responsive to the sensor for initiating a dispense cycle upon a valid detection signal from the receiver. For example, the proximity sensor 160 or other detector can be used to detect the presence of a user's hand. In some variations, the sheet material detector sensor 158 also can be aligned to detect a user's hand below the dispenser assembly 10 and can include a second infrared emitter/detector pair aligned to detect a sheet hanging in or below the discharge 15.

The controller 100 of the control circuitry can control activation of the dispensing mechanism upon valid detection of a user's hand for dispensing a measured length of the sheet material. In one variation, the control circuitry 5 can track the running time of the motor 60A, and/or receive feedback information directly therefrom indicative of a number of revolutions of the driven roller and correspondingly, an amount of the sheet material feed thereby. In addition, or as a further alternative, as discussed, monitoring systems, such as, for example and without limitation, sensors, and the like, and associated circuitry may be provided for this purpose. Various types of sensors can include, for example and without limitation, IR, radio frequency (RF), capacitive or other suitable sensors, and any one or a combination of such sensing systems can be used. The control circuitry 5 also can control the length of sheet material dispensed. Any number of optical or mechanical devices may be used in this regard, such as, for example and without limitation, an optical encoder may be used to count the revolutions of the guide or driven rollers, with this count being used by the control circuitry 5 to meter the desired length of the sheet material to be dispensed.

The processing logic for operation of the dispenser assembly 100 in, for example, and without limitation, hand sensor and butler modes, can be part of the control software stored in the memory of the controller 100 of the control system 5. One or more binary flags can also be stored in memory and represent an operational state of the dispenser (e.g., "sheet material cut" set or cleared). An operational mode switch in dispenser can be configured to set the mode of operation. For example, in the hand sensor mode, the proximity (or hand) sensor 160 can detect the presence of a user's hand below the dispenser housing 12 and, in response, the drive mechanism 60 can be actuated or otherwise operated to dispense a measured amount of sheet material from one of the supplies 18 or 22. Subsequently, the control circuitry 5 can be configured to monitor when the sheet of material is removed. For example, actuation of the pawl member 152 or triggering/activation of a sheet material detection sensor 158 can determine the removal of sheet material and reset the proximity sensor 160. The proximity sensor 160 also can configured to control or otherwise not allow additional sheet material to be dispensed until the proximity sensor is reset. It is contemplated that, if the proximity sensor 160 detects the presence of a user's hand but does not dispense sheet material, the control circuit can be configured to check for sheet material using the sheet material detection sensor 158. If sheet material has not been dispensed (i.e., no sheet material is hanging from the dispenser), the drive mechanism 60 can be activated to dispense a next sheet.

A multi-position switch 162 also can be provided to switch the dispenser operation between a first or standard operation mode and a second mode, such as a butler mode. In the butler mode, the proximity sensor 160 that is configured to detect the presence of a user's hand/object can be deactivated, and the controller 100 can automatically dispense sheet material when the cover is closed and the dispenser assembly 10 is put into operation. The sheet material detection sensor 158 further can determine if a sheet is hanging from the dispenser. If sheet material is hanging, the controller 100 will then monitor when the sheet of material is removed. For example, a cutting mechanism movement detector, which can be configured to detect actuation or movement of the cutting mechanism; the pawl member 152; and/or the sheet material detection sensor 158 can determine the removal of sheet material and can subsequently reset the dispenser assembly 10. The next sheet will be dispensed automatically. However, if the sheet material detection sensor 158 determines the absence of hanging sheet material, the drive mechanism 60 will be activated to dispense the next sheet. Subsequently, the controller 100 will determine if the sheet has been removed before dispensing another sheet.

Optionally, the dispenser assembly 10 is configured to be operative in the first mode and, as such, to be responsive to a signal from the proximity sensor 160 to dispense a sheet of material. Optionally, the dispenser assembly 10 is operative in the second mode to dispense a next sheet in response to the signal means being activated by movement of the pawl member 152 in response to dispensed sheet material being removed from the dispenser assembly 10. In another optional variation, the dispenser assembly 10 can be configured to operate in a second mode to dispense a next sheet in response to the signal means 153 being activated by movement of the pawl member 152 and a signal from a sheet material detection sensor 158 that the sheet material has been removed from the dispenser assembly 10.

The dispenser assembly 10 generally can be configured to dispense a measured length of the sheet material, which may be accomplished by various means, such as, for example and without limitation, a timing circuit that actuates and stops the operation of the motor 60A driving the driven rollers 56/58 after a predetermined time. In one optional variation, the motor 60A can be configured to provide direct feedback as to the number of revolutions of the driven rollers 56/58, which is indicative of an amount of the sheet material fed thereby. Alternatively, a motor revolution counter can be configured to measure the degree of rotation of the driven rollers 56/58 and is operatively interfaced with control circuitry 5 (e.g., the controller 100 thereof) to stop the motor 60A after a defined number of revolutions of the motor 60A and/or the driven rollers 56/58. This motor revolution counter may be, for example and without limitation, an optical encoder type of device, a mechanical device, or the like. The control circuitry 5 can optionally include a device to allow maintenance personnel to adjust the sheet length by increasing or decreasing the revolution counter set point. In a further aspect, the multi-position switch 162 can also be configured to be in operable communication with the control circuitry 5 to select one of a plurality of time periods as a delay between delivery of an initial sheet and delivery of a next sheet to the user. Embodiments of the present disclosure described herein can also utilize concepts disclosed in U.S. Pat. Nos. 7,213,782 and 7,370,824, both of which are incorporated by reference herein as if set forth in their entireties, as well as U.S. patent application Ser. No. 13/155,528, which also is incorporated by reference herein as if set forth in its entirety.

FIGS. 6-18 show a dispenser assembly 410 for dispensing a rolled sheet material 11 and a dispensing system or mechanism 450 for a dispenser according to another embodiment of the disclosure, which embodiment is generally similar to the prior embodiments except for variations noted and variations that will be apparent to one of ordinary skill in the art. Accordingly, similar or identical features of the embodiments have been given like or similar reference numbers. In the embodiment of FIGS. 6-18, the dispenser assembly 410 is similar to the dispenser assembly 10 of FIGS. 1-5 except that the dispensing system 450 includes a gear driven transmission assembly 462 (FIGS. 10 and 14-18) rather than the belt driven transmission assembly 62 of the dispensing system 50 (FIGS. 1-2C).

Figure 6:
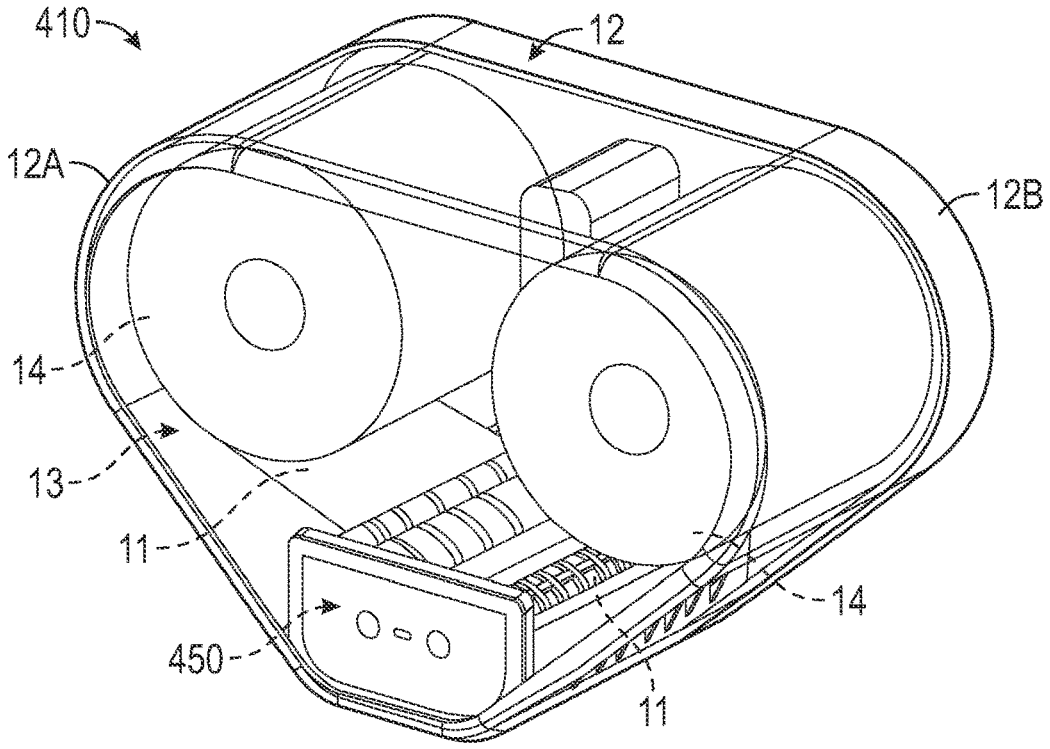
FIGS. 6-8 are views of a dispenser assembly according to additional embodiments of the disclosure.
Figure 7:
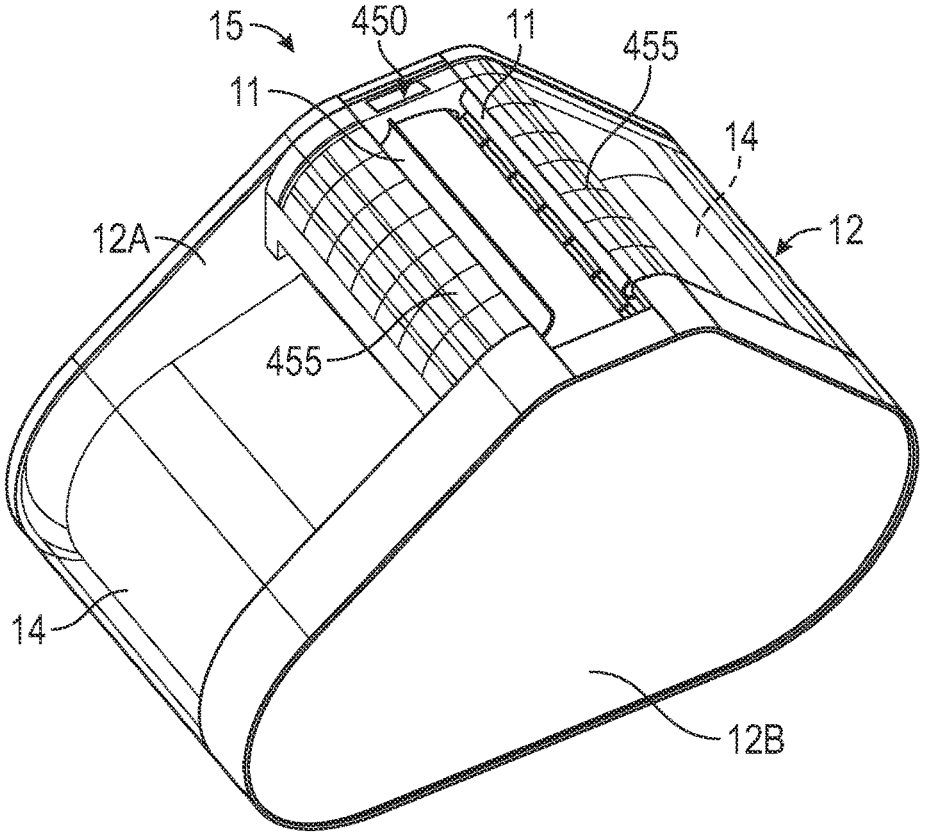
Figure 8:
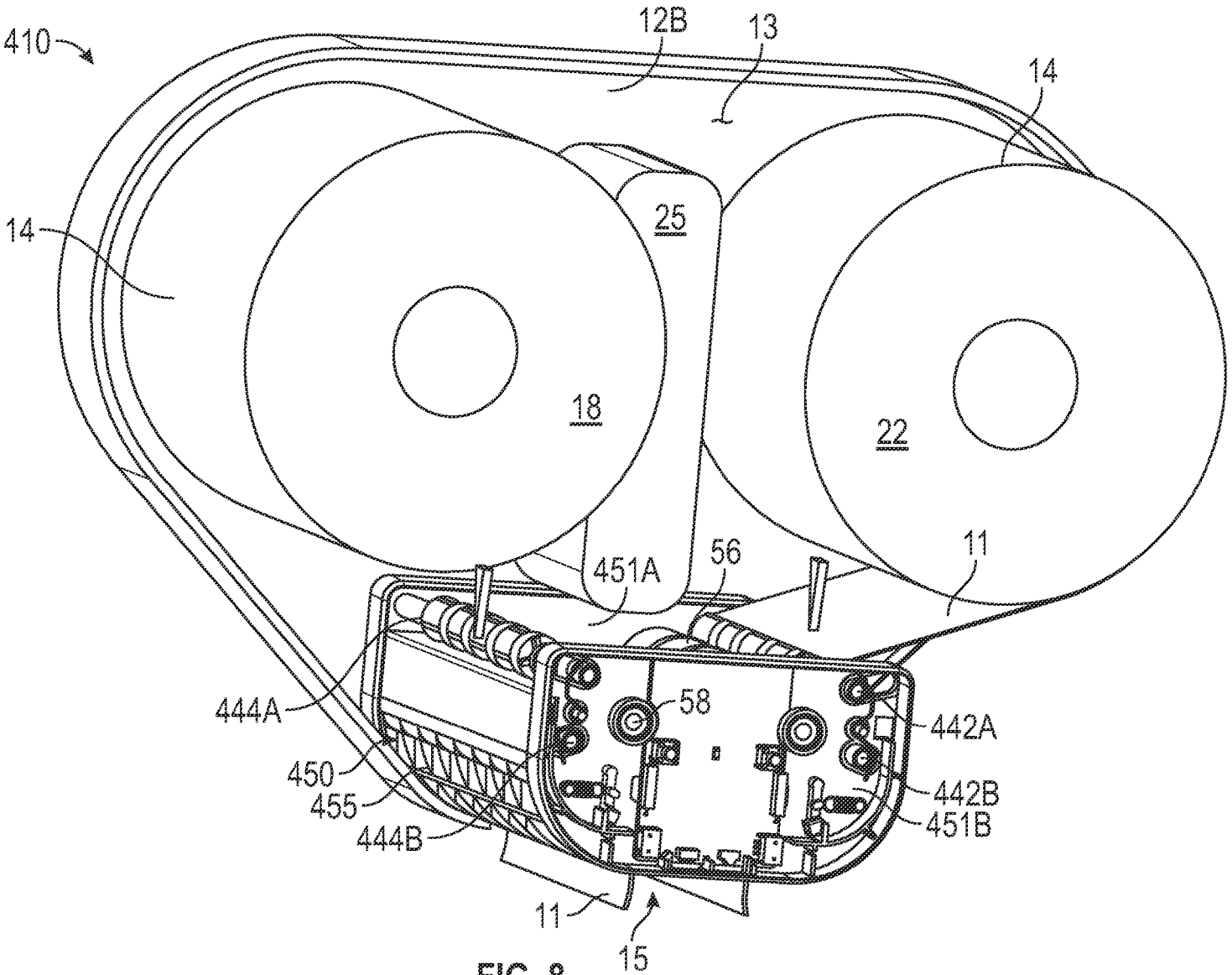
Figure 9:
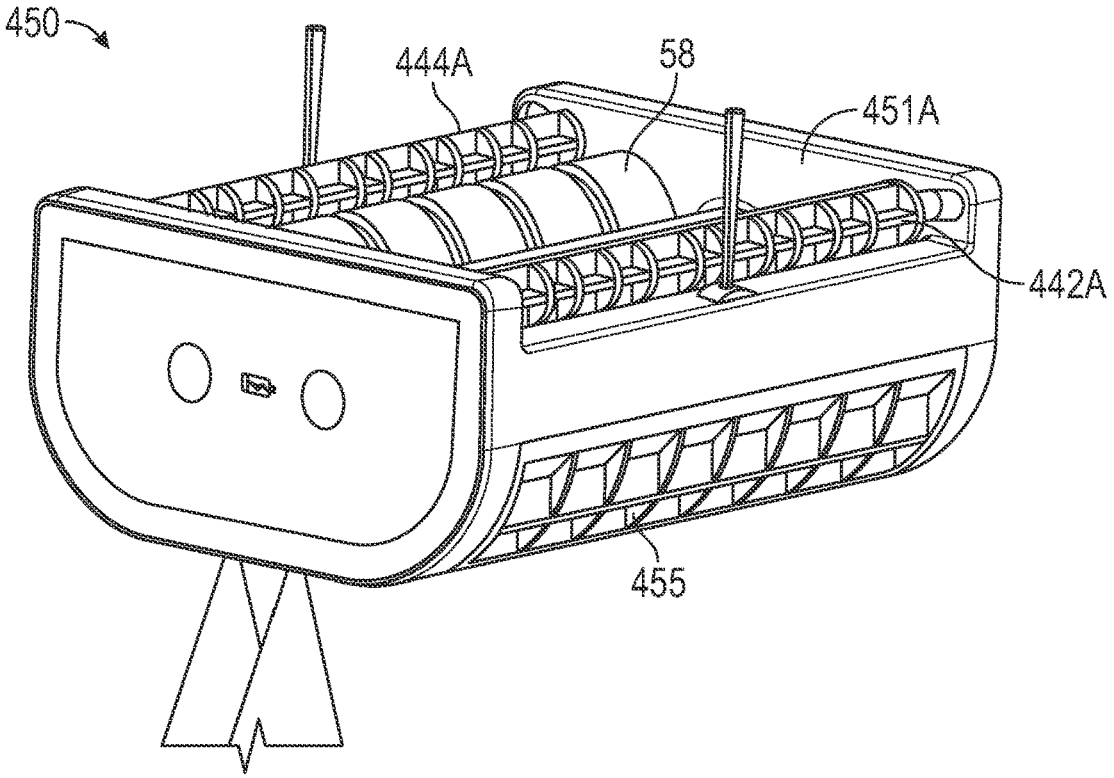
FIGS. 9-13 are views of a dispensing system of the dispenser assembly of FIGS. 6-8.
Figure 10:
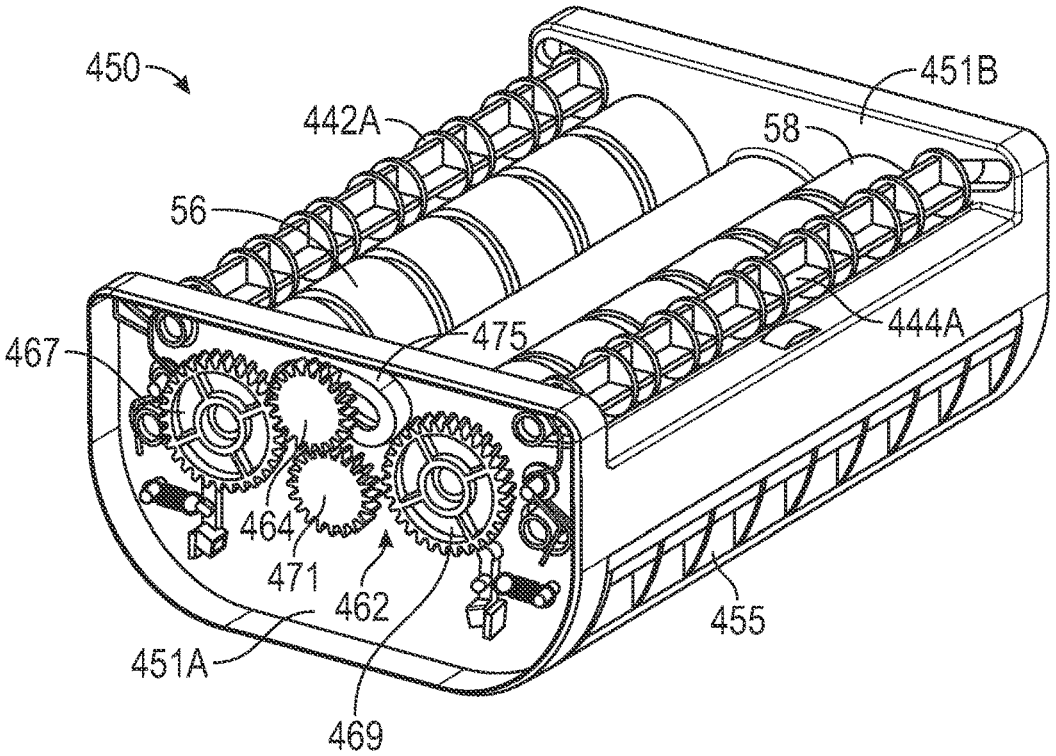
Figure 11:
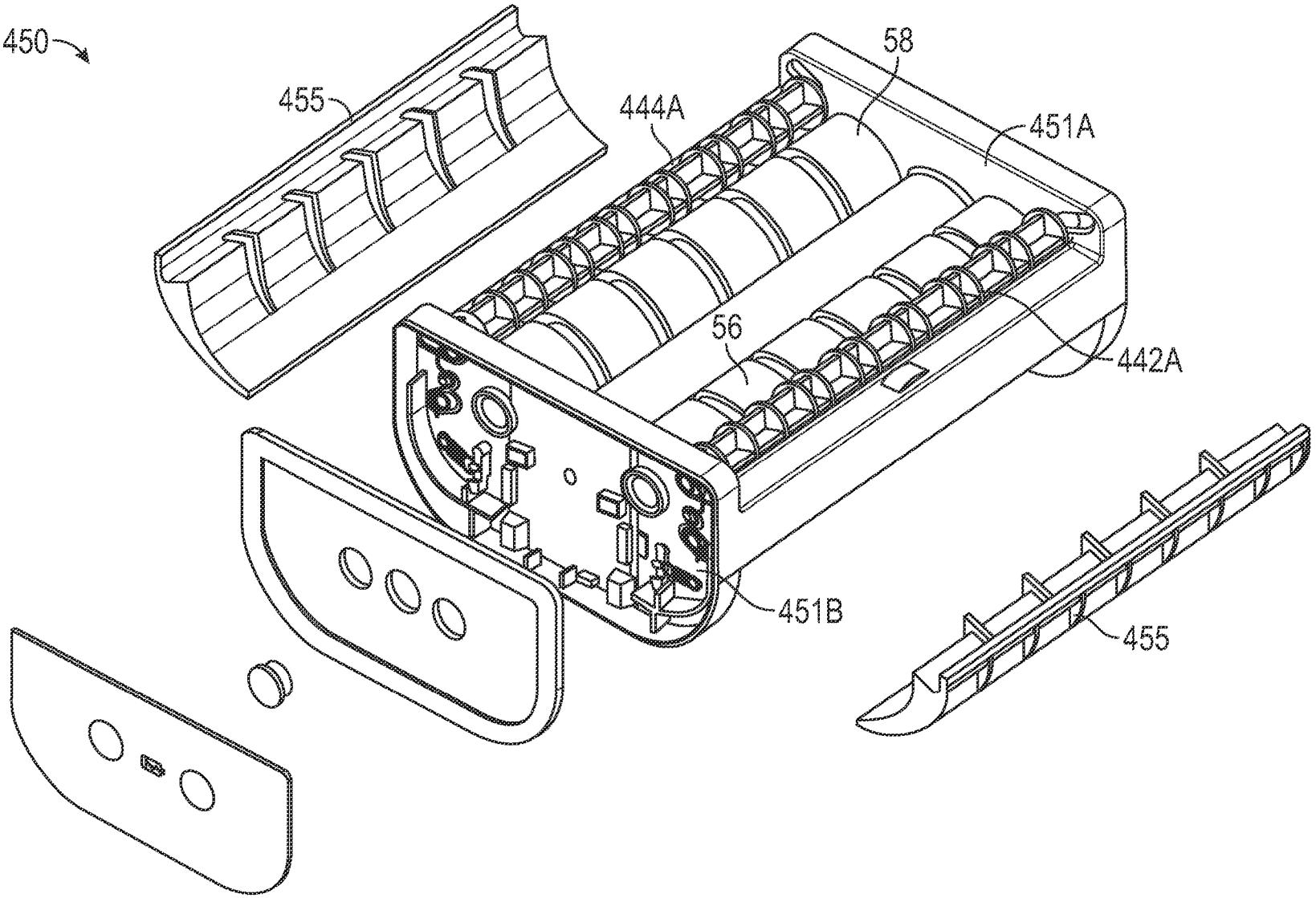
Figure 12:
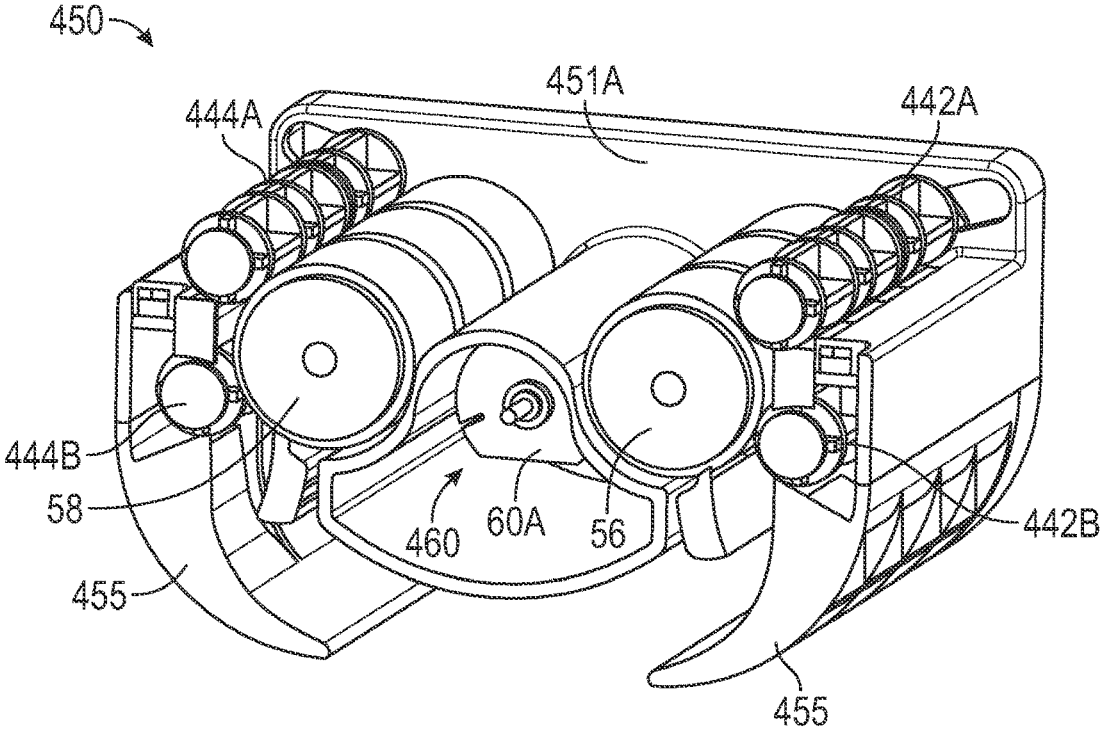
Figure 13:
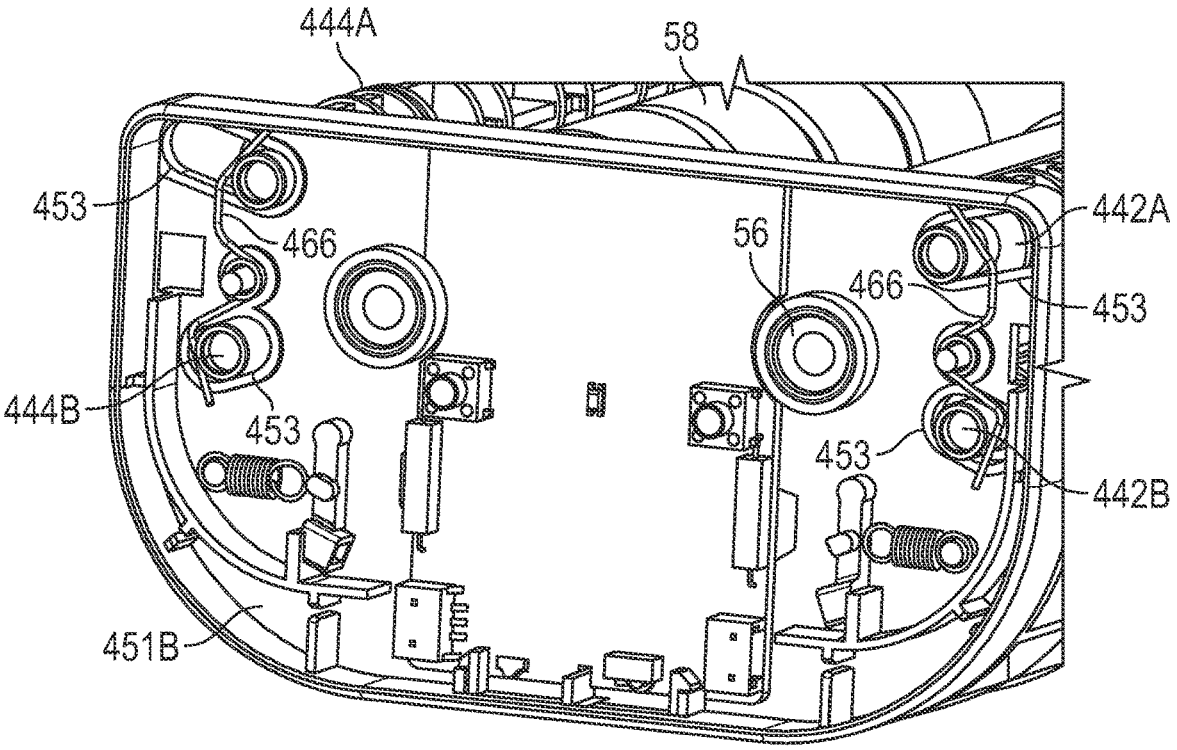
Figure 14:
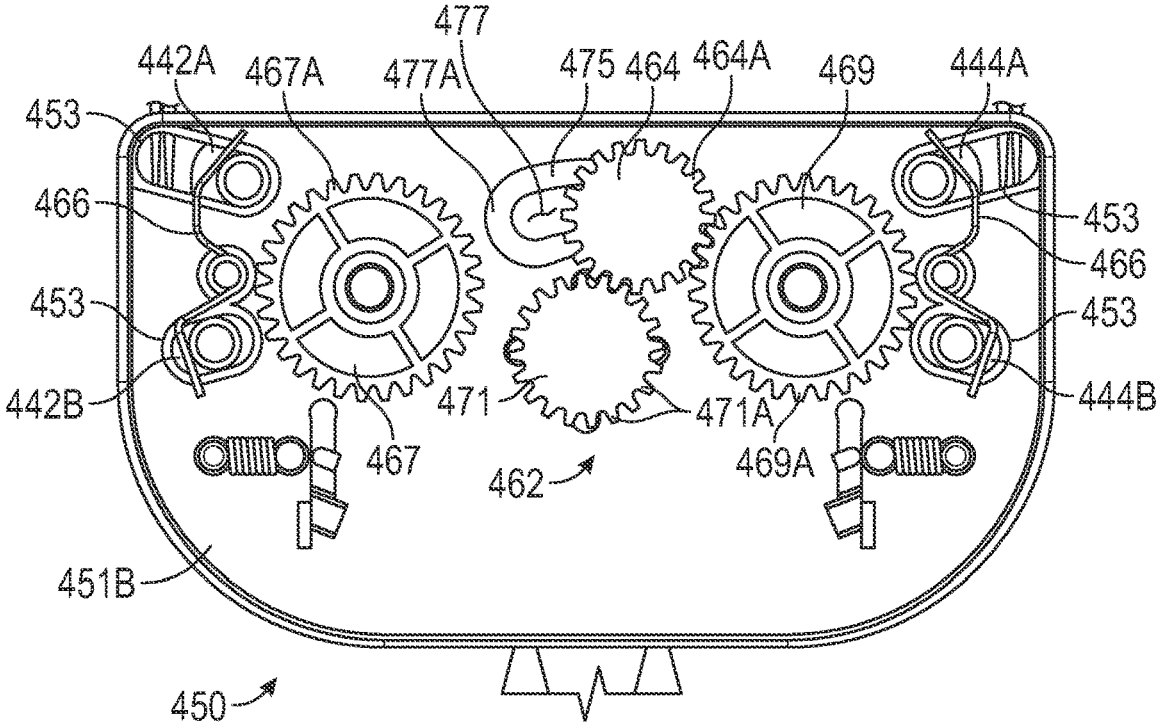
FIGS. 14-18 are views of a transmission assembly of the dispensing system of FIGS. 9-13.
Figure 15:
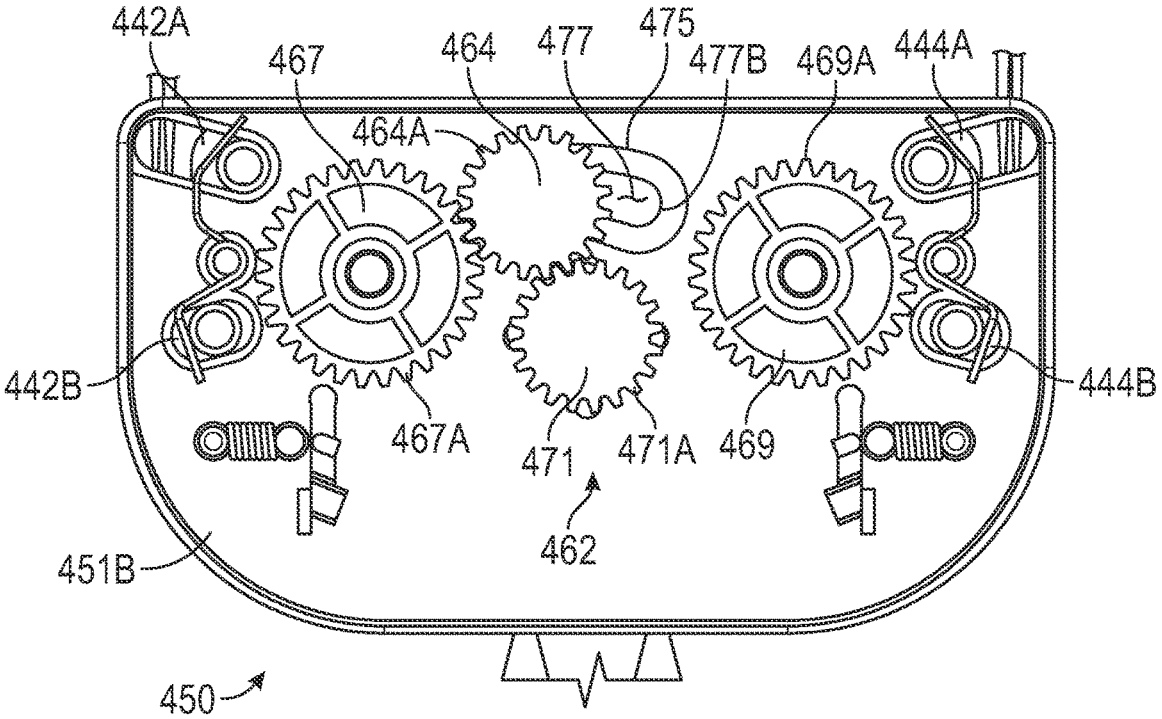

As shown in FIGS. 6-8, the dispenser assembly 410 can include the dispenser housing 12 having the cover 12A that is movable/removable (e.g., FIG. 8) to allow access to the components of the dispenser assembly 410, and the backing portion 12B that is configured to mount or otherwise connect via, for example and without limitation, fasteners, adhesive, and the like, to the dispenser assembly 410 to a wall, partition, or other suitable support within a facility, such as a restroom, hospital room, and the like. The dispenser housing 12 further includes the one or more chambers or compartments 13 defined therein and sized, dimensioned, and/or configured to receive and house the plurality of supplies 14 of sheet material 11 therein (e.g., the first supply 18 and the second supply 22 of sheet material). The dispenser housing 12 also including a discharge 15 that facilitates dispensing of the sheet material 11 of the supplies of sheet material 14 from the dispenser assembly 410.

As shown in FIGS. 8-11, the dispensing system 450 can include driven rollers 56/58 for engaging and driving the sheet material 11 from the supplies 18/22 of sheet material. For example, the first supply 18 of sheet material can be dispensed by the corresponding first driven roller 56 and the second supply 22 of rolled sheet material can be dispensed by the corresponding second driven roller 58 similar or identical to prior embodiments. In optional embodiments, the driven rollers 56/58 can be mounted between a first end plate 451A and a second end plate 451B of the dispensing system 450 such as by exemplified bearing assemblies or other suitable features. In other aspects, the dispensing system 450 can include guide rollers 442A/444A (FIGS. 8-12) extending along the respective driven rollers 56/58 and guide rollers 442B/444B (FIG. 12) extending along the respective driven rollers 56/58.

As exemplarily shown in FIGS. 8, 10, and 13-18, the guide rollers 442A/444A and 442B/444B can be mounted to the end plates 451A/451B in respective slots 453 (e.g., FIGS. 13 and 14) such as by the exemplified bearing assemblies or other suitable features mounted in the slots 453. In additional embodiments, the bearings can be movable along the slots 453 so that the guide rollers 442A/444A and 442B/444B can be operatively biased toward and/or against the respective driven rollers 56/58 such as, for example and without limitation, by springs or other suitable biasing members 466 that are configured to urge the bearings in the slots 453 toward the driven rollers 56/58. For example and without limitation, the biasing members 466 can be mounted to the end plates 451A/451B so that the biasing members press or are otherwise urged against the ends of the guide rollers (e.g., the bearing assemblies). Accordingly, the guide rollers 442A/444A and 442B/444B can press or otherwise engage the sheet material 11 against the respective driven rollers 56/58 as it passes between the driven rollers 56/58 and guide rollers 442A/444A and 442B/444B.

In this aspect, the dispensing system 450 can be configured to include any suitable number of guide or pressing rollers positioned adjacent the driven rollers 56/58 and/or guide rollers 442A/444A and 442B/444B to guide and/or engage the sheet material without departing from the scope of the present disclosure. In optional embodiments, the end plates 451A/451B can be connected by horizontal supports to form a support structure, which can be a unitary/integral structure or separate pieces coupled together. As exemplarily shown in FIGS. 7-12, curved guide plates 455 can be mounted between the end plates 451A/451B for guiding the sheet material 11 to the discharge 15.

As additionally exemplarily indicated in FIGS. 10, 12, and 14-18, the dispenser assembly 410 can include a drive mechanism 460 operatively connected or coupled to the driven rollers 56/58 via a gear driven transmission assembly 462 to selectively drive rotation thereof. In this aspect, the drive mechanism 460 can include a motor 60A (FIG. 12) or other suitable actuator and the driven rollers 56/58 are configured to rotate under the power of the drive mechanism 460 to pull the sheet material 11 from the respective supplies 18/22 and along the discharge paths at least partially defined between the driven rollers 56/58 and associated guide rollers 442A/444A and 442B/444B and through the discharge 15 defined in the dispenser housing 12. In this aspect, the drive mechanism 460 is configured to operatively communicate with a control circuitry (e.g., including controller 100 as shown in FIG. 5) of the dispenser assembly 410 to receive instructions and power for selectively activating and driving the driven rollers 56/58 of each roller assembly through a dispensing cycle (such as, for example and without limitation, a determined time, number of revolutions, and the like) to feed the selected or desired amount/length of the sheet material through the discharge 15 of the dispenser housing 12.

As described in more detail below, the motor 60A can be driven in a first direction, e.g., D1 in FIG. 16, to cause the transmission assembly 462 to engage and drive the first driven roller 56 and move the sheet material from the corresponding first supply 18 of sheet material along the first discharge path toward and out from the discharge 15 of the dispenser housing 12. Similarly, the motor 60A can be driven in a second direction, e.g., D2 in FIGS. 17 and 18, to cause the transmission assembly 462 to disengage with the first driven roller 56 and to engage and drive the second driven roller 58 and move the sheet material from the corresponding second supply 22 of sheet material along the second discharge path toward and out from the discharge 15 of the dispenser housing 12.

In embodiments, the gear driven transmission assembly 462 can optionally also include a plurality of gears for transferring power from the drive mechanism 460 to a selective one of the driven rollers 56/58. In this aspect and as shown in FIGS. 10 and 14-18, the transmission assembly 462 can include a drive gear 471 mounted to the motor 60A via a drive shaft extending through an opening in the first end plate 451A of the dispensing system 450. In embodiments, the drive gear 471 can be driven to rotate on its axis by the motor 60A directly or indirectly.

Optionally, the transmission assembly 462 further can include an intermediate gear 464 coupled to the first end plate 451A by a bearing 473 (FIGS. 17 and 18) received in a transmission guide 475 mounted on the first end plate 451A. For example, the intermediate gear 464 can rotate about its axis on the bearing 473 and the transmission guide 475 can define a path 477 (e.g., a curved path as shown in FIGS. 10 and 14-18 or any suitable path) between the driven rollers 56/58. Accordingly, in operation, the intermediate gear 464 can move/translate on its bearing 473 along the path 477 from a first end 477A to a second end 477B. In exemplary embodiments, the transmission guide 475 can be made of a self-lubricating plastic or any suitable material. The drive gear 471 can engage the intermediate gear 464, wherein a plurality of teeth 471A arranged along the circumference of the drive gear are configured to enmeshed with or otherwise engage a plurality of teeth 464A arranged along the circumference of the intermediate gear 464. It is contemplated that the curve of the path 477 in the transmission guide 475 can help retain the intermediate gear 464 in engagement with the drive gear 471 as the intermediate gear 464 translates along the path 477.

As exemplarily illustrated in FIGS. 10 and 14-18, the transmission assembly 462 further can include a first roller gear 467 mounted to a distal end of the first driven roller 56 and a second roller gear 469 mounted to a distal end of the second drive roller 58. In embodiments, the roller gears 467/469 can be coupled to the respective driven rollers 56/58 (e.g., by respective axles extending through respective openings in the first end plate 451A) so that rotation of a selected one of the roller gears 467/469 causes the respective driven roller 56/58 to rotate on its axis. As exemplarily shown, the first roller gear 467 can be mounted proximate the first end 477A of the transmission guide 475 so that the first roller gear 467 engages the intermediate gear 464 (e.g., teeth 467A arranged along the circumference of the first roller gear 467 engage the teeth 464A of the intermediate gear 464) when the intermediate gear 464 is at the first end 477A of the transmission guide 475. Similarly, the second roller gear 469 can be mounted proximate the second end 477B of the transmission guide 475 so that the second roller gear 469 engages the intermediate gear 464 (e.g., teeth 469A arranged along the circumference of the second roller gear 469 engage the teeth 464A of the intermediate gear 464) when the intermediate gear 464 is at the second end 477B of the transmission guide 475.

Figure 16:
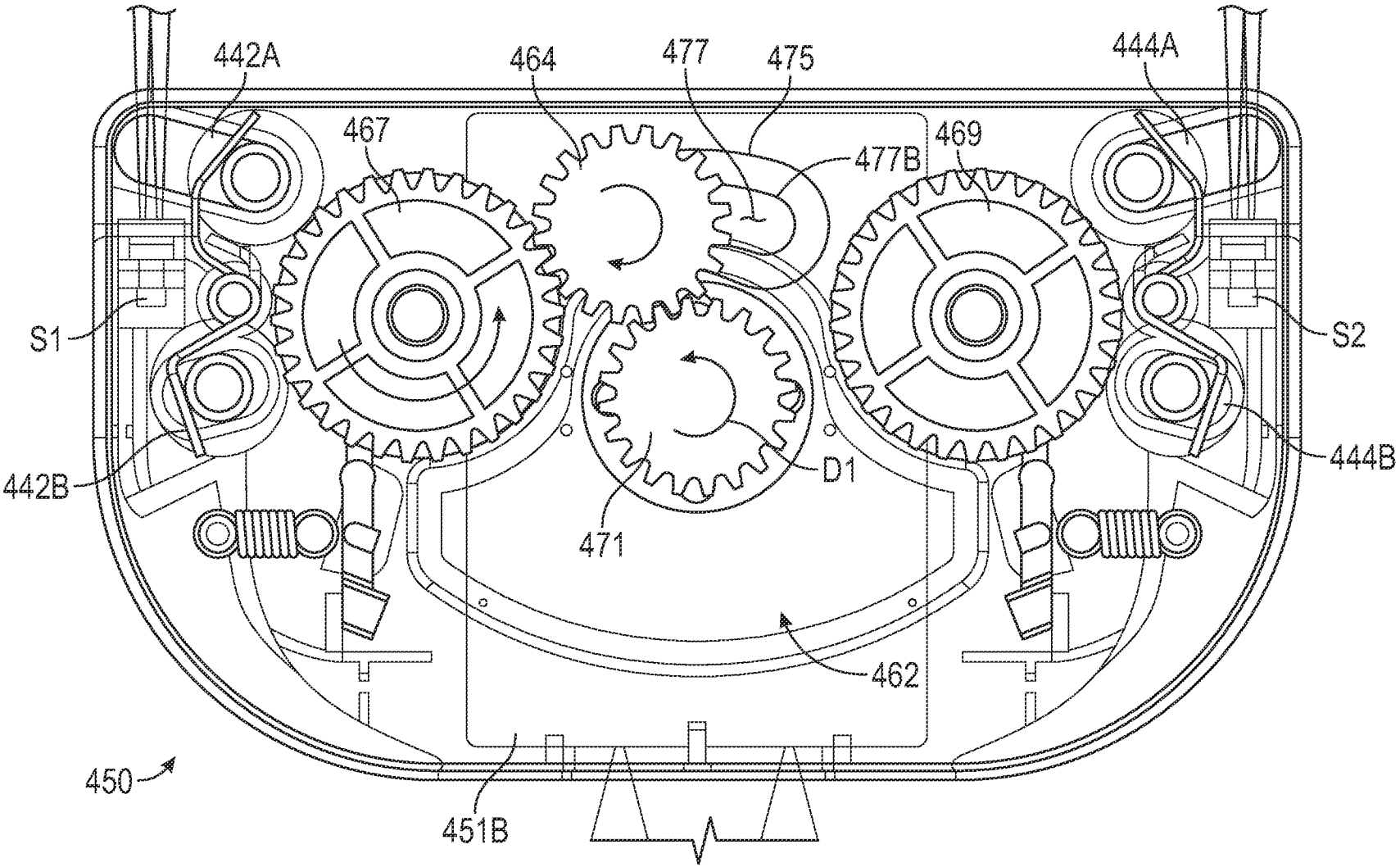
Figure 17:
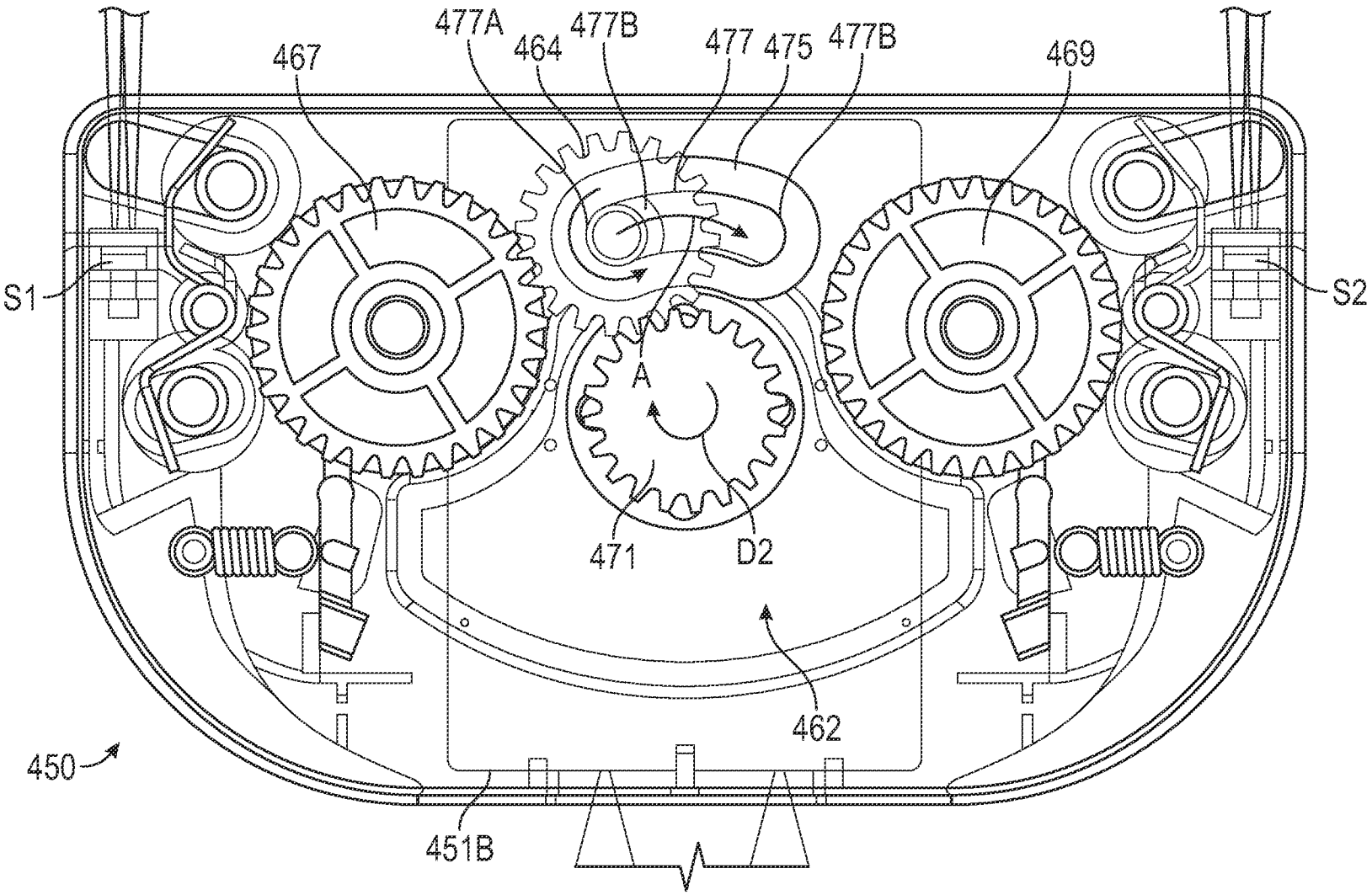

In operation, according to exemplary embodiments, the motor 60A can rotate in the direction D1 shown in FIG. 16, rotating the drive gear 471 in the direction D1. The engagement between the intermediate gear 464 and the drive gear 471 can urge the intermediate gear 464 toward the first end 477 of the transmission guide 475 and in engagement with the first roller gear 467. Accordingly, the rotation of the drive gear 471 is transmitted to the first roller gear 467 via the intermediate gear 464 so that the first driven roller 56 is rotated in the direction D1 to draw the sheet material 11 between the first driven roller 56 and the guide rollers 442A/442B along the discharge path toward and out from the discharge 15 of the dispenser housing 12.

Figure 18:
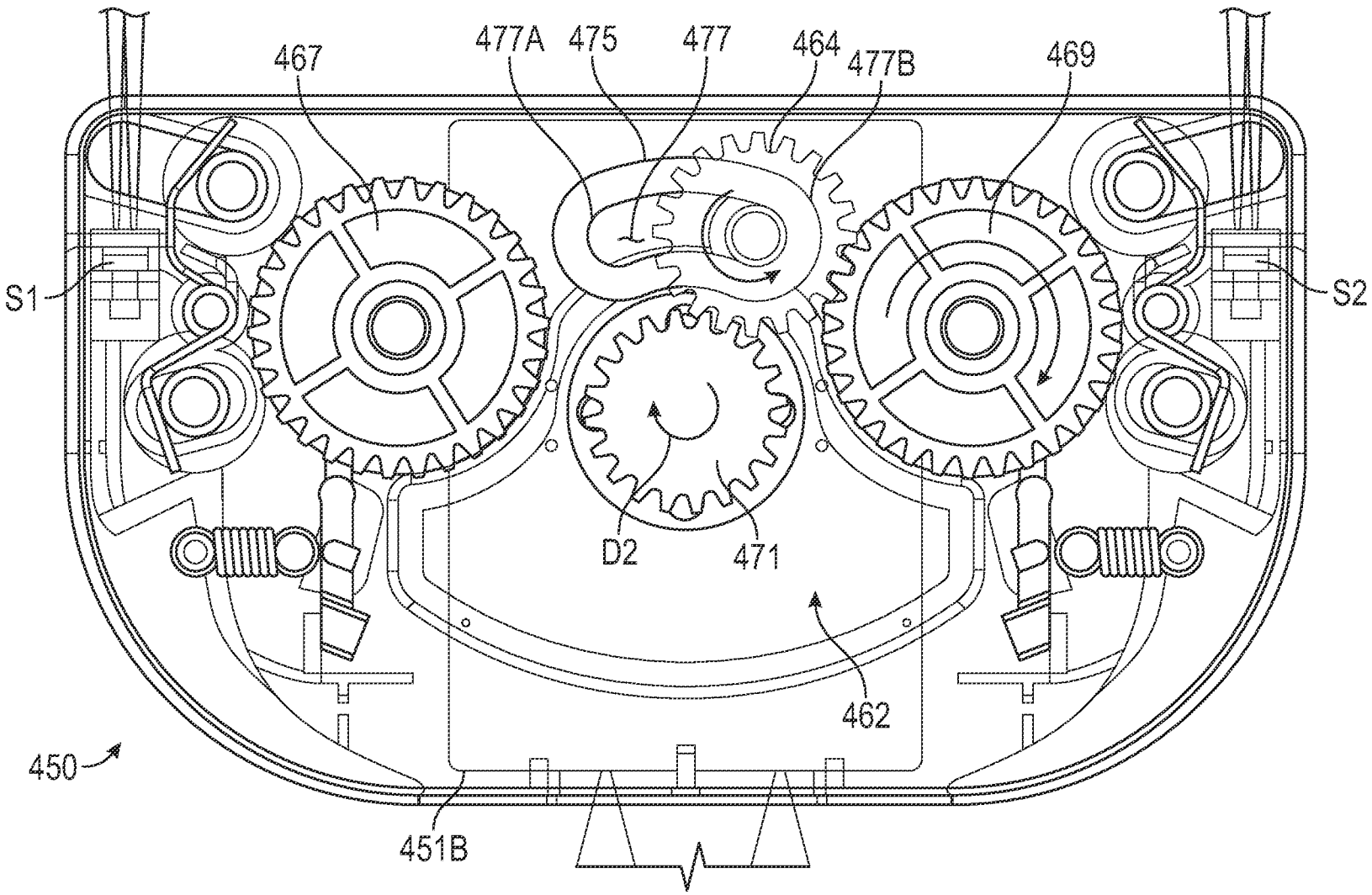
Figure 19A:
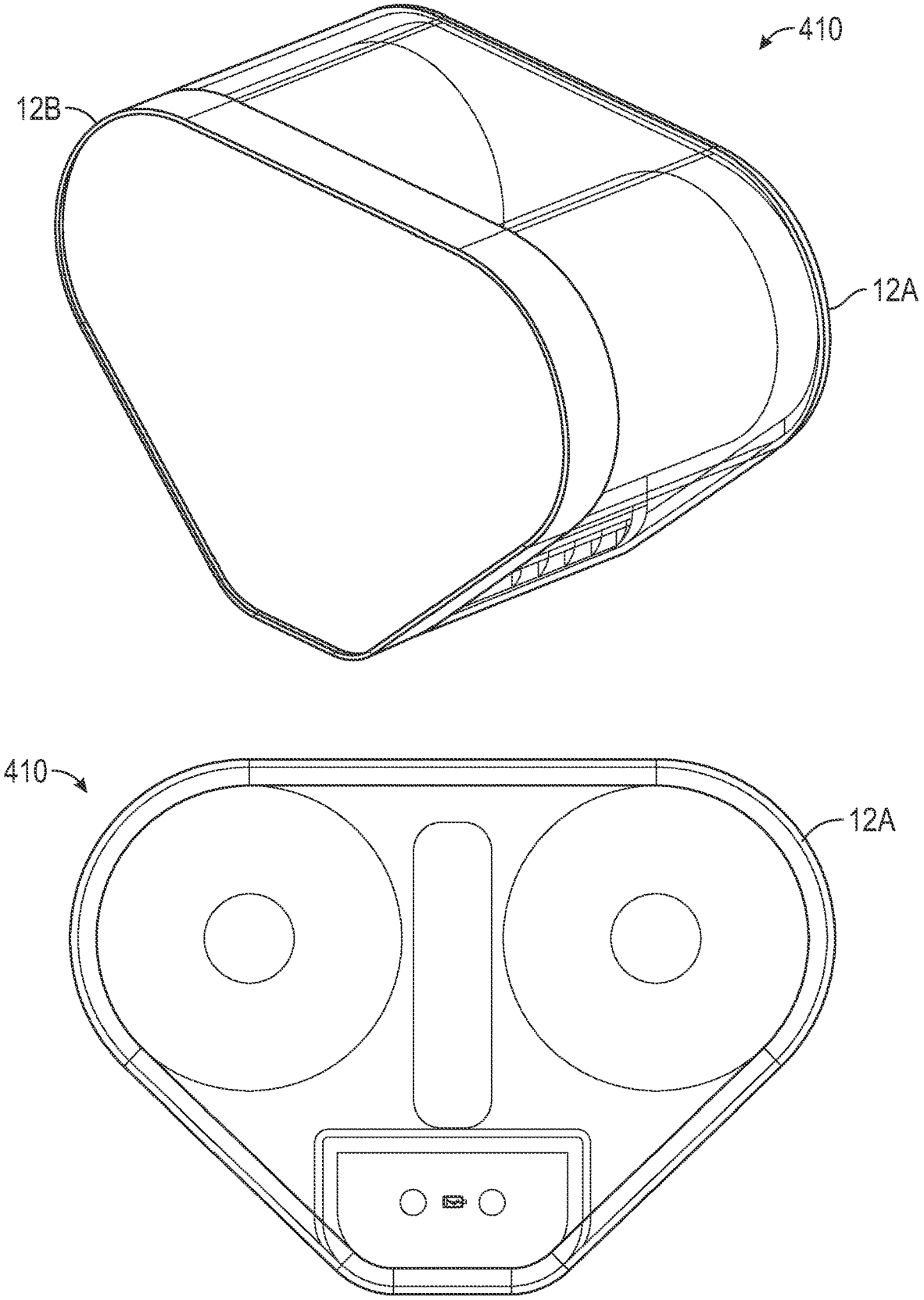
FIGS. 19A-19E show additional views of the features of FIGS. 6-18.
Figure 19B:
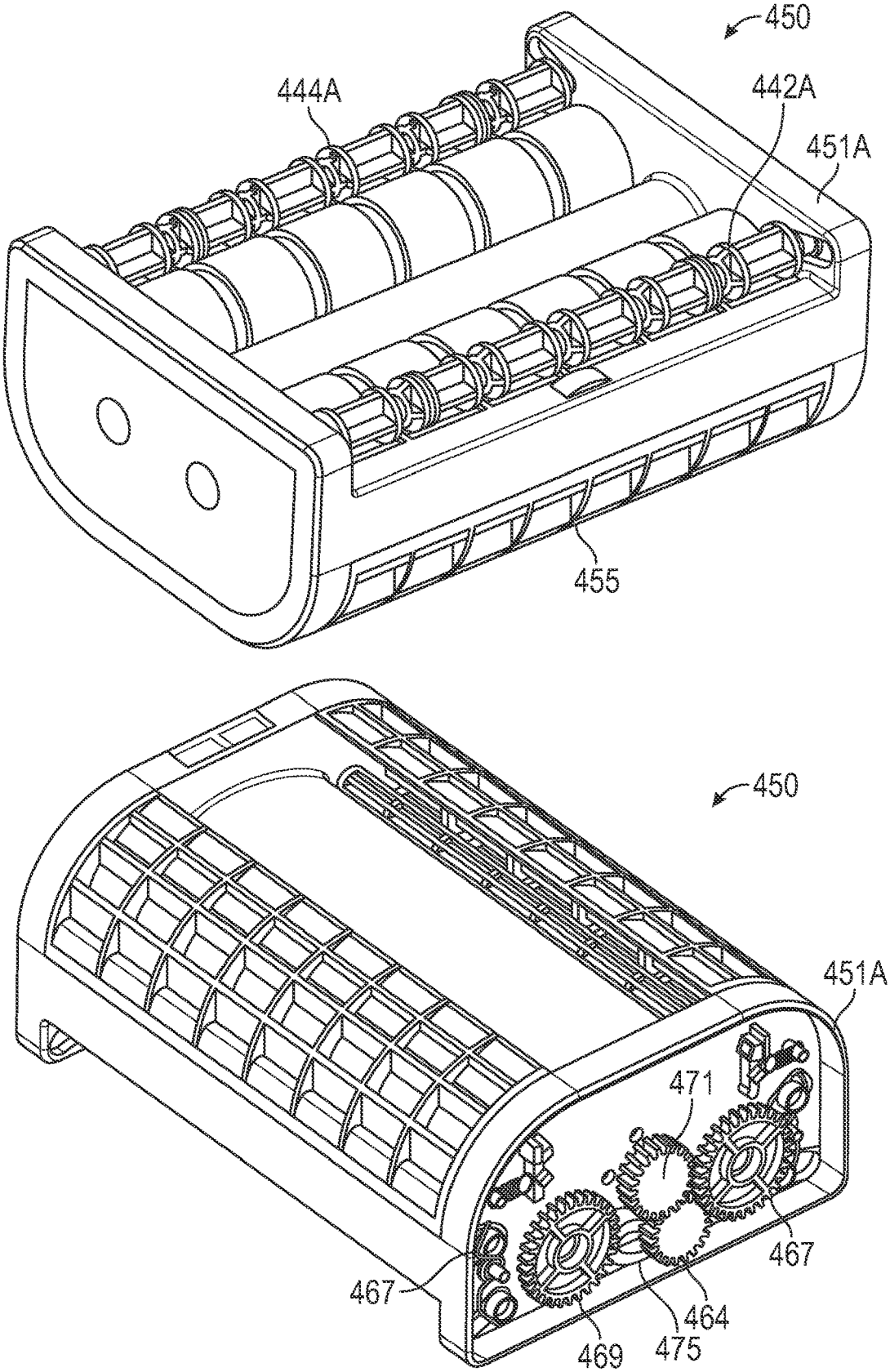
Figure 19C:
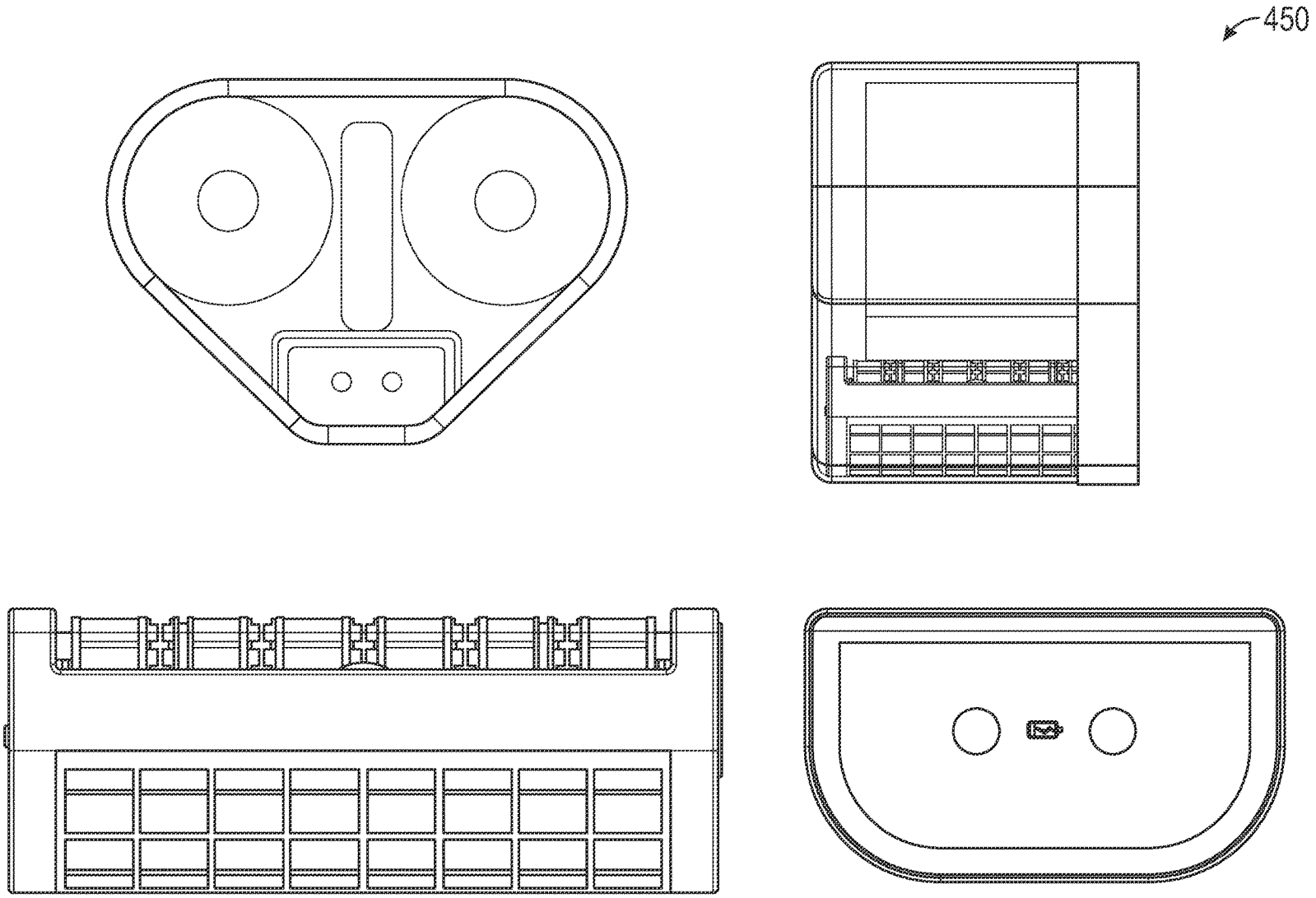
Figure 19D:
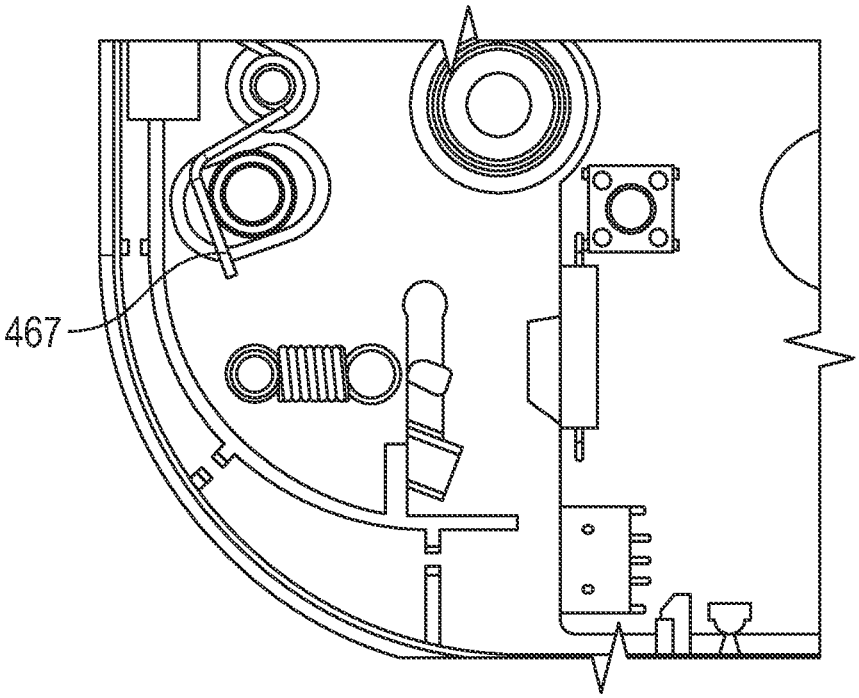
Figure 19D:
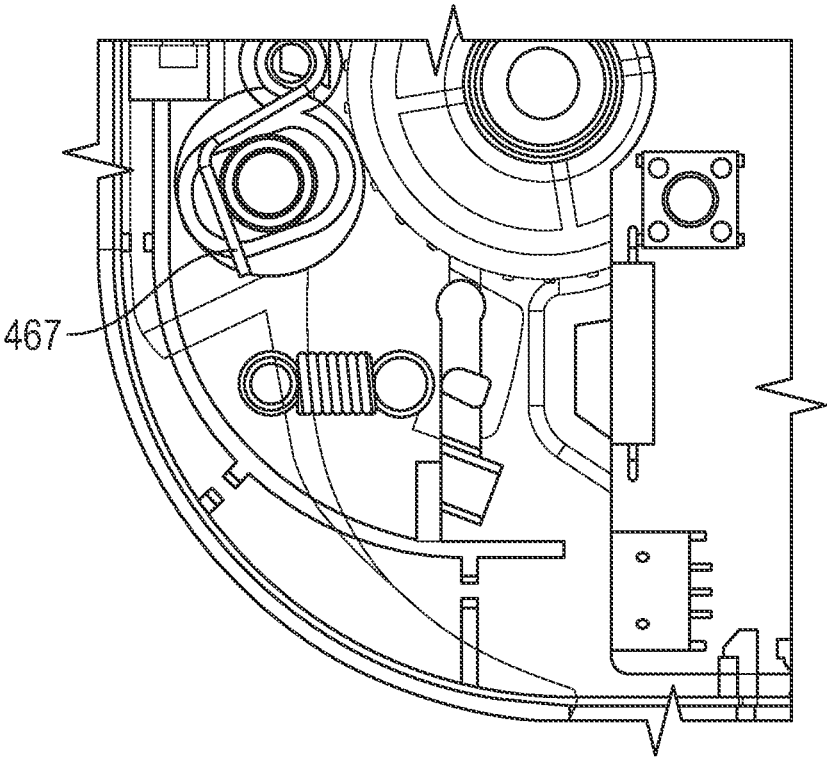
Figure 19E:
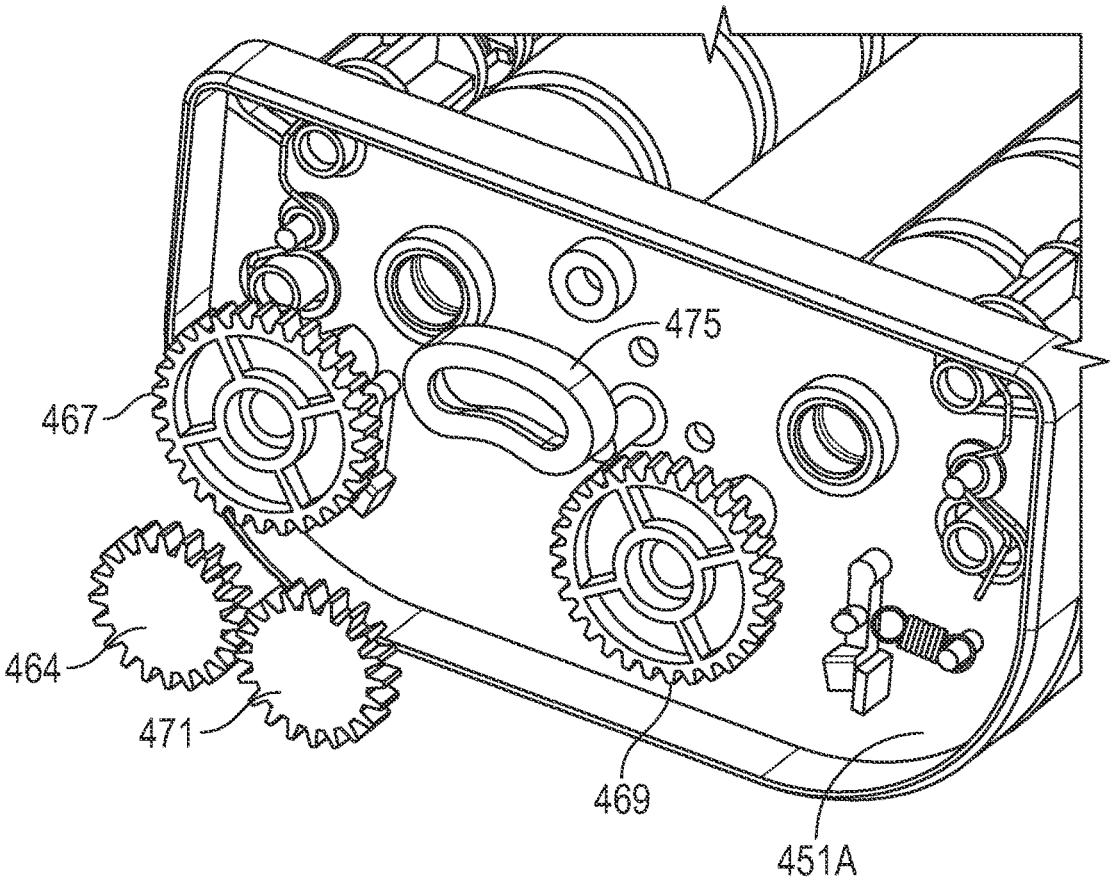
Figure 19E:
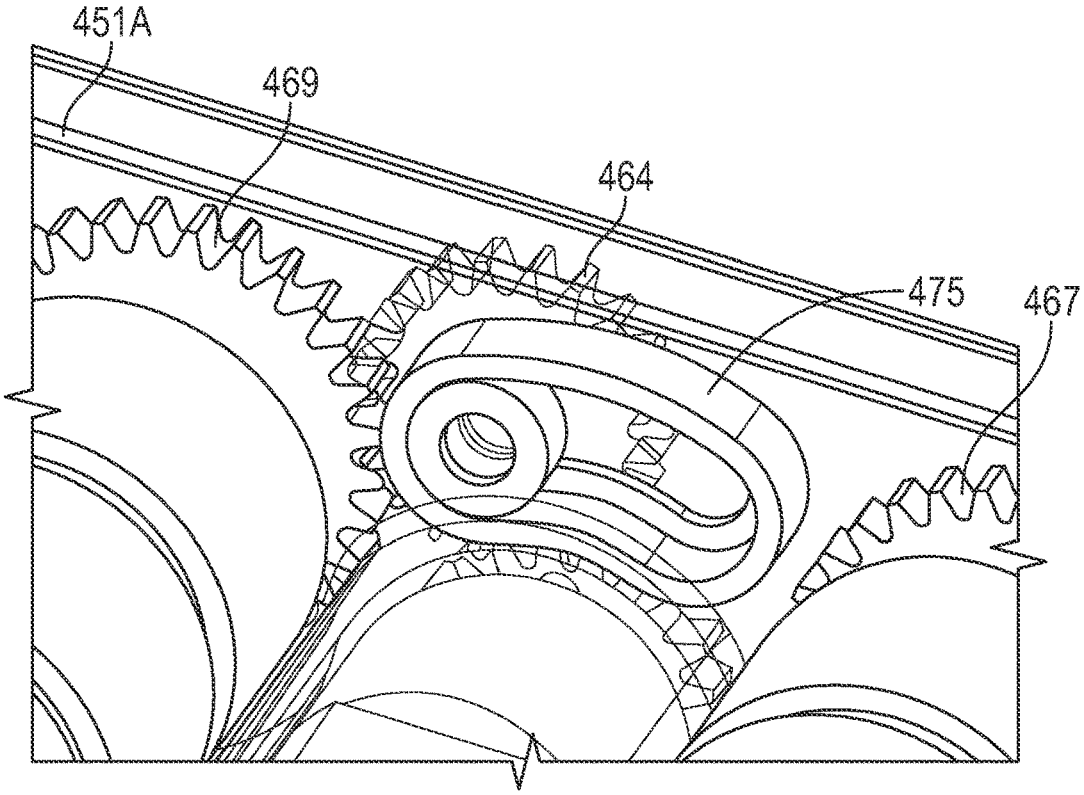
Figure 20A:
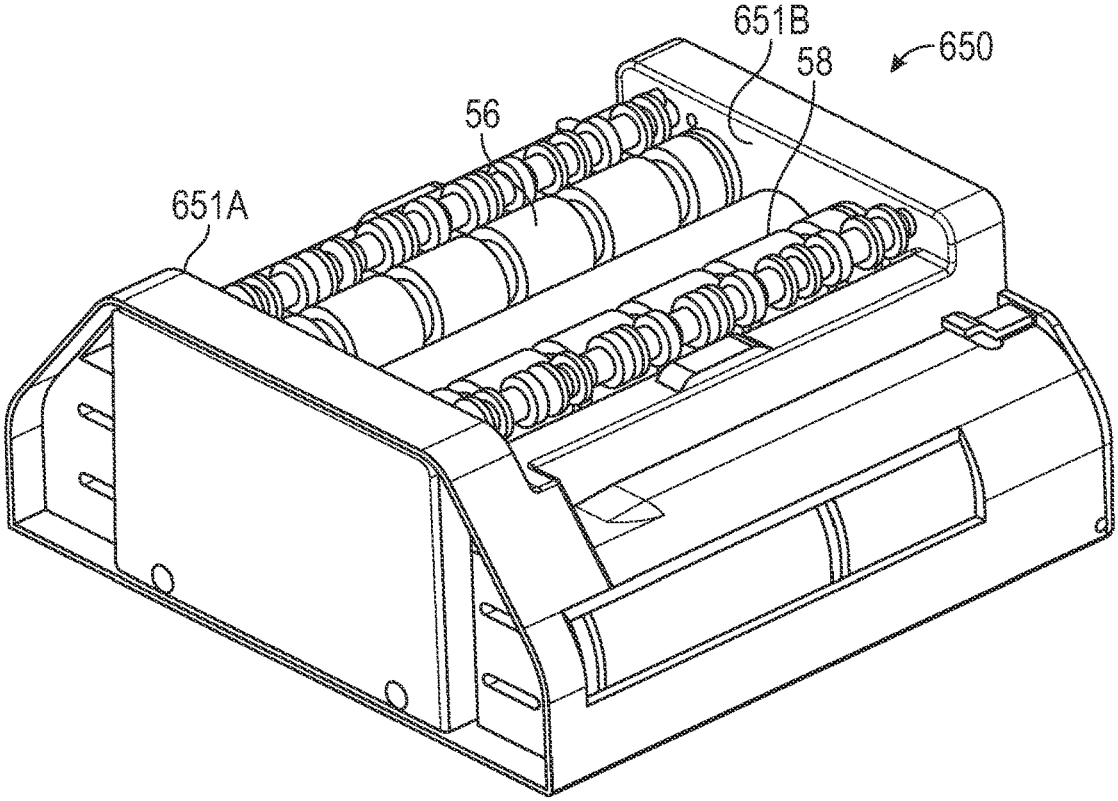
FIGS. 20A-22 are views of a dispensing system according to additional embodiments of the disclosure.
Figure 20B:
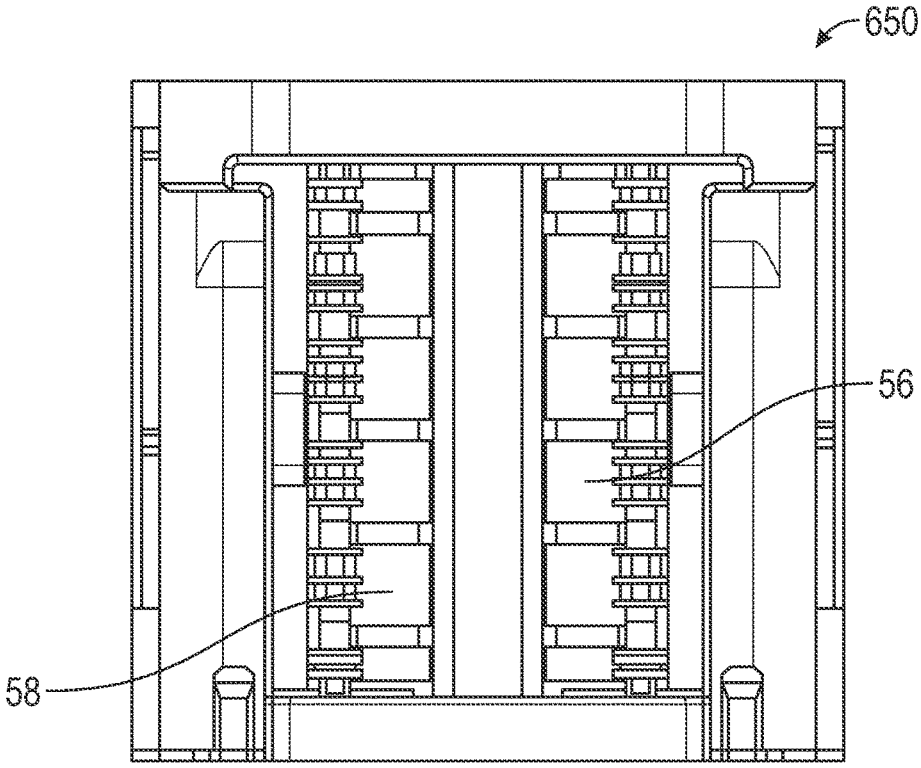

In embodiments, it is contemplated that the transmission assembly 462 can be operated to disengage the first driven roller 56 and engage the second driven roller 58. For example, the controller 100 can reverse the direction of the motor 60A (e.g., due to a signal from a supply sensor S1 that the first supply of sheet material is depleted) so that the motor turns the drive gear 471 in the direction D2 shown in FIG. 17. In this aspect, the intermediate gear 464 is moved along the path 477 in the transmission guide 475 in the direction of the arrow A, away from the first roller gear 467 and the first end 477A of the path 477 by the drive gear 471 until the intermediate gear 464 reaches the second end 477B of the path 477 and engages the second roller gear 469. As shown in FIG. 18, continued rotation of the drive gear 471 causes the intermediate gear 464 to rotate on its axis at the second end 477B, causing the second roller gear 469 to rotate. Accordingly, the rotation of the drive gear 471 is transmitted to the second roller gear 469 via the intermediate gear 464 so that the second driven roller 58 is rotated in the direction D2 to draw the sheet material 11 between the second driven roller 58 and the guide rollers 444A/444B along the discharge path toward and out from the discharge 15 of the dispenser housing 12. The transmission assembly 462 can be operated to disengage the second driven roller 58 and engage the first driven roller 56 by reversing the above process (e.g., due to a signal produced by a supply sensor S1 that indicates that the first supply of sheet material is depleted).

Additional views of the features of FIGS. 6-18 are shown in FIGS. 19A-19E according to embodiments of the disclosure.

In embodiments, it is contemplated that the gear driven transmission assembly 462 generally can have a quieter operation than belt driven transmissions. Further, in various aspects, the gear driven transmission assembly 462 can be more reliable, such as by reducing or eliminating slipping between components and/or using more durable components. Further, the gear driven transmission assembly 462 can reduce or eliminate the need for separate biasing apparatus since rotation of the drive gear 471 urges the intermediate gear 464 toward the first roller gear 467 or the second roller gear 469 in addition to rotating the intermediate gear 464.

FIGS. 20A-27B show a dispensing system or mechanism 650 for a dispenser according to additional embodiments of the disclosure, which embodiments are generally similar to the prior embodiments except for variations noted and variations that will be apparent to one of ordinary skill in the art. Accordingly, similar or identical features of the embodiments have been given like or similar reference numbers. In the embodiments of FIGS. 20A-27B, the dispensing system 450 includes a belt driven transmission assembly 662 with two belts 664A, 664B selectively driven by a centrally located gear clutch assembly 671 mounted on a drive mechanism 660.

Figure 21A:
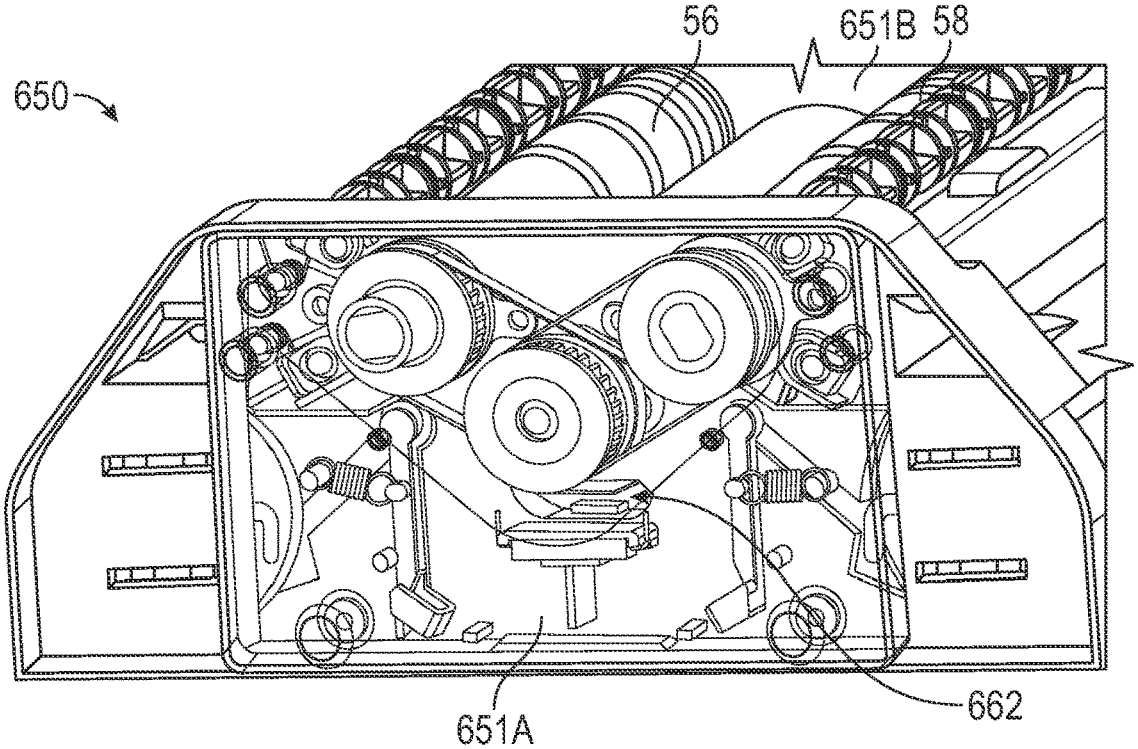
Figure 21B:
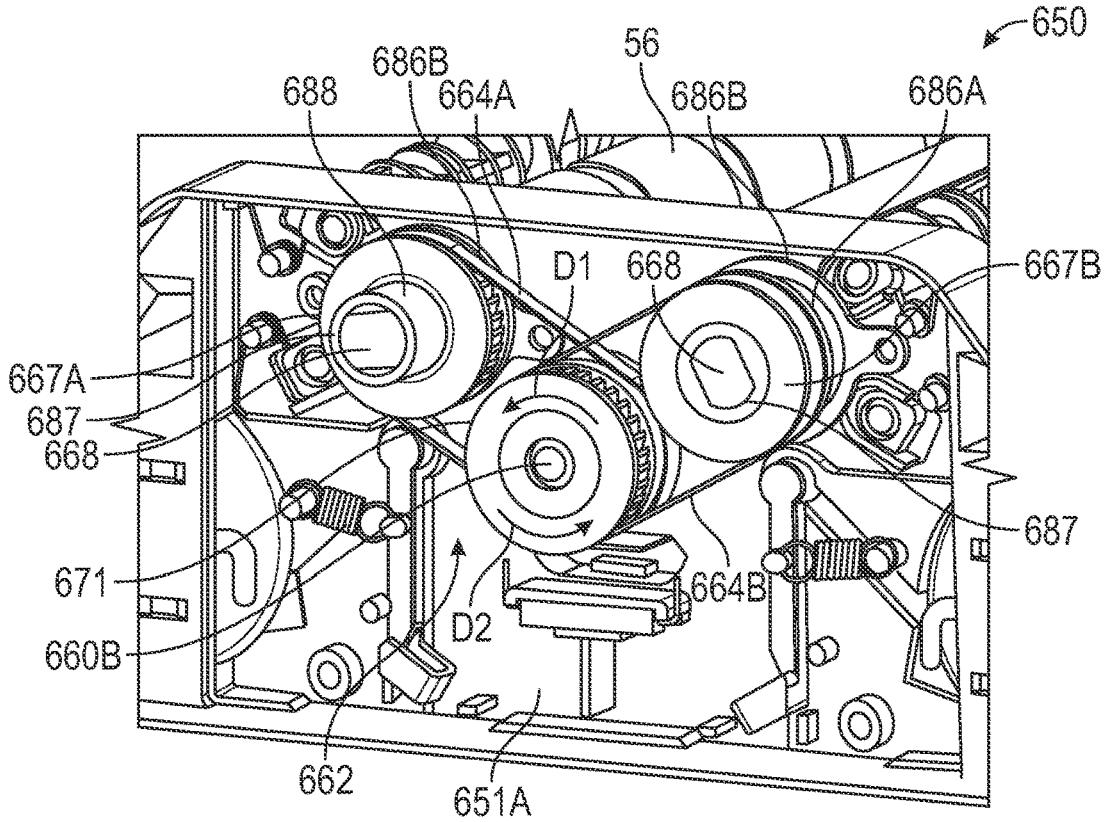

As exemplarily shown in FIGS. 21A and 21B, the belt driven transmission assembly 662 can be mounted at an end wall or end plate 651A of the dispensing system 650 and can include the two drive belts 664A, 664B operatively connecting or engaging the drive mechanism 660 and the driven rollers 56, 58 to transfer power therebetween for selectively driving rotation of the first driven roller 56 and/or the second driven roller 58, which driven rollers 56, 58 can be supported between the end plate 651A and an opposing end wall or end plate 651B. In embodiments, the gear clutch assembly 671 can be connected to the driven rollers 56, 58 by the respective drive belts 664A, 664B, which can engage corresponding belt pulleys or belt gears 667A, 667B connected to the respective driven rollers 56, 58.

Figure 25A:
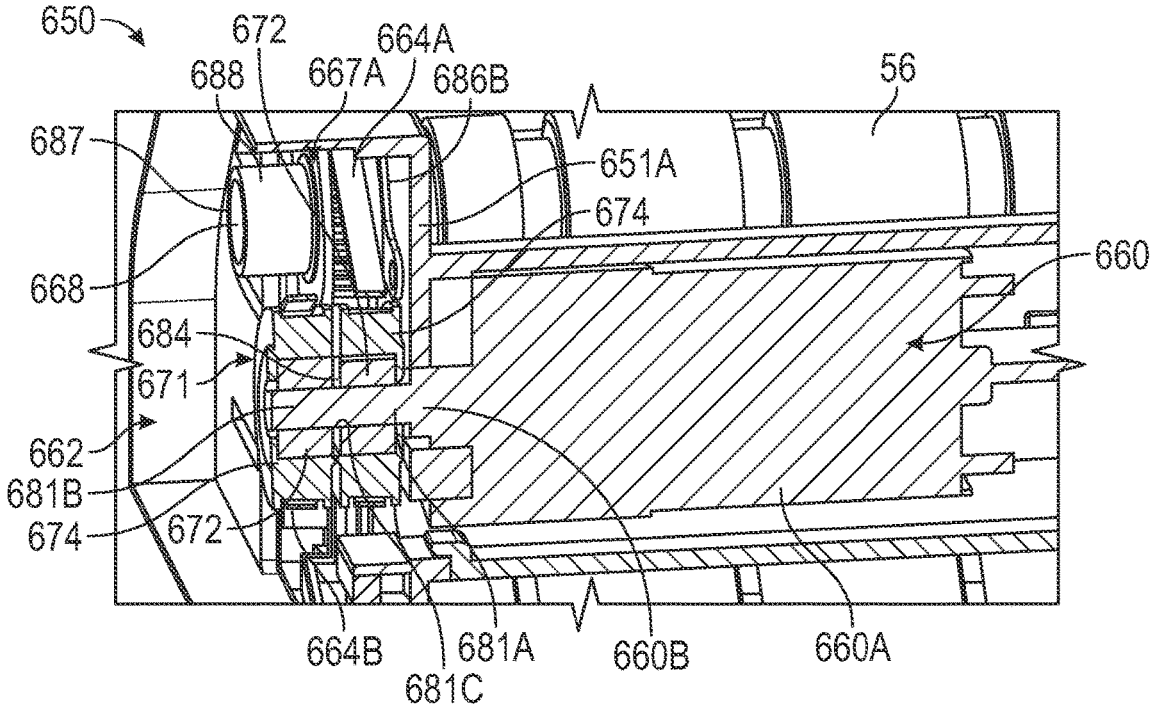
Figure 25B:
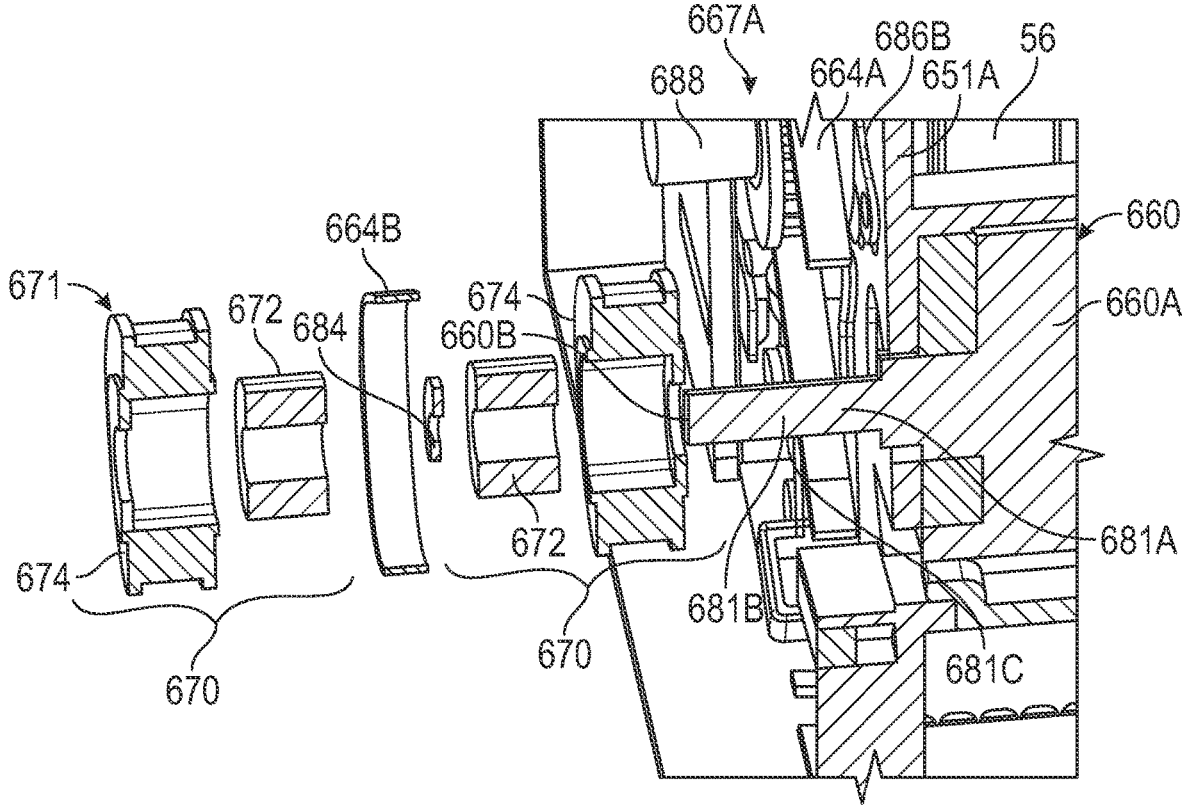
Figure 25C:
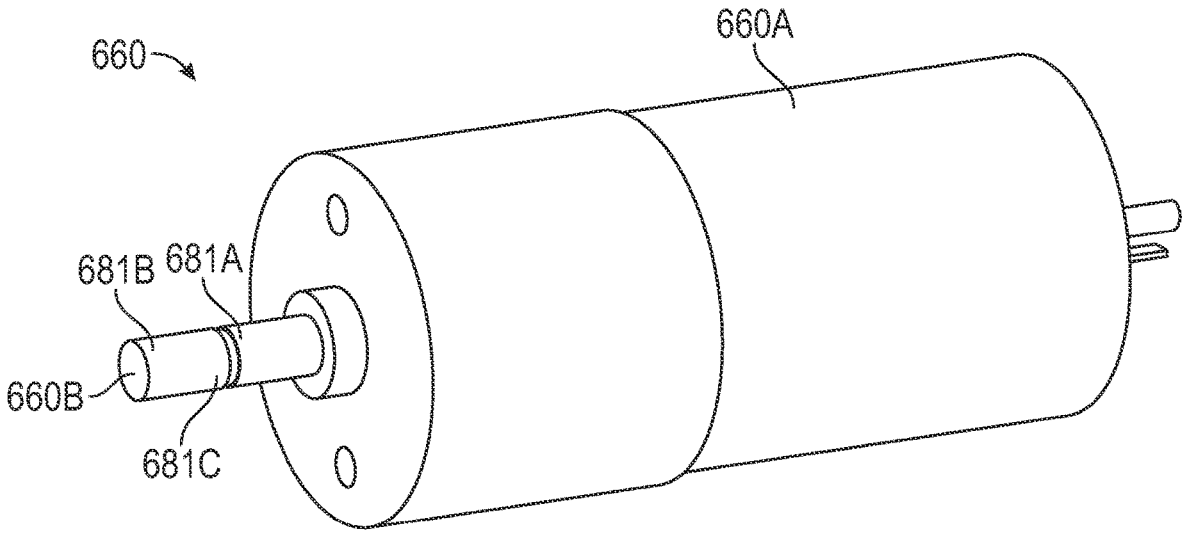
Figure 25D:
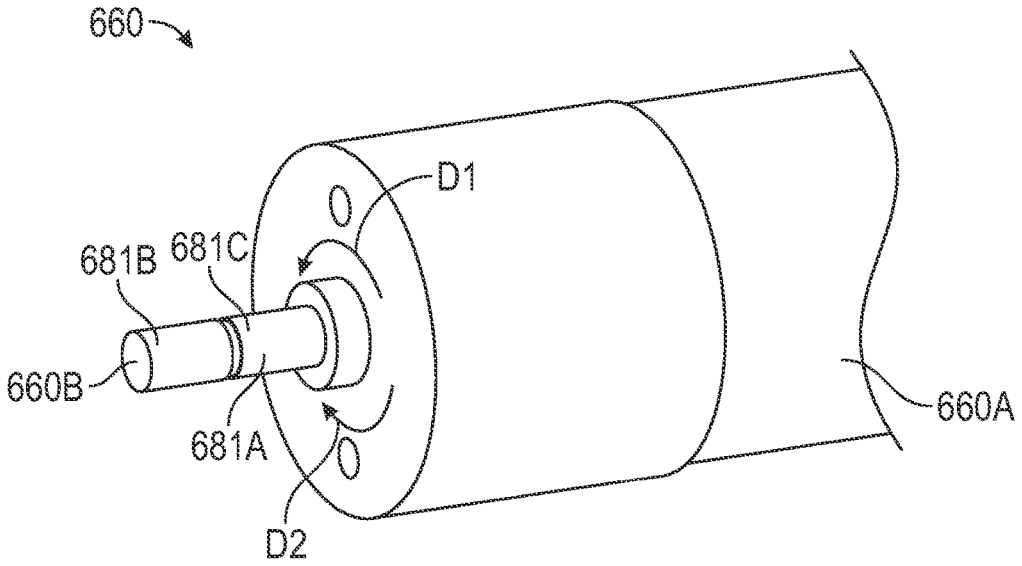
Figure 26A:
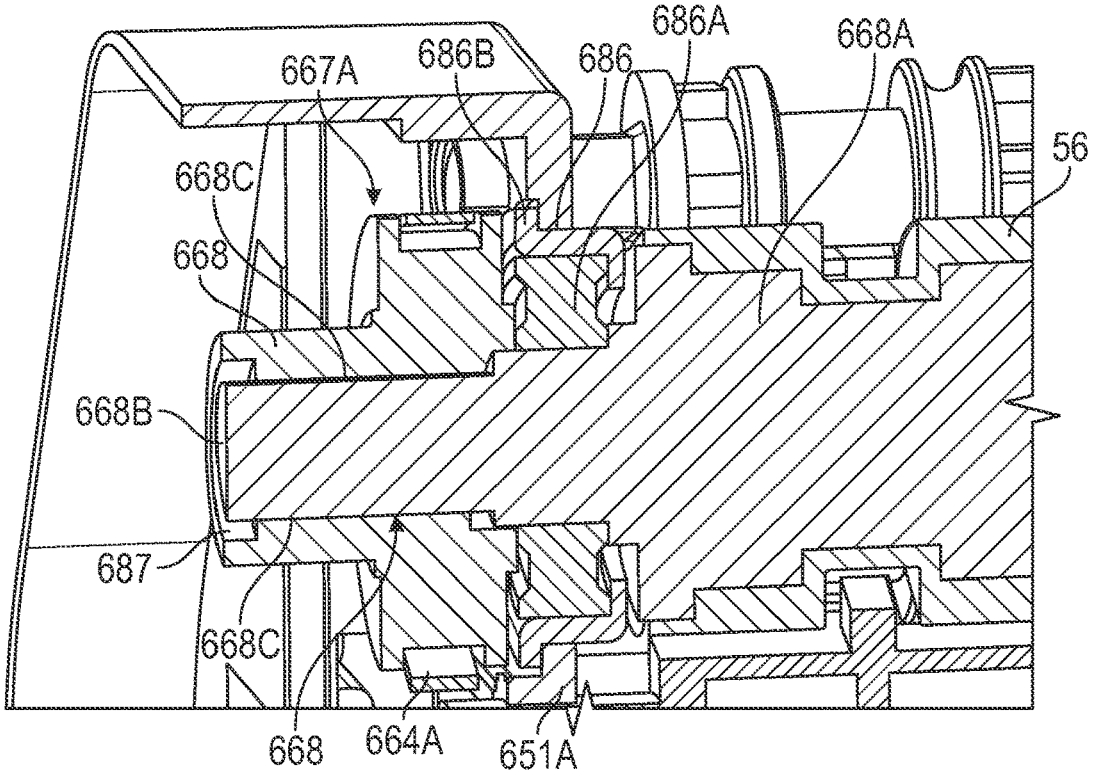
Figure 26B:
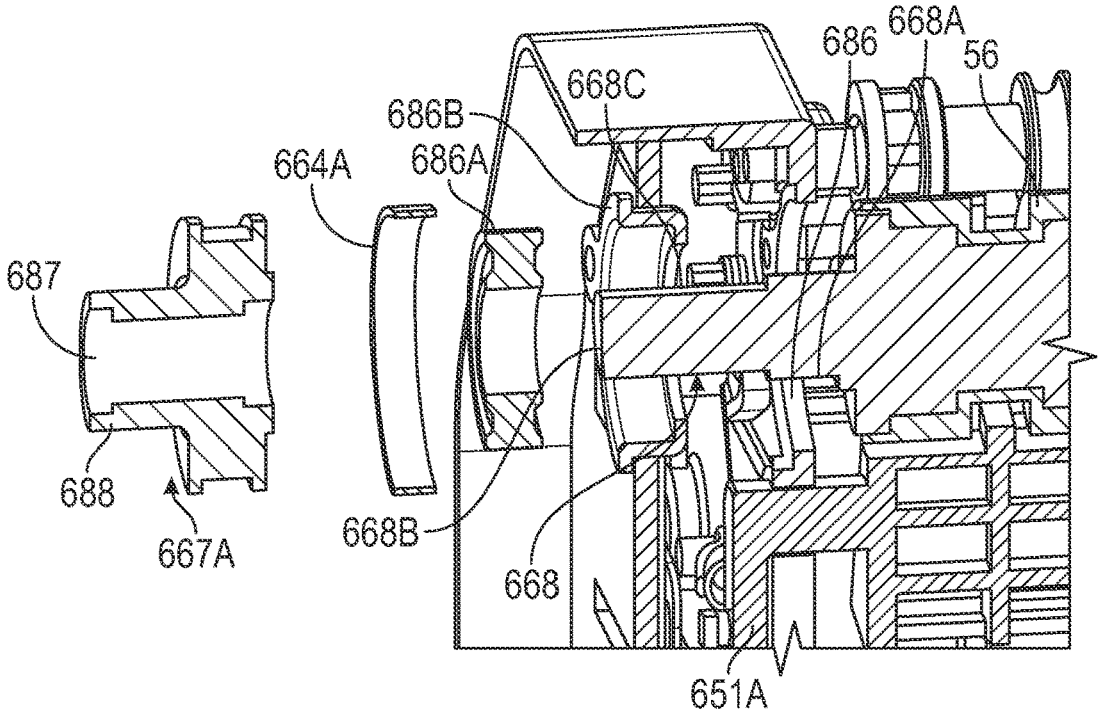

In additional optional aspects and as shown in FIGS. 23 and 25A-25D, the drive mechanism 660 can include a motor 660A (for example and without limitation, a brushless servo or stepper motor, or other, similar type of variable speed, reversible electric motor, or other suitable drive system) and a drive shaft 660B. As shown in FIGS. 25C and 25D, the drive shaft 660B can include a proximal section 681A spaced from a distal section 681B by a recess 681C or other suitable dividing feature.

As described in more detail below, each of the respective proximal section 681A and the distal section 681B can be configured to operatively engage respective portions of the gear clutch assembly 671. In some exemplary embodiments, a C-clip 684 can engage the recess 681C and can extend between the portions of the gear clutch assembly 671 (FIGS. 22, 23, 25A, and 25B) to help keep the portions of the gear clutch assembly 671 separate from one another. The drive shaft 660B could be otherwise configured without departing from the disclosure. For example, and without limitation, the recess 681C and the C-clip 684 could be omitted and/or the drive shaft 660B can be stepped so that the distal section 681B has a different diameter than the proximal section 681A (e.g., the diameter of the distal section 681B could be stepped up from the diameter of the proximal section 681A or the diameter of the distal section 681B could be stepped down from the diameter of the proximal section 681A) to help keep the portions of the gear clutch assembly 671 separate. In the illustrated exemplary embodiments, the drive motor 660A can be mounted in a defined interior chamber of the dispenser housing and on an interior side of the end plate 651A, and the drive shaft 660B can extend through the end plate 651A (e.g., via a through-bore, a clearance opening, a bushing, a bearing, and/or other suitable features) to engage the gear clutch assembly 671 on the outer side of the end plate 651A. In other embodiments, the drive motor 660A could be mounted on the exterior side of the end plate 651A.

As shown in FIGS. 21A-23, 25A, and 25B, the gear clutch assembly 671 can include a first or proximal drive pulley or drive gear 671A engaging or mounted on the proximal section 681A of the drive shaft 660B and a second or distal drive pulley or drive gear 671B engaging or mounted on the distal section 681B of the drive shaft 660B. As shown in FIGS. 21A, 21B, 27A, and 27B, the first drive belt 664A engages the proximal drive gear 671A and the first belt gear 667A so that they are rotatably coupled together by the first drive belt, and the second drive belt 664B engages the distal drive gear 671B and the second belt gear 667B so that they are rotatably coupled together by the second drive belt. In embodiments, the C-clip 684 can be positioned between the drive gears 671A, 671B in the recess 681C of the drive shaft 660B so that the drive gears 671A, 671B are spaced from one another by at least the C-clip 684.

In exemplary embodiments, the gear clutch assembly 671 can include or incorporate one or more clutch assemblies or mechanisms 670 (FIG. 25B), such as hybrid or one-way clutch mechanisms, that allow for selective transfer of power between the drive mechanism 660 and the driven rollers 56, 58. For example and as shown in FIGS. 22, 23, 25A, and 25B, the clutch mechanisms 670 can be incorporated or integrated with the respective drive gears 671A, 671B. Accordingly, in operation, when the drive mechanism 660 is driven in a first direction D1 (FIGS. 21B and 25D), the clutch assembly 670 of the proximal drive gear 671A will lock/engage for transfer of power/torque to the first driven roller 56 (e.g., via the first drive belt 664A and the first belt gear 667A) so that the first driven roller 56 is driven by the drive mechanism 660 and rotated to dispense its corresponding supply of sheet material (while the clutch assembly 670 of the distal drive gear 671B remains generally disengaged). In addition, when the drive mechanism 660 is driven in the opposite direction D2 (FIGS. 21B and 25D), the clutch assembly 670 of the proximal drive gear 671A will unlock or disengage such that there is no transfer of power/torque between the drive mechanism 660 and the first driven roller 56 (while the clutch assembly 670 for the distal drive gear 671B engages or locks for transfer of power/torque to the second driven roller 58, e.g., via the second drive belt 664B and the second belt gear 667B, so that the second driven roller 58 is rotated to dispense its corresponding supply of sheet material).

Figure 23:
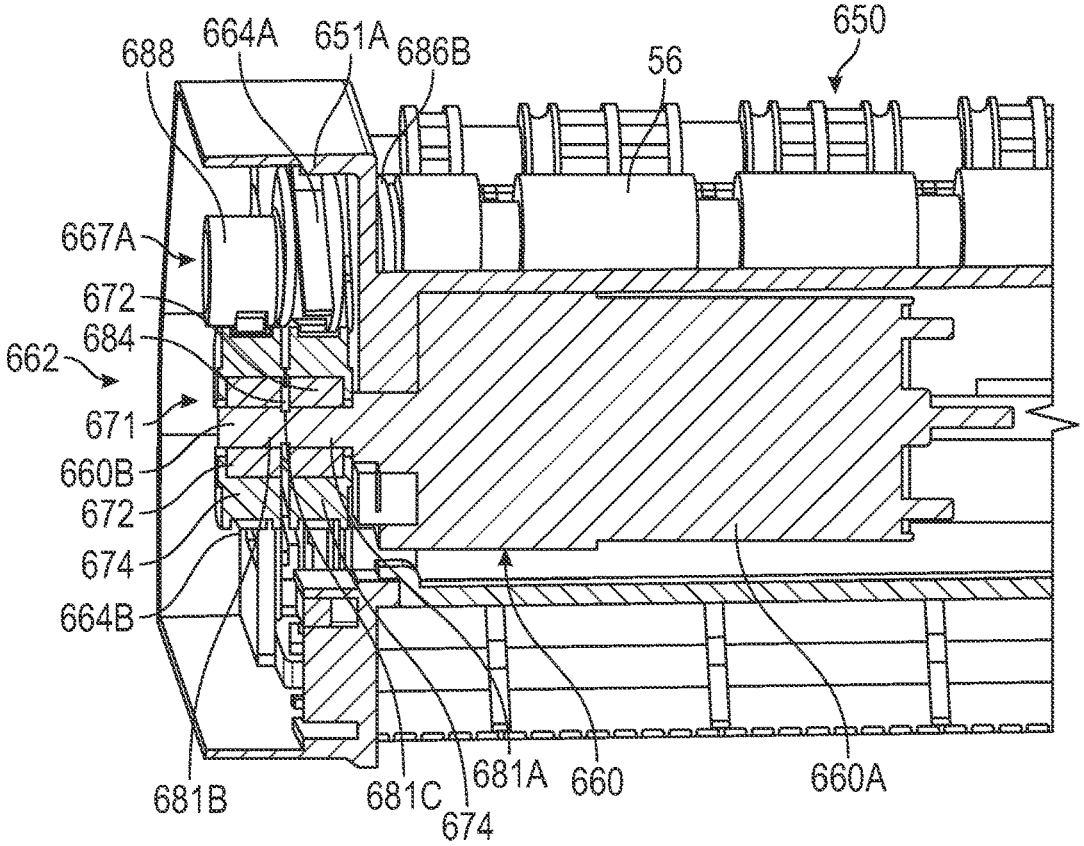
FIGS. 23-27B are views of a transmission assembly of the dispensing system of FIGS. 20A-22.
Figure 24:
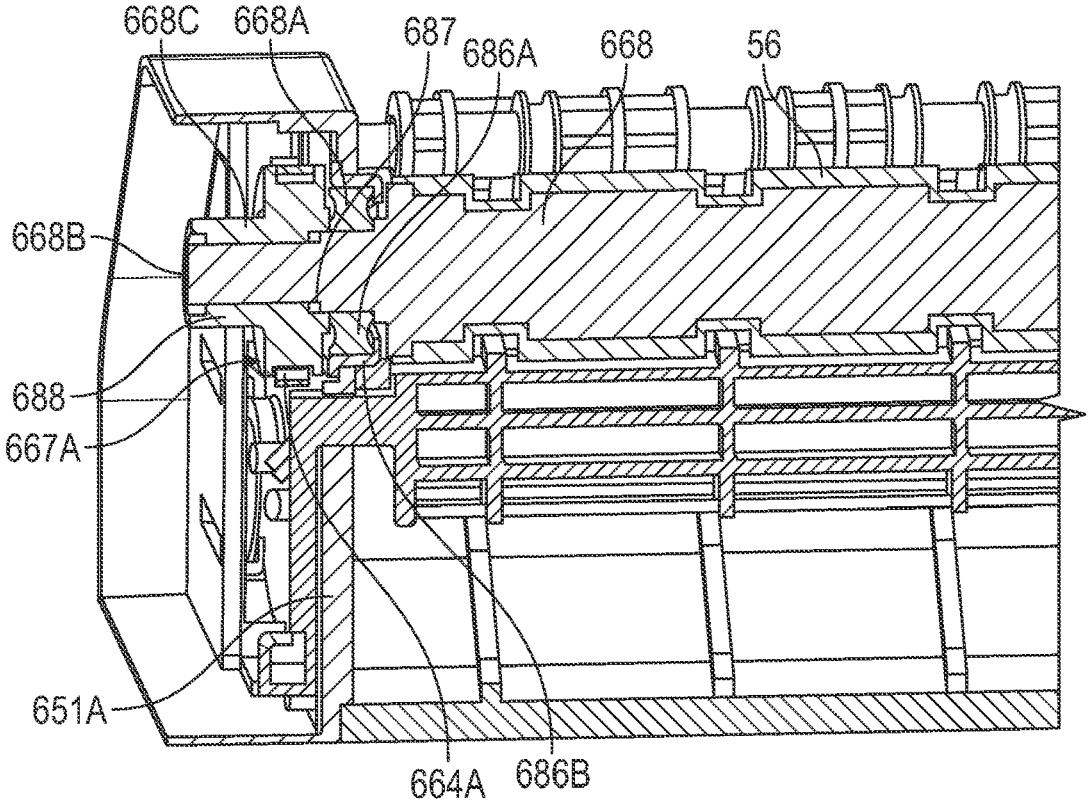

In one example construction, as generally illustrated in FIGS. 23, 25A, and 25B, each clutch assembly 670 can include one or more tracks/races, such as an inner race 672 and an outer race 674, that rotate together (when engaged) or independently of one another (when disengaged). In exemplary embodiments, the inner and outer races 672, 674 of the clutch assemblies 670 can be configured in a similar or identical manner as the inner and outer races 72, 74 of FIG. 2B. Alternatively, one or both of the clutch assemblies 670 could be otherwise configured without departing from the scope of the application. In an exemplary embodiment, both of the inner races 672 of the drive gears 671A, 671B are turned by the drive shaft 660B when the motor 660A turns the drive shaft in either direction D1, D2. However, in operation, the clutch assemblies 670 are configured so that, when the drive shaft 660B is turned in the direction D1, only the clutch assembly 670 of the proximal drive gear 671A engages to cause the outer race 674 to turn with the inner race 672, thereby moving the first drive belt 664A, which turns the first belt gear 667A and the first driven roller 56. The clutch assembly 670 of the distal drive gear 671B is disengaged so that the inner race 672 and the outer race 674 are able to rotate independently when the drive shaft 660B is rotated in the direction D1 and the outer race 674 does not rotate with the inner race 672 so that the second drive belt 664B, the second belt gear 667B, and the second driven roller 58 are not turned. Similarly, when the drive shaft 660B is operationally turned in the direction D2, only the clutch assembly 670 of the distal drive gear 671B engages to cause the outer race 674 to turn with the inner race 672, thereby moving the second drive belt 664B, which turns the second belt gear 667B and the second driven roller 58. In this aspect, the clutch assembly 670 of the proximal drive gear 671A is disengaged so that the inner race 672 and the outer race 674 are able to rotate independently when the drive shaft 660B is rotated in the direction D2 and the outer race 674 does not rotate with the inner race 672 so that the first drive belt 664A, the first belt gear 667A, and the first driven roller 56 are not turned.

In the illustrated embodiments, the proximal and distal drive gears 671A, 671B can be similar or identical to one another and can be mounted on the drive shaft 660B in opposite orientations (FIGS. 22, 23, 25A, and 25B). Alternatively, in other exemplary embodiments, the drive gears 671A, 671B could be configured differently.

Figure 22:
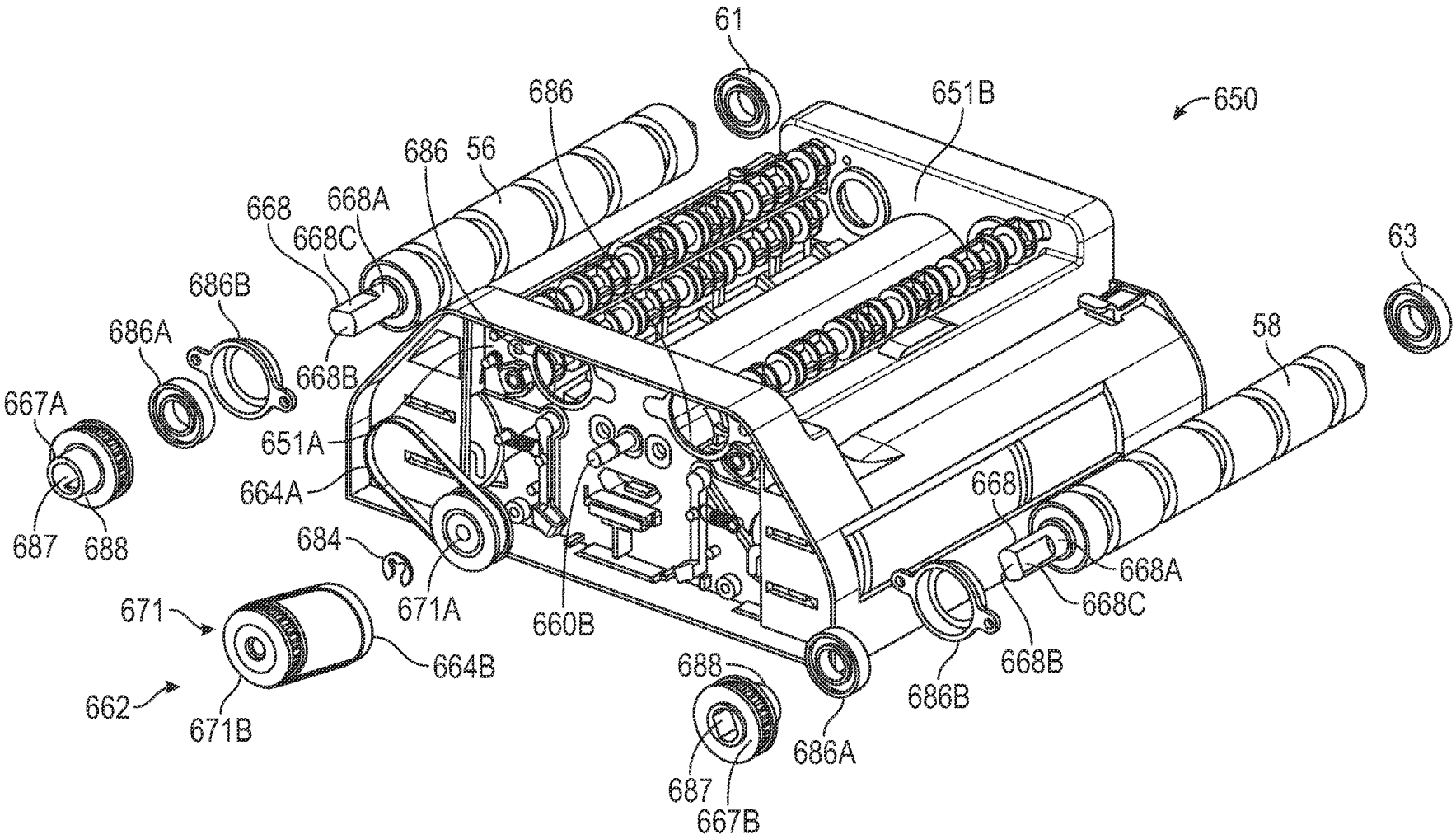

As shown in FIGS. 21A-22, 24, 26A, and 26B, the belt gears 667A, 667B are mounted to respective drive shafts or roller extensions 668 of the respective driven rollers 56, 58. As shown in FIG. 22, each of the roller extensions 668 includes a cylindrical portion 668A that is supported in a respective opening 686 of the end plate 651A by a bearing 686A and/or a bushing 686B (e.g., the cylindrical portion 668A engages an inner race of the bearing 686A or an inner surface of the bushing 686B). In optional embodiments, a distal section 668B of the roller extension 668 can be configured to mate with or otherwise engage a central bore 687 of the respective belt gear 667A, 667B. For example, in an optional aspect, the distal section 668B can have a flat surface 668C on either side of the roller extension 668, and the flat surfaces 668C can engage respective flat surfaces on the interior surface of the belt gear extending along the central bore 687. Accordingly, operable rotation of the belt gears 667A, 667B can cause the respective roller extension 668 to turn, thereby turning the respective driven roller 56, 58.

Figure 27A:
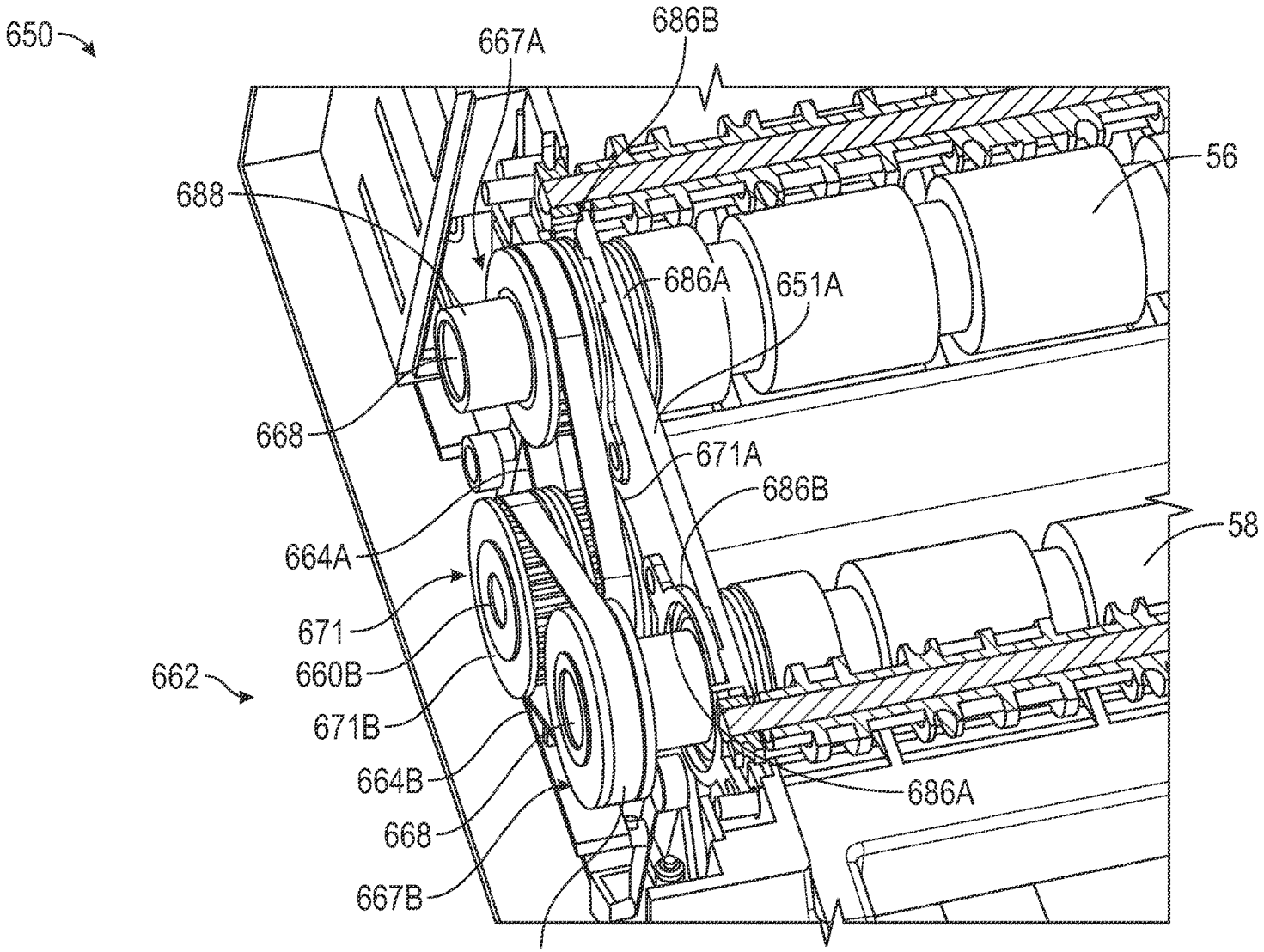
Figure 27B:
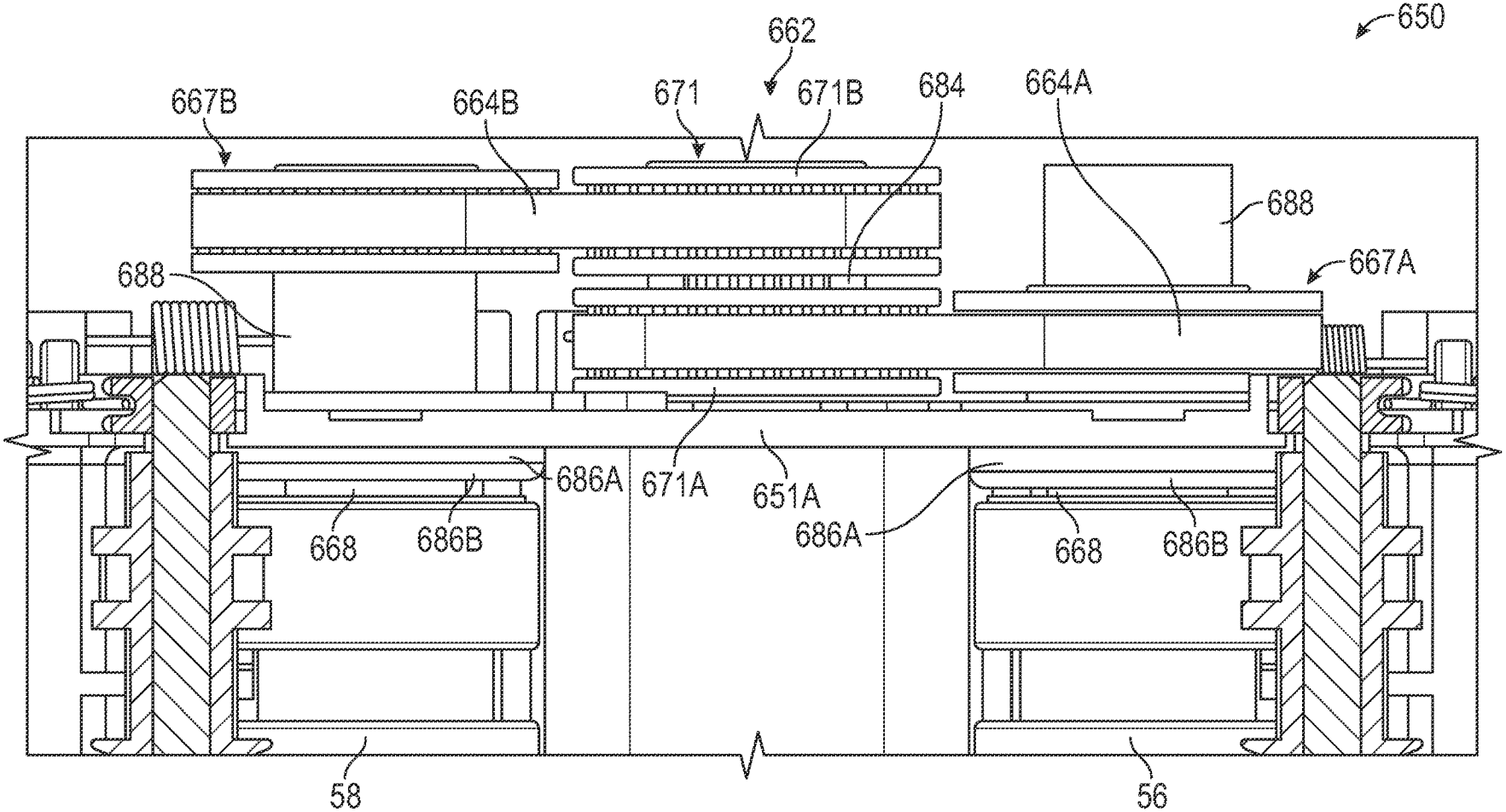

As shown in FIGS. 27A and 27B, the belt gears 667A, 667B can be similar or identical to one another and can be mounted on the respective roller extensions 668 in opposite orientations in order to align the belt engaging portions of the belt gears 667A, 667B with the respective drive gears 671A, 671B. For example and without limitation, each of the belt gears 667A, 667B can include a spacer portion 688. In this aspect, it is contemplated that the second belt gear 667B can be oriented so that the spacer portion 688 is positioned between the belt engaging portion of the belt gear and the end plate 651A, and the spacer portion 688 of the first belt gear 667A is spaced from the end plate 651A by the belt engaging portion of the belt gear. The belt gears 667A, 667B could be otherwise configured and/or could be optionally configured different from one another (e.g., the spacer portion 688 could be omitted on the first belt gear 667A).

In embodiments, the transmission assembly 662 of FIGS. 20A-27B can be easier to assemble due to the central location of the gear clutch assembly 671. In addition, the belt gears 667A, 667B, located at the outer portions of the transmission assembly, can be desirably made of lighter, cheaper materials (e.g., plastic instead of metal). In embodiments, the configuration of the transmission assembly 662 can be quieter and can increase the efficiency of the dispensing system 650.

Figure 28B:
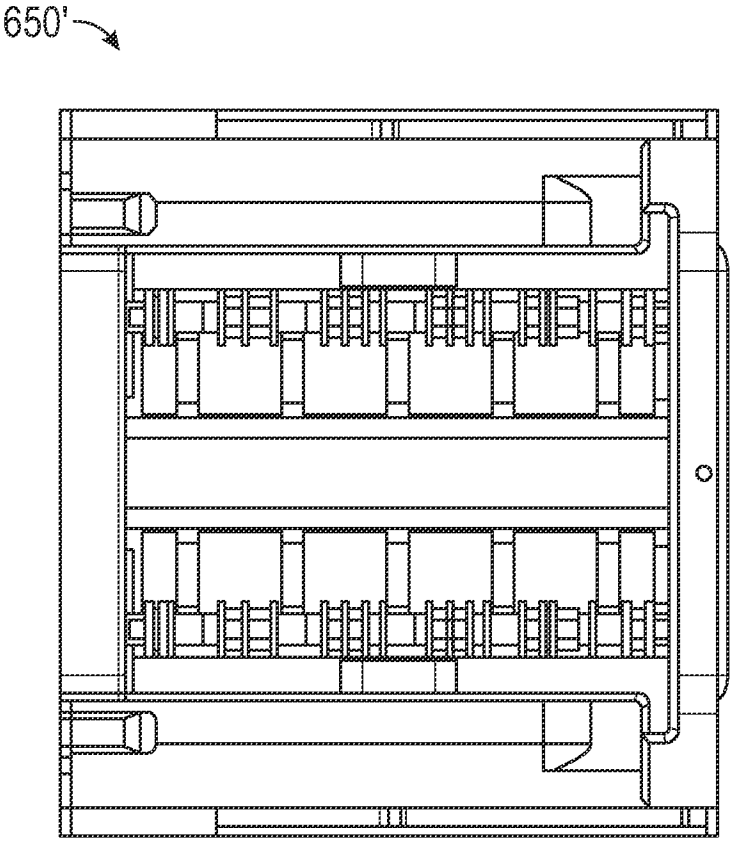
FIGS. 28A and 28B show views of other embodiments of a dispensing system.
Figure 28A:
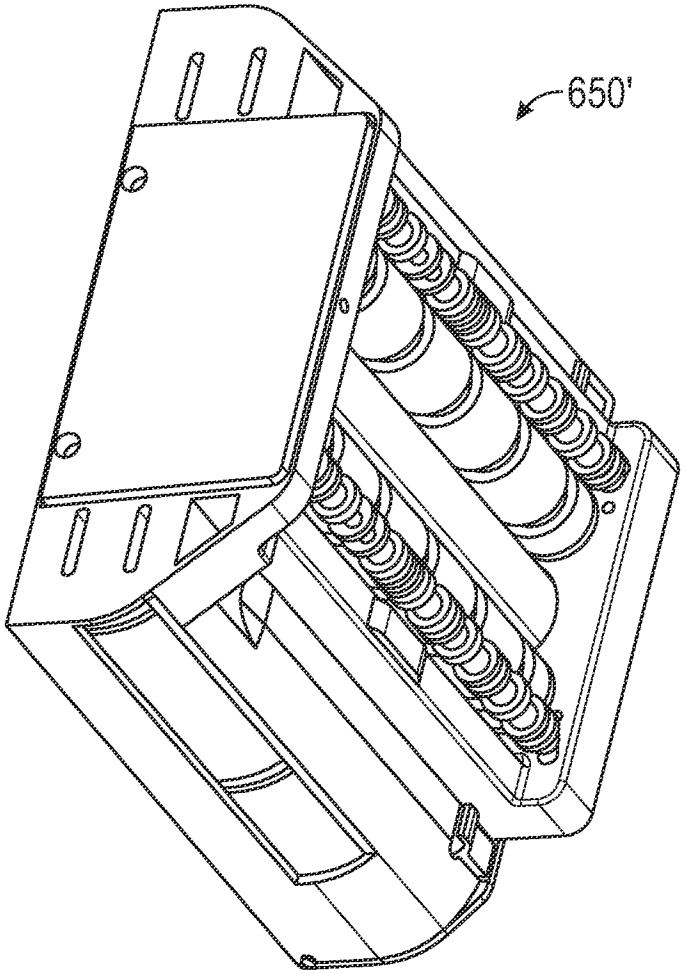
Figure 28C:
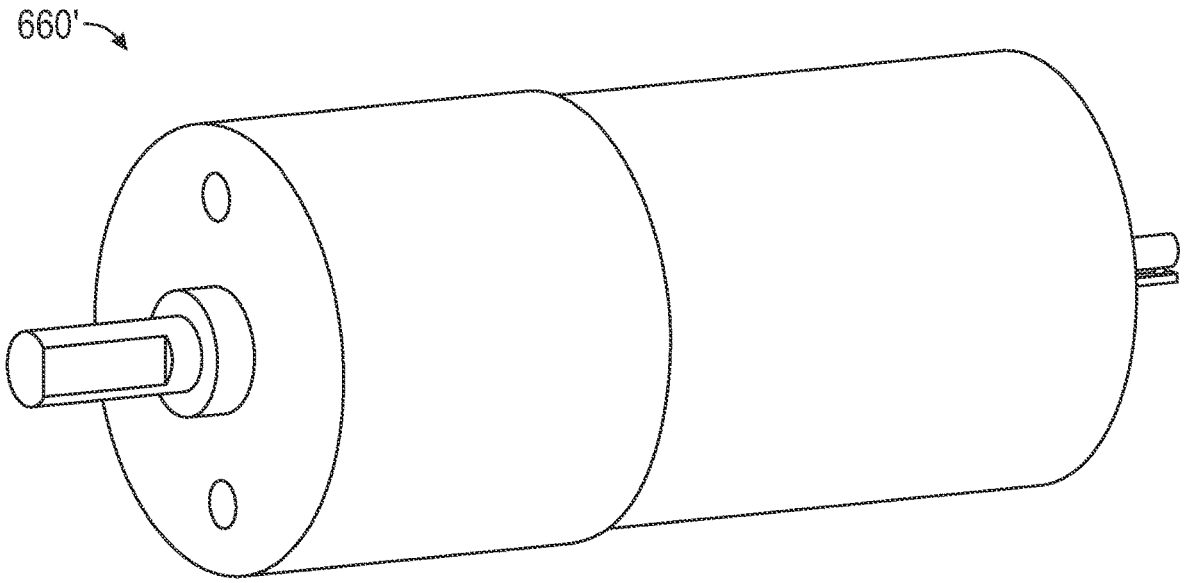
FIGS. 28C and 28D show views of other embodiments of a drive mechanism for a dispensing system.
Figure 28D:
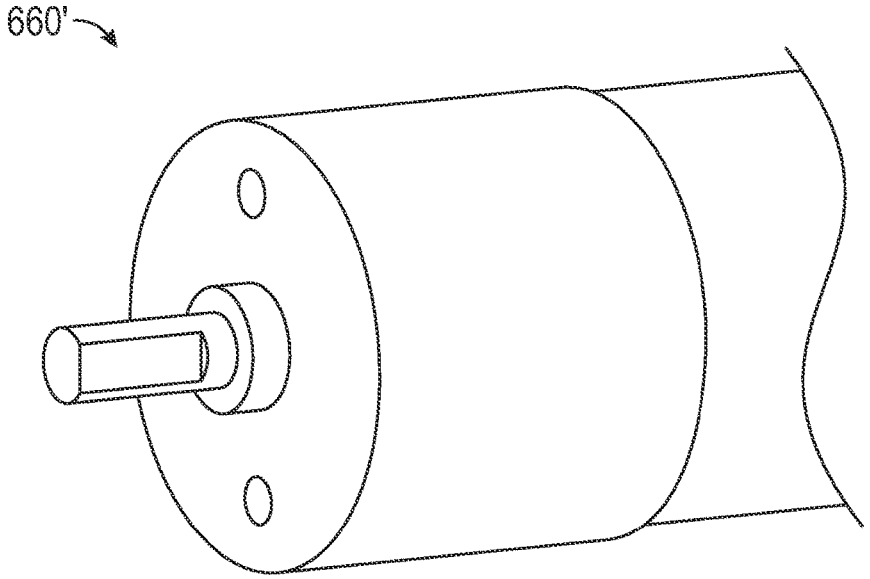

FIGS. 28A and 28B show views of other optional embodiments of a dispensing system 650', and FIGS. 28C and 28D show views of other optional embodiments of a drive mechanism 660'.

In one exemplary embodiment, it is contemplated that the sheet material dispenser can include a dispenser housing with a first and a second supply of sheet material supported therein and including a first driven roller rotatably mounted within the dispenser housing that is configured to drive sheet material from the first supply of sheet material and a second driven roller rotatably mounted within the dispenser housing that is configured to drive sheet material from the second supply of sheet material. In this aspect, the sheet material dispenser further can include a drive mechanism operably coupled to a select one of the first or second driven roller to selectively drive rotation of the select one of the first or the second driven roller. In this exemplary aspect, it is contemplated that the drive mechanism comprises a transmission assembly configured to selectively drive rotation of the select one of the first or the second driven roller; and a motor configured to drive in a first rotation direction to cause the transmission assembly to disengage with the second driven roller and engage and rotate the first driven roller to affect the movement of the sheet material from the first supply of sheet material along a first discharge path toward and out from a discharge defined in the dispenser housing. In this aspect, the motor is further configured to drive in a second rotation direction, opposite to the first rotation direction, to cause the transmission assembly to disengage with the first driven roller and to engage and rotate the second driven roller to affect the movement of sheet material from the second supply of sheet material along a second discharge path toward and out from the discharge of the dispenser housing. The sheet material dispenser can further include a control circuitry in communication with the drive mechanism that is programmed to selectively actuate the motor in the first or second rotative direction to feed the sheet material from the selected supply of sheet material through the discharge defined in the dispenser housing.

In a further exemplary aspect, the transmission assembly of the sheet material dispenser can include a plurality of gears for transferring power from the drive mechanism to a select one of the first or the second driven roller. For example, and without limitation, the plurality of gears can comprise a drive gear, an intermediate gear, a first roller gear, and a second roller gear. In this exemplary aspect, the drive gear is mounted to the motor and the intermediate gear is configured to be slidably received within a transmission guide defined in the first end plate of the housing that extends along a path between the respective first and second driven rollers. As shown, the intermediate gear is positioned in engagement with the drive gear and rotates in a direction that is in opposition to the select first or second rotation direction of the motor.

Further, the first roller gear is mounted to a distal end of the first driven roller and the second roller gear is mounted to a distal end of the second drive roller. As shown, the selective rotation of a respective first or second roller gear affects a complementary rotation of the coupled first or second driven roller. More particularly, in this exemplary aspect, the first roller gear is mounted proximate a first end of the transmission guide so that the first roller gear is configured to engage the intermediate gear when the intermediate gear is at the first end of the transmission guide. Similarly, the second roller gear is mounted proximate a second end of the transmission guide so that the second roller gear is configured to engage the intermediate gear when the intermediate gear is at the second end of the transmission guide.

In another aspect, the sheet material dispenser can further include a first guide roller and a second guide roller. In this aspect, the dispenser housing has a first end plate and a second, spaced and opposed, end plate and, as shown, each respective end plate can define a slot. It is contemplated that the first and second guide rollers can be configured for mounting therein the respective slots of the first and second end plates and can be further configured for biased movement along the respective slots of the first and second end plates such that the respective first and second guide rollers are urged toward the respective first and second driven rollers. In this exemplary aspect, each of the first and second guide rollers can include a pair of bearing assemblies positioned so that one bearing assembly of the pair of bearing assemblies can be positioned at a proximal end of the respective guide roller and another bearing assembly of the pair of bearing assemblies can be positioned at a distal end of the respective guide roller.

Still further, it is contemplated in this aspect that the sheet material dispenser can include a first biasing member mounted within the dispenser housing that is configured to urge the first guide roller along the slots and toward the first driven roller and a second biasing member mounted within the dispenser housing configured to urge the second guide roller along the slots and toward the second driven roller.

In another exemplary embodiment, it is contemplated that the sheet material dispenser can include a dispenser housing, a first driven roller, a second driven roller, a drive mechanism, and a control circuitry. In this aspect, the dispenser housing has a first and a second supply of sheet material supported therein the housing. Further, the first driven roller is configured to be rotatably mounted within the dispenser housing to drive sheet material from the first supply of sheet material and, similarly, the second driven roller is configured to be rotatably mounted within the dispenser housing to drive sheet material from the second supply of sheet material.

As exemplarily illustrated, the drive mechanism is operably coupled to a select one of the first or second driven roller to selectively drive rotation of the select one of the first or the second driven roller. In this exemplary aspect, the drive mechanism comprises a motor and a plurality of gears. The motor configured to drive in a first rotation direction and further configured to drive in a second rotation direction, opposite to the first rotation direction. For example, and without limitation, the plurality of gears for transferring power from the drive mechanism to the select one of the first or the second driven roller includes a drive gear, an intermediate gear, a first roller gear and a second roller gear. In this exemplary aspect, the drive gear is mounted to the motor and the intermediate gear is configured to be slidably received within a transmission guide defined in the first end plate of the housing that extends along a path between the respective first and second driven rollers. As shown, the intermediate gear is positioned in engagement with the drive gear and rotates in a direction that is in opposition to the select first or second rotation direction of the motor.

The exemplary control circuitry is in communication with the drive mechanism and is programmed to selectively actuate the motor in the first or second rotative direction to feed the sheet material from the selected supply of sheet material through the discharge defined in the dispenser housing.

In this exemplary aspect, when the motor is selectively driven in the first rotation direction, the intermediate gear engages with the first roller gear and disengages from the second roller gear to affect the rotation of the first driven roller and to affect movement of sheet material from the first supply of sheet material along a first discharge path toward and out from the discharge. Similarly, when the motor is selectively driven in the second rotation direction, the intermediate gear disengages with the first roller gear and engages with the second roller gear to affect the rotation of the second driven roller and to affect movement of sheet material from the second supply of sheet material along a second discharge path toward and out from the discharge of the dispenser housing. More particularly, in this exemplary aspect, it is contemplated that the first roller gear is mounted proximate a first end of the transmission guide so that the first roller gear is configured to engage the intermediate gear when the intermediate gear is at the first end of the transmission guide, Similarly, it is contemplated that the second roller gear is mounted proximate a second end of the transmission guide so that the second roller gear is configured to engage the intermediate gear when the intermediate gear is at the second end of the transmission guide.

In a further exemplary embodiment, it is contemplated that the sheet material dispenser can include a dispenser housing, a first driven roller, a second driven roller, and a drive mechanism operably coupled the first and second driven rollers. In this aspect, the dispenser housing has a first and a second supply of sheet material supported therein. Further, the first driven roller is configured to be rotatably mounted within the dispenser housing to drive sheet material from the first supply of sheet material and the second driven roller is configured to be rotatably mounted within the dispenser housing to drive sheet material from the second supply of sheet material. In this exemplary aspect, the sheet material dispenser can further include a control circuitry in communication with the drive mechanism that is programmed to selectively actuate the motor in the first or second rotative direction to feed the sheet material from the selected supply of sheet material through the discharge defined in the dispenser housing.

In this exemplary aspect and as illustrated, the drive mechanism can include a motor, a first and second belt gear, a first and second drive gear, and respective first and second drive belts, and a plurality of clutch assemblies. In this aspect, the motor is configured to drive in a first rotation direction and in a second, opposite, rotation direction and further has a drive shaft that has a proximal section and a spaced distal section.

In further exemplary aspects, the first belt gear is coupled to the first driven roller and the second belt gear is coupled to the second driven roller. Further, as shown, the first drive gear is mounted on the proximal section of the drive shaft and the second drive gear is mounted on the distal section of the drive shaft. As further shown, the first drive belt is configured to engage the first belt gear and the first drive gear and similarly, the second drive belt is configured to engage the second belt gear and the second drive gear.

At least one clutch assembly of the a plurality of clutch assemblies is configured to be operably integrated with the first drive gear and at least one clutch assembly configured to be operably integrated with the second drive gear. In this aspect, upon selective rotation of the motor in the first rotation direction, the at least one clutch assembly that is configured to be operably integrated with the first drive gear disengages from the second drive gear and operatively engages the first drive gear to affect transfer of torque to the first drive gear so that the first driven roller is driven by the first drive belt and first drive gear to rotate and dispense its supply of sheet material. Similarly, upon selective rotation of the motor in the second rotation direction, the at least one clutch assembly that is configured to be operably integrated with the second drive gear disengages from the first drive gear and operatively engages the second drive gear to affect transfer of torque to the second drive gear so that the first driven roller is driven by the second drive belt and second drive gear to rotate and dispense its supply of sheet material.

Exemplarily, each clutch assembly can include an inner race and an outer race that are configured to rotate together when the clutch assembly is engaged and are configured to act independently of one another when the clutch assembly is disengaged. In operation, when the drive shaft is turned in the first rotative direction, each clutch assembly is configured so that the at least one clutch assembly integrated with the first drive gear engages to cause the respective clutch assembly outer race to turn with the inner race, affecting movement of the first drive belt and rotation of the first belt gear and the first driven roller. Additionally, when the drive shaft is turned in the first rotative direction, the at least one clutch assembly integrated with the second drive gear is disengaged so that the respective clutch assembly inner race and the outer race rotate independently of each other such that the outer race does not rotate with the inner race and no movement is affected on the second drive belt.

In a similar embodiment in operation, when the drive shaft is turned in the second rotative direction, each clutch assembly is configured so that only the at least one clutch assembly integrated with the second drive gear engages to cause the respective clutch assembly outer race to turn with the inner race, affecting movement of the second drive belt and rotation of the second belt gear and the second driven roller. Thus, when the drive shaft is turned in the second rotative direction, the at least one clutch assembly integrated with the first drive gear is disengaged so that the respective clutch assembly inner race and the outer race rotate independently of each other such that the outer race does not rotate with the inner race and no movement is affected on the first drive belt.

Any of the features of the various embodiments of the disclosure can be combined with replaced by, or otherwise configured with other features of other embodiments of the disclosure without departing from the scope of this disclosure.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A sheet material dispenser, comprising:

a dispenser housing with a first and a second supply of sheet material supported therein;

a first driven roller rotatably mounted within the dispenser housing and configured to drive sheet material from the first supply of sheet material;

a second driven roller rotatably mounted within the dispenser housing and configured to drive sheet material from the second supply of sheet material;

a drive mechanism operably coupled to a select one of the first or second driven roller to selectively drive rotation of the select one of the first or the second driven roller, the drive mechanism comprising:

a transmission assembly configured to selectively drive rotation of the select one of the first or the second driven roller; and a motor configured to drive in a first rotation direction to cause the transmission assembly to disengage with the second driven roller and engage and rotate the first driven roller to affect movement of the sheet material from the first supply of sheet material along a first discharge path toward and out from a discharge defined in the dispenser housing and further configured to drive in a second rotation direction, opposite to the first rotation direction, to cause the transmission assembly to disengage with the first driven roller and to engage and rotate the second driven roller to affect the movement of sheet material from the second supply of sheet material along a second discharge path toward and out from the discharge of the dispenser housing; and a control circuitry in communication with the drive mechanism, the control circuitry including programming configured to selectively actuate the motor to drive in the first or second rotation direction to feed the sheet material from a selected supply of the sheet material through the discharge defined in the dispenser housing.

2. The sheet material dispenser of claim 1, wherein the transmission assembly comprises a plurality of gears for transferring power from the drive mechanism to a select one of the first or the second driven roller, the plurality of gears comprising;

a drive gear mounted to the motor;

an intermediate gear configured to be slidably received within a transmission guide defined in a first end plate of the housing that extends along a path between the respective first and second driven rollers, wherein the intermediate gear is positioned in engagement with the drive gear and rotates in a direction that is in opposition to the selected first or second rotation direction of the motor;

a first roller gear mounted to a distal end of the first driven roller; and a second roller gear mounted to a distal end of the second drive roller, wherein selective rotation of a respective first or second roller gear affects a complementary rotation of the coupled first or second driven roller.

3. The sheet material dispenser of claim 2, wherein the first roller gear is mounted proximate a first end of the transmission guide so that the first roller gear is configured to engage the intermediate gear when the intermediate gear is at the first end of the transmission guide and wherein the second roller gear is mounted proximate a second end of the transmission guide so that the second roller gear is configured to engage the intermediate gear when the intermediate gear is at the second end of the transmission guide.

4. The sheet material dispenser of claim 1, further comprising a first guide roller and a second guide roller, wherein the dispenser housing has a first end plate and a second end plate, spaced and from opposite the first end plate, wherein each end plate defines a slot, and wherein the first and second guide rollers are configured for mounting therein the respective slots of the first and second end plates and are configured for biased movement along the respective slots of the first and second end plates such that the respective first and second guide rollers are urged toward the respective first and second driven rollers.

5. The sheet material dispenser of claim 4, wherein each first and second guide rollers further comprises a pair of bearing assemblies, one bearing assembly of the pair of bearing assemblies being positioned at a proximal end of the respective guide roller and another bearing assembly of the pair of bearing assemblies being positioned at a distal end of the respective guide roller.

6. The sheet material dispenser of claim 4, further comprising a first biasing member mounted within the dispenser housing configured to urge the first guide roller along the slots and toward the first driven roller; and a second biasing member mounted within the dispenser housing configured to urge the second guide roller along the slots and toward the second driven roller.

7. A sheet material dispenser, comprising:

a dispenser housing with a first and a second supply of sheet material supported therein;

a first driven roller rotatably mounted within the dispenser housing and configured to drive sheet material from the first supply of sheet material;

a second driven roller rotatably mounted within the dispenser housing and configured to drive sheet material from the second supply of sheet material;

a drive mechanism operably coupled to a select one of the first or second driven roller to selectively drive rotation of the select one of the first or the second driven roller, the drive mechanism comprising:

a motor configured to drive in a first rotation direction and further configured to drive in a second rotation direction, opposite to the first rotation direction;

a plurality of gears for transferring power from the drive mechanism to the select one of the first or the second driven roller, the plurality of gears comprising;

a drive gear mounted to the motor;

an intermediate gear configured to be slidably received within a transmission guide defined in a first end plate of the housing that extends along a path between the respective first and second driven rollers, wherein the intermediate gear is positioned in engagement with the drive gear and rotates in a direction that is in opposition to the select first or second rotation direction of the motor;

a first roller gear mounted to a distal end of the first driven roller; and a second roller gear mounted to a distal end of the second drive roller, wherein selective rotation of a respective first or second roller gear affects a complementary rotation of the coupled first or second driven roller; and a control circuitry in communication with the drive mechanism that is programmed to selectively actuate the motor to drive in the first or second rotation direction to feed the sheet material from a selected supply of the first supply of sheet material or the second supply of sheet material through a discharge defined in the dispenser housing.

8. The sheet material dispenser of claim 7, wherein the motor is selectively driven in the first rotation direction to cause the intermediate gear to engage with the first roller gear and disengage from the second roller gear to affect the rotation of the first driven roller and to affect movement of sheet material from the first supply of sheet material along a first discharge path toward and out from the discharge and is further configured to be selectively driven in the second rotation direction to cause the intermediate gear to disengage with the first roller gear and to engage with the second roller gear to affect the rotation of the second driven roller and to affect movement of sheet material from the second supply of sheet material along a second discharge path toward and out from the discharge of the dispenser housing.

9. The sheet material dispenser of claim 8, wherein the first roller gear is mounted proximate a first end of the transmission guide so that the first roller gear is configured to engage the intermediate gear when the intermediate gear is at the first end of the transmission guide and wherein the second roller gear is mounted proximate a second end of the transmission guide so that the second roller gear is configured to engage the intermediate gear when the intermediate gear is at the second end of the transmission guide.

10. The sheet material dispenser of claim 7, further comprising a first guide roller and a second guide roller, wherein the dispenser housing has a first end plate and a second end plate, spaced from and opposite the end plate, wherein each end plate defines a slot, and wherein the first and second guide rollers are configured for mounting therein the respective slots of the first and second end plates and are configured for biased movement along the respective slots of the first and second end plates such that the respective first and second guide rollers are urged toward the respective first and second driven rollers.

11. A sheet material dispenser, comprising:

a dispenser housing with a first and a second supply of sheet material supported therein;

a first driven roller rotatably mounted within the dispenser housing and configured to drive sheet material from the first supply of sheet material;

a second driven roller rotatably mounted within the dispenser housing and configured to drive sheet material from the second supply of sheet material;

a drive mechanism operably coupled the first and second driven rollers to selectively drive rotation of a select one of the first or the second driven rollers, the drive mechanism comprising:

a motor having a drive shaft that has a proximal section and a spaced distal section, wherein the motor is configured to drive in a first rotation direction and in a second, opposite, rotation direction;

a first belt gear coupled to the first driven roller and a second belt gear coupled to the second driven roller;

a first drive gear mounted on the proximal section of the drive shaft and a second drive gear mounted on the distal section of the drive shaft;

a first drive belt configured to engage the first belt gear and the first drive gear and a second drive belt configured to engage the second belt gear and the second drive gear; and a plurality of clutch assemblies, at least one clutch assembly configured to be operably integrated with the first drive gear and at least one clutch assembly configured to be operably integrated with the second drive gear, wherein, upon selective rotation of the motor in the first rotation direction, the at least one clutch assembly configured to be operably integrated with the first drive gear disengages with the second drive gear and operatively engages the first drive gear to affect transfer of torque to the first drive gear so that the first driven roller is driven by the first drive belt and first drive gear to rotate and dispense its supply of sheet material, and wherein, upon selective rotation of the motor in the second rotation direction, the at least one clutch assembly configured to be operably integrated with the second drive gear disengages with the first drive gear and operatively engages the second drive gear to affect transfer of torque to the second drive gear so that the first driven roller is driven by the second drive belt and second drive gear to rotate and dispense its supply of sheet material.

12. The sheet material dispenser of claim 11, further comprising a control circuitry in communication with the drive mechanism that is programmed to selectively actuate the motor to drive in the first or second rotation direction to feed the sheet material from a selected supply of the first supply of sheet material or the second supply of sheet material through a discharge defined in the dispenser housing.

13. The sheet material dispenser of claim 11, wherein each clutch assembly comprises an inner race and an outer race that are configured to rotate together when the clutch assembly is engaged and are configured to act independently of one another when the clutch assembly is disengaged.

14. The sheet material dispenser of claim 13, wherein each clutch assembly is configured so that, when the drive shaft is turned in the first rotation direction, the at least one clutch assembly integrated with the first drive gear engages to cause the outer race thereof to turn with the inner race, affecting movement of the first drive belt and rotation of the first belt gear and the first driven roller, and wherein, when the drive shaft is turned in the first rotation direction, the at least one clutch assembly integrated with the second drive gear is disengaged so that the inner race and the outer race thereof rotate independently of each other such that the outer race does not rotate with the inner race and no movement is affected on the second drive belt.

15. The sheet material dispenser of claim 14, wherein each clutch assembly is configured so that, when the drive shaft is turned in the second rotation direction, the at least one clutch assembly integrated with the second drive gear engages to cause the outer race thereof to turn with the inner race, affecting movement of the second drive belt and rotation of the second belt gear and the second driven roller, and wherein, when the drive shaft is turned in the second rotation direction, the at least one clutch assembly integrated with the first drive gear is disengaged so that the inner race and the outer race thereof rotate independently of each other such that the outer race does not rotate with the inner race and no movement is affected on the first drive belt.

16. A sheet material dispenser, comprising:

a dispenser housing with a first and a second supply of sheet material supported therein;

a first driven roller rotatably mounted within the dispenser housing and configured to drive sheet material from the first supply of sheet material;

a second driven roller rotatably mounted within the dispenser housing and configured to drive sheet material from the second supply of sheet material;

a drive mechanism operably coupled the first and second driven rollers to selectively drive rotation of a select one of the first or the second driven rollers, the drive mechanism comprising:

a motor having a drive shaft that has a proximal section and a spaced distal section, wherein the motor is configured to drive in a first rotation direction and in a second, opposite, rotation direction;

a first drive gear mounted on the proximal section of the drive shaft and a second drive gear mounted on the distal section of the drive shaft; and a plurality of clutch assemblies configured to be operably integrated with the first drive gear and with the second drive gear, wherein, upon selective rotation of the motor in the first rotation direction, at least one clutch assembly disengages from the second drive gear and operatively engages the first drive gear to affect transfer of torque to the first drive gear so that the first driven roller is driven to rotate and dispense its supply of sheet material, and wherein, upon selective rotation of the motor in the second rotation direction, the at least one clutch assembly disengages from the first drive gear and operatively engages the second drive gear to affect transfer of torque to the second drive gear so that the first driven roller to rotate and dispense its supply of sheet material.

17. The sheet material dispenser of claim 16, further comprising a control circuitry in communication with the drive mechanism that is programmed to selectively actuate the motor in the first or second rotation direction to feed the sheet material from a selected one of the first supply of sheet material or the second supply of sheet material through a discharge defined in the dispenser housing.

18. The sheet material dispenser of claim 16, wherein each clutch assembly comprises an inner race and an outer race that are configured to rotate together when the clutch assembly is engaged and are configured to act independently of one another when the clutch assembly is disengaged.

19. The sheet material dispenser of claim 18, wherein each clutch assembly is configured so that, when the drive shaft is turned in the first rotation direction, the at least one clutch assembly integrated with the first drive gear engages to cause the outer race thereof to turn with the inner race, affecting movement of the first driven roller, wherein, when the drive shaft is turned in the first rotation direction, the at least one clutch assembly integrated with the second drive gear is disengaged so that the inner race and the outer race thereof rotate independently of each other such that the outer race does not rotate with the inner race and no movement is affected on the second driven roller, wherein, when the drive shaft is turned in the second rotation direction, the at least one clutch assembly integrated with the second drive gear engages to cause the outer race thereof to turn with the inner race, affecting movement of the second driven roller, and wherein, when the drive shaft is turned in the second rotation direction, the at least one clutch assembly integrated with the first drive gear is disengaged so that the inner race and the outer race thereof rotate independently of each other such that the outer race does not rotate with the inner race and no movement is affected on the second driven roller.

* * * * *